United States Patent [19]

Fiedler et al.

[11] 4,323,896

[45] Apr. 6, 1982

[54] HIGH RESOLUTION VIDEO DISPLAY SYSTEM

[75] Inventors: Wayne Fiedler, Burbank; Gregory E. Slobodzian, Bartlett, both of Ill.

[73] Assignee: Stewart-Warner Corporation, Chicago, Ill.

[21] Appl. No.: 245,344

[22] PCT Filed: Mar. 18, 1980

[86] PCT No.: PCT/US80/00280

§ 371 Date: Mar. 18, 1980

§ 102(e) Date: Mar. 18, 1980

[51] Int. Cl.[3] ..... G09G 3/22; G09G 3/26

[52] U.S. Cl. ..... 340/800; 340/748; 340/750; 340/792; 340/801; 340/802; 358/240

[58] Field of Search ..... 358/230, 240, 241; 340/744, 748, 750, 792, 794, 800, 801, 802

[56] References Cited

U.S. PATENT DOCUMENTS

| | | |
|---|---|---|
| 3,622,695 | 11/1971 | Rugaber . |
| 3,623,070 | 11/1971 | Johnson et al. . |
| 3,627,924 | 12/1971 | Fleming et al. . |
| 3,651,511 | 3/1972 | Andrews et al. . |
| 3,728,714 | 4/1973 | Kolesar et al. . |
| 3,733,435 | 5/1973 | Chodil et al. . |
| 3,752,910 | 8/1973 | Lewis . |
| 3,761,617 | 9/1973 | Tsuchiya et al. . |
| 3,765,011 | 10/1973 | Sawyer . |
| 3,786,474 | 1/1974 | Miller . |
| 3,787,819 | 1/1974 | Busink . |
| 3,787,834 | 1/1974 | Elliott . |
| 3,793,629 | 2/1974 | Sharpless . |
| 3,798,632 | 3/1974 | Liddle . |
| 3,827,042 | 7/1974 | Mandzsu et al. . |
| 3,863,023 | 1/1975 | Schmersal et al. . |
| 3,886,403 | 5/1975 | Owaki et al. . |
| 4,149,151 | 4/1979 | Nagae et al. . |

OTHER PUBLICATIONS

Computer, vol. 7, No. 10, Oct. 1974 by R. A. Jarvis.
IEEE Transactions on Computers, vol. C-19, No. 11 Nov. 1970 by D. F. Dinn et al.
1972 Article by D. E. Liddle "A Parallel Addressed, Multiplexed-Driver Plasma Display".

*Primary Examiner*—Robert L. Richardson
*Attorney, Agent, or Firm*—McDougall, Hersh & Scott

[57] ABSTRACT

A high resolution video display system suitable for use in displaying large outdoor scoreboards is disclosed. Video signals are converted from analog to digital format. Portions of the signal are selected for display on the scoreboard and the selected portions are then processed and transmitted to the scoreboard elements. A high resolution display is obtained by utilizing quantizing, selection, and transmission circuits which can operate in real time at a rate sufficiently high to keep up with the incoming video signal. This permits the system to utilize more video information than it has previously been possible to use. An additional feature of the invention is the ability to simulate a traveling sign display by causing a message to appear to move across the scoreboard.

9 Claims, 55 Drawing Figures

COMPUTER SYSTEM

COMPUTER SYSTEM

EXAMPLE OF DISPLAY BUFFER IMAGE MAP

ROTATOR OPERATION

ROTATING CONTROL

ROTATOR TIMING

VIDEO CONVERTER

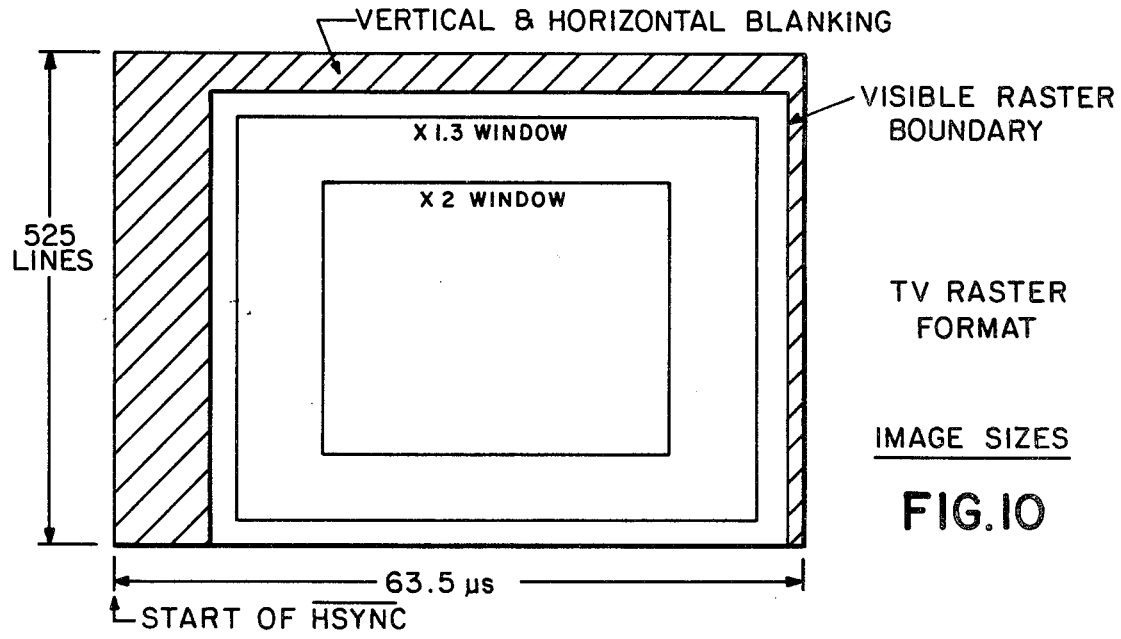
FIG. 10
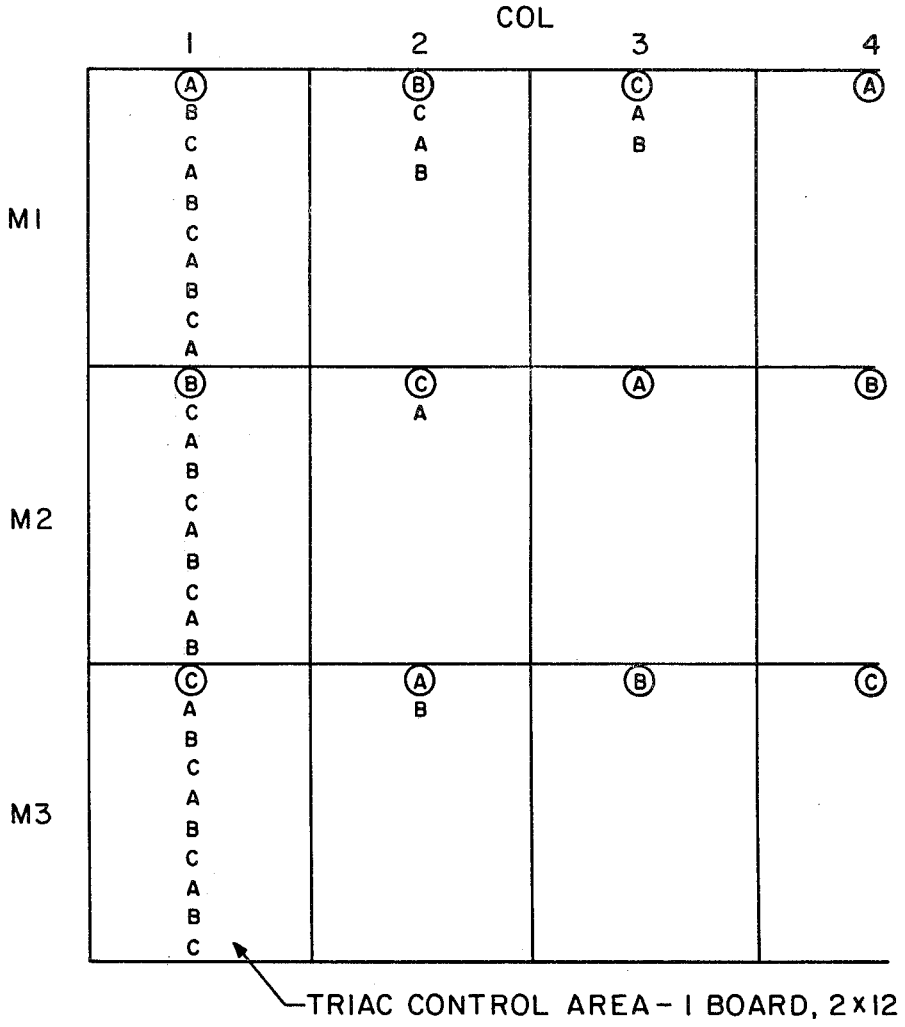
FIG. 34 COL PHASE ROTATION-TYPICAL

RESTART FLOW DIAGRAM

BACKGROUND FLOW DIAGRAM

FIG. 12
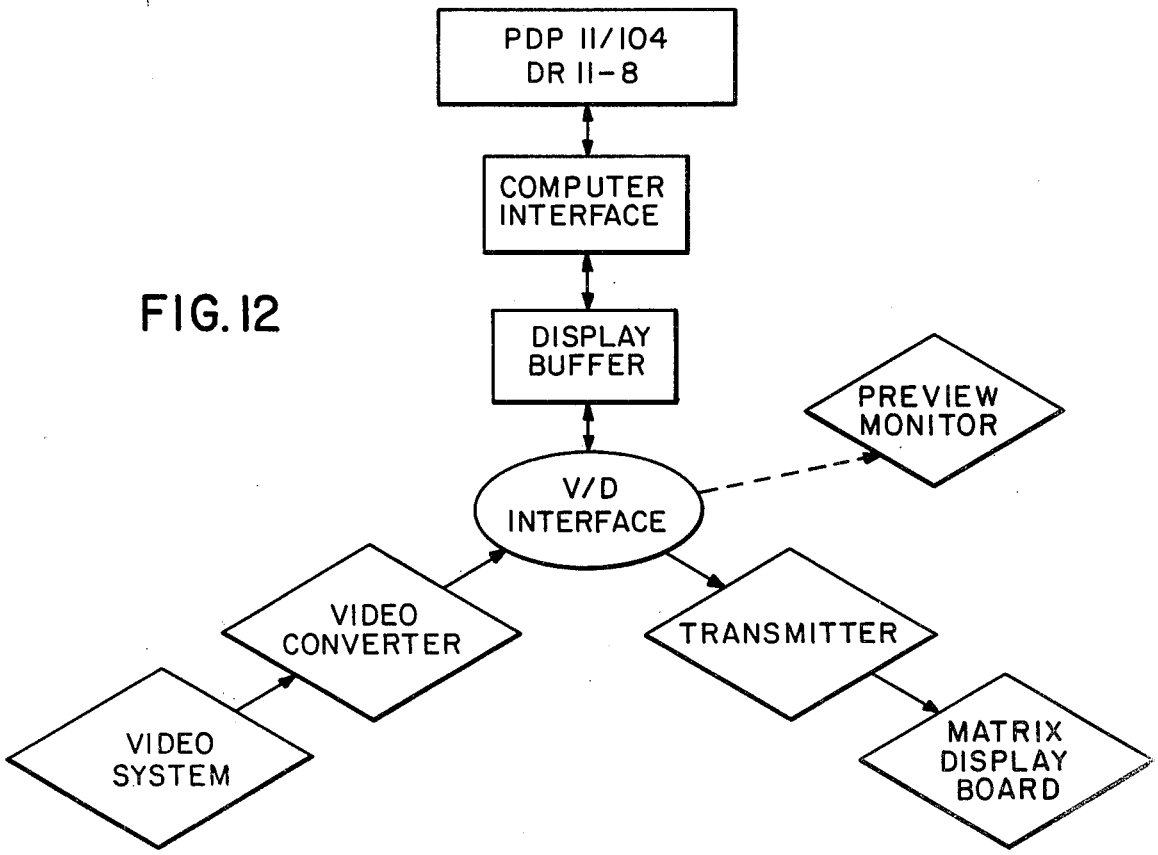
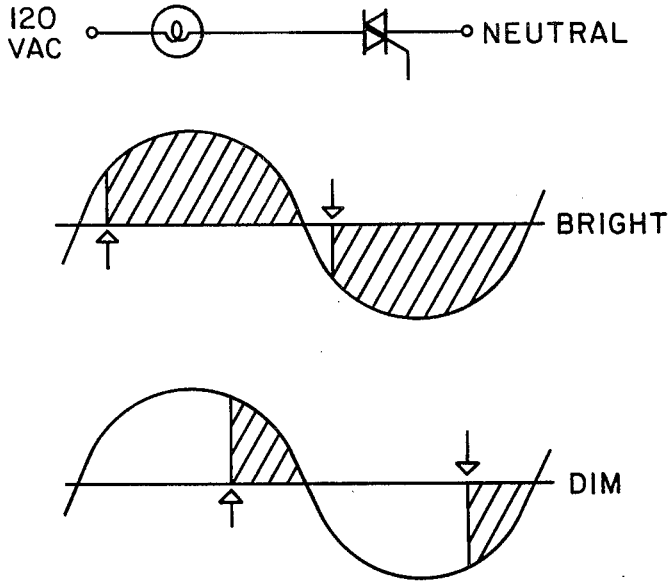
→ TRIAC FIRING POINT
▨ LAMP ON TIME
PHASE CONTROLLED DIMMING
FIG. 23

V/D INTERFACE

412
CLR
LSB
SDA
BSDA
SDB
BSDB
ADBØØ
BDBØØ
UPPER 8 PIXELS
LOWER 8 PIXELS
ADBI5
BDBI5
DBDØ
DBDI
R/W
502
HCLK
494
16 BIT WORD CNTR
496
YRENA
WSTB
INCA
DDBF

412

SDC
BSDC
490
492
CDBΦΦ
SDD
BSDD
DDBΦΦ
492
CDBI5
DDBI5
DBD2
DBD3
MHENA3
MHENA
MVENA
SLV
VDENA
SPUT
VENA
498
D Q F/F
MHENA 2
D F/F
500
MVLENA
HSYNC
HSYNC
CLAMP
488
CLAMP

TIMING DIAGRAM

TYPICAL MATRIX BOARD ADDRESSING

TRIAC BOARD ADDRESS SELECT METHOD

ΦPULSE COUNTER TIMING

DATA OUTPUT LOGIC
BLOCK DIAGRAM OF MEMORY I CIRCUITS
DRIVER BOARD

Lt POSITIONS FOR 20 ROWS WITH AN ABC ROTATION

ΦP OUTPUTS FOR A CAB ROTATION

HIGH RESOLUTION VIDEO DISPLAY SYSTEM

BACKGROUND OF THE INVENTION

This invention relates to the field of large video display systems of the type suitable for use in stadia. Such displays are usually formed by a large matrix of variable intensity display devices as, for example, incandescent light bulbs, fluorescent light sources, light-emitting diode sources, and the like. The display devices are driven by an electronic display system, usually computer controlled. The display system receives a video input such as the line feed from a network broadcast, a video tape recording, or a signal from a live action camera. The display system digitizes the video input, producing data corresponding to the intensity level of each picture element which forms a line in a conventional television raster. The number of picture elements or sampling points and the number of lines of the raster which are digitized and subsequently used by the display system are limited by the capacity of the system to handle the incoming video data in real time.

Because the video data rates are so high it has not heretofore been possible to utilize all of the available video information for displaying images on the scoreboard portion of the display system. Instead, large portions of the video information are simply discarded and, as a result, the display image was of rather low, although acceptable, resolution. For example, in early systems referred to below, approximately 75% of the available video data was discarded by the display system. That is, these systems utilized every other line of video data in one field. As is well known in the television industry, a complete frame of video information includes two fields which are interlaced to form the complete frame.

In such prior systems, even with the reduced quantity of data it was still necessary to provide a means for storing the selected data from each frame for a time sufficient to permit its transmission to the display device. In early systems, the digitized data for a frame was stored in a computer memory and subsequently transferred from the memory to the display devices. Typically, such systems employed minicomputers of the type manufactured by Digital Equipment Corporation, Maynard, Massachusetts, such as PDP 8 and 11. Although such computers are relatively powerful devices, their data transfer rates are too low to transmit as much digitized video information, on a real-time basis, as is required for high resolution video displays. As a result, the computer represents a limiting element in the system with respect to the rate at which digitized data can be transferred to the display elements.

One way of increasing the data-handling capacity of such systems is to substitute a high-speed random-access memory, often referred to as a full-frame buffer for the computer storage. This results in a speed increase which permits improved contrast, e.g., increased number of intensity levels and better resolution, e.g., more video data utilized. In such systems, the computer retains control of the system but is removed from the data path to the display board.

This latter approach wherein a buffer is utilized produces an acceptable display image but is still not totally satisfactory from the standpoint of being able to use sufficient video information to provide high resolution and high quality video displays.

It is desirable to provide a display system which is capable of utilizing substantial portions of the available video data for each frame. In order to do so, it is necessary that the system be able to digitize and transmit the digitized video information to the display board on essentially a real time basis. By real time basis it is meant that the need for a full frame buffer memory or a full frame computer storage element is eliminated and the digitized data is transmitted directly to the display board after appropriate selection of the portions thereof to be displayed.

It is accordingly an object of the present invention to provide a high resolution video display system which can receive video data, digitize it into the intensity level information, and transmit the digitized information to a display board on a real time basis.

It is a further object of the present invention to provide a system of the type mentioned in the preceding paragraph which does not require a full frame buffer memory interposed in the data path.

Another object of the invention is to provide a display system which can simulate enlargement of selected portions of a video frame by increasing the sampling rate for a line of incoming video data and utilizing additional lines which may, in other modes of operation, be discarded.

Still a further object of the invention is the provision of display system circuits which are programmable so that various user options can be set up merely by changing program data whereby resolution, enlargement, display sizes, intensity levels, and the like can be selected for particular applications.

A further object of the invention is the provision of a novel circuit, referred to herein as a rotator, which can cause a message to appear to travel across the video display in a manner which does not require the control computer to perform the data manipulation involved therewith.

Other objects and advantages of the invention will become apparent from the remaining portions of the specification.

Prior Art Statement

In accordance with the provisions of 37 CFR 1.97, applicants state that the following patents represent the closest prior art of which they are aware: U.S. Pat. Nos. 4,009,335; 3,941,926; 3,961,365; and 4,148,073, all of which are assigned to the assignee of the present invention. These patents disclose video display systems of the present type in which, however, video data is digitized and a complete frame is stored in either a computer memory or a full frame buffer memory. The data is then taken from the memory and transferred to the display board for illuminating the display devices.

In the first-mentioned patent, a 4-shades of gray device is disclosed in which data is transmitted from the computer to the display board during a time window between processing cycles. In the second-mentioned patent, a device capable of displaying 8 or 16 shades of gray is disclosed which also employs a computer memory although there is a suggestion of employing a random-access memory to store a frame of digitized data. In the third-mentioned patent, a color display system is disclosed similar to the second-mentioned patent which, however, employs parallel data handling systems to generate information for differently colored display devices which are clustered to generate a color display. In the last-mentioned patent, a display system is disclosed in which a full frame buffer is utilized to increase the speed of the display system. The computer acts as a control device but is not directly in the data path. That patent also discloses techniques for creating an electronic enlargement by increasing the sampling rate of the incoming video information for a selected portion of the video picture. In this regard, see particularly FIGS. 4–10 and the text relating thereto.

REFERENCE TO OTHER PATENTS

Although the present invention is a unique system for displaying video images, certain portions thereof employ circuits which are common to and disclosed in the U.S. patents referenced in the Prior Art Statement. In order to reduce the amount of detailed explanation necessary in this specification, those patents are hereby incorporated by reference.

BRIEF DESCRIPTION OF THE DRAWINGS

FIG. 10 is a diagram of image sizes relative to a TV raster of 525 lines.

FIG. 12 is a block diagram indicating the manner in which the V/D interface acts to switch data transfers between various portions of the invention.

FIG. 23 is a diagram useful in explaining the technique of phase controlled dimming utilized in the present invention.

FIGS. 27-1 and 27-2 are schematic diagrams of a portion of the driver board according to the invention.

FIG. 34 is a diagram useful in explaining the phase rotation triac control areas.

I. OVERVIEW

A. THEORY OF OPERATION

The display system according to the present invention is made up of three major elements. The first consists of the computers, terminals, and video hardware. The second includes the control logic 106, which is required to interface the first element to the third. This equipment is mounted in the control room computer racks and junction boxes. The third element of the system is the video matrix display board.

B. THE COMPUTER CONTROL SYSTEM

The computer control system is actually two systems in one. They are identified as System A and System B. Under normal operation, the A System is used to operate the display matrix. The A System is often referred to as the NORMAL or PROGRAM system. The B System is exactly like the A System, but is intended for off-line production or preparation work. The B System is often referred to as the BACK-UP or PRODUCTION system. In the event of a malfunction in the A System, the operator need only move the COMPUTER MODE Selector Switch from A to B to re-establish control over the Matrix Display. Since the A and B Computer Control Systems are for all practical purposes identical, only one will be described.

Figure 1:
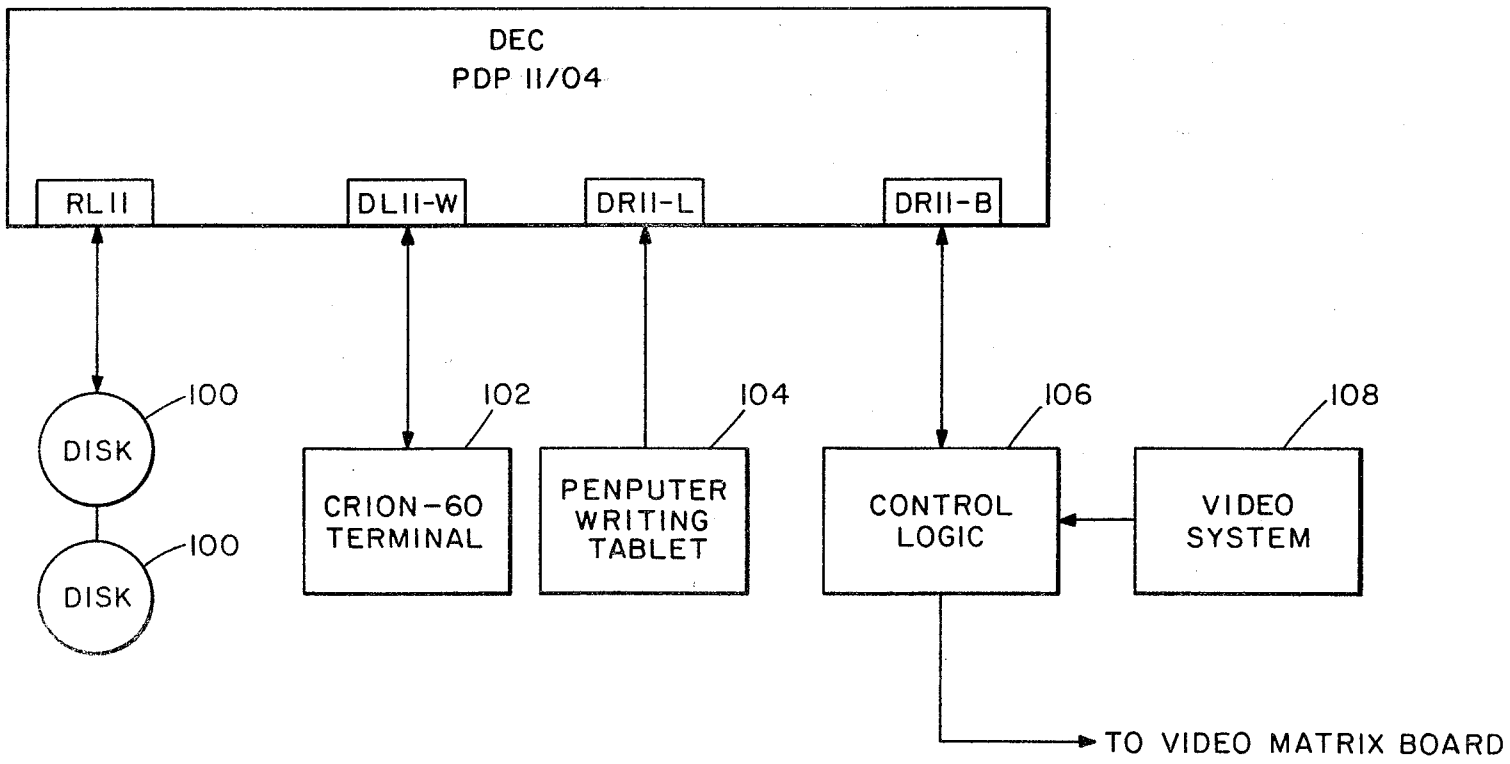
FIG. 1 is a block diagram of the computer system according to the invention.

The heart of the computer control system is a DIGITAL EQUIPMENT CORP. PDP 11/04 mini-computer with 28k words of memory (see FIG. 1). For its mass memory storage medium there are two disk drives, 100 each with a capacity of 5.2 million bytes. These drives use a removable disk pack for easy loading and program expansion.

The operator interfaces with the computer through a MAGNAVOX ORION-60 Plasma Display Terminal 102. Using the keyboard and touch panel of the ORION, the operator controls the flow of data. Prerecorded symbols can be quickly selected on the "PEN- TEL PENPUTER" 104 located next to the ORION terminal. These two devices interface directly with the PDP 11/04 computer via commercially available DEC DL11-W and DR11-L interfaces, respectively.

The video equipment comprises a system 108 that contains common and dedicated elements for both the A and B Computer Systems. The video source equipment includes video records, and cameras switch selectable at the discretion of the system operator.

The video system does not interfere directly with the computers. It interfaces with a VIDEO CONVERTER 110 (FIG. 2) which, in turn, interfaces with the computer. The video system is essentialy a video input selector and signal conditioner. It provides the source video that may be displayed on the matrix display board.

C. CONTROL LOGIC

The Control Logic 106 (FIG. 2) provides the interfacing hardware necessary to allow the elements of the computer control system to generate displays on the video matrix board. In a simplified form it operates as follows:

In response to an operator's request, the computer commands the logic to perform an operation. There are three basic types of operations:

1. Display a video image directly on the matrix board.
2. Store a video image in disk memory.
3. Display a stored disk image on the matrix board.

The Control Logic decodes the command and, if possible, executes it. After execution, the Logic informs the control system that is done.

The Control Logic communicates with the computer via a DEC DR11-B interface module 112 contained within the computer chassis.

D. COMPUTER INTERFACE

The COMPUTER INTERFACE 114 (FIG. 2) is primarily used to transfer blocks of data between the computer memory and a full frame DISPLAY BUFFER 116. These blocks of data move in either direction at approximately 1.2 usec per 16 bit word. Data coming from the computer is sent on the DR11-B's output bus (OB). Data going to the computer is sent on the input bus (IB). The OB and IB are also used to send command and status information between the computer and other devices making up the Control Logic System 106. It transmits other signals as well, in particular, the Function (FNCT) Signals, which are used to determine which device connected to the bus is to be selected. FIG. 3 is a table of functions and commands recognized by the Control Logic. For convenience, all of the signals between the DR11-B and the Control Logic are referred to as CONTROL BUS Signals.

E. DISPLAY BUFFER

The DISPLAY BUFFER 116 is essentialy a random access memory (RAM). Its organization is 64×4096; however, it constructable in 1K increments. The DISPLAY BUFFER is a memory that may hold an image which can be displyed on the matrix board. It may also hold an image which can be transferred to the computer memory. In operation, the DISPLAY BUFFER may be written to, or read from, by either the COMPUTER INTERFACE 114 or the V/D INTERFACE 118.

F. MESSAGE ROTATOR

The MESSAGE ROTATOR 120 allows a message to travel from right to left across the matrix board. It does this without requiring the computer to read, shift, and write the entire frame, an operation which takes a great deal of computer time and yields rather slow travel rates.

G. V/D INTERFACE

The V/D (video/display) INTERFACE 118 is used to transfer display data between the VIDEO CONVERTER 110, DISPLAY BUFFER 116, and the VIDEO TRANSMITTER 122. It is the primary display control device and data router. In addition, it controls a PREVIEW/DISPLAY MONITOR 124 which allows an operator to preview material prior to displaying it on the matrix display board.

H. VIDEO CONVERTER

The VIDEO CONVERTER 110 is made up of three basic units: the QUANTIZER 126, the VIDEO CONTROLLER 128, the VIDEO CONTROL PANEL 130. The VIDEO CONVERTER transfers digitized video images to the V/D INTERFACE 118.

The VIDEO QUANTIZER 126 board performs the following functions:

1. Receives the video source signal.
2. Strips and regenerates sync signals from the video source signal.
3. Divides a video line into a series of sampling points.
4. Converts (quantizes) the analog video into a 4 bit digital value representative of one of 16 possible intensity levels for a variable intensity display device such as an incandescent light bulb.

The VIDEO CONTROLLER 128 selects the parameters for operation of the QUANTIZER. The VIDEO CONTROLLER contains an Intel 8085 microprocessor ($\tau$P). It monitors the video operator inputs, which include:

1. JOYSTICK position control for selecting desired portions of the video picture to be displayed.
2. Image size selection controls.
3. RUN/STOP controls.

In addition, it receives commands from the computer via the CONTROL BUS and V/D INTERFACE.

The VIDEO CONTROL PANEL 130 is mounted in the operator's console. It allows the video operator to select various display options which include: image size, image position, automatic gain, and automatic set-up (AGC and ASU).

I. TRANSMITTER 122

The TRANSMITTER receives data from the V/D INTERFACE 118, formats it and inserts the necessary addresses, then transmits the image to the video matrix board 132. The formating involves dividing each line of data into a LEFT and RIGHT half, thereby reducing the data rate by half. An address header must be placed at the beginning of each line of data so that the Matrix Display Logic at the board will know where to place each line it receives. The TRANSMITTER must also mantain a steady stream of lamp brightness data. The lamp brightness information, called $\phi$ pulses, is generated by the $\phi$ GENERATOR 134 as determined by the four bit word from the QUANTIZER 126. The $\phi$ PULSES are multiplexed by the transmitter and continuously transmitted to both the LEFT and RIGHT halves of the matrix board 132.

J. $\phi$ GENERATOR

The $\phi$ GENERATOR is used to generate three bursts of 15 pulses. Each burst is locked to one of the three power line phases: A, B, or C. Each pulse within a burst defines one of 15 lamp brightness intensity levels (the 16th level being the off condition). Adjustments on the $\phi$ GEN allow it to be set-up to render the desired lamp brightness and contrast steps between the 16 brightness levels.

K. MATRIX DISPLAY BOARD 132

The MATRIX display is preferably made up of 40-watt incandescent lamps, arranged in a matrix M lamps high by N lamps wide. The face of the display is formed by stacking modules of lamps, each module containing a quantity of lamp trays. To the electronics involved in controlling the lamps, the precise number, placement, or size of the modules is unimportant. The electronics sees only an arrangement of lamp trays forming an electrical matrix of a predetermined size. ($M \times N$)

Each lamp tray contains 24 lamps and is controlled by one TRIAC CONTROL BOARD CARD. Thirty TRIAC CARDS are driven by one DRIVER BOARD. Two DRIVER BOARDS can be controlled by one CONTROLLER BOARD. The DRIVER and CONTROLLER BOARD are connected to the HIGH SPEED CONTROL CABLES via one I/O BOARD. All of the above (except the lamp tray) is contained within a CONTROL CABINET located at the BOARD.

Each CONTROL CABINET has the capacity to drive 1,440 lamps. For reasons of packaging expedience, each cabinet can drive these lamps arranged only in an area 24 lamps wide by 60 lamps high.

Each CONTROL CABINET is fed 3-phase power from a power distribution cabinet. The power feed is connected to a load center mounted on the side of each CONTROL CABINET. Within each load center is a quantity of 20-amp circuit breakers, which provide power to the enitre cabinet.

L. CONTROL CABINET LOGIC

As already mentioned, the CONTROL CABINET houses four types of logic control boards. A brief description of their operation will be given here.

The data transmitted from the transmitter is received at the control cabinets via a set of HIGH-SPEED CABLES. The transmission is made up of two independent data paths, one for the LEFT side of the matrix board and one for the RIGHT side. Each set of high-speed signals is received inside the cabinet by the I/O BOARD. The I/O BOARD re-transmits this data via a second set of HIGH-SPEED CABLES to the next cabinet in line. The I/O BOARD also passes this data on to the CONTROLLER and DRIVER BOARDS. In addition, the I/O BOARD contains the circuits necessary to demultiplex the $\phi$ PULSES and provide them to the CONTROLLER BOARD.

The CONTROLLER BOARD generates the signals necessary to control the loading and outputting of data at one or two DRIVER BOARDS. Each CONTROL CABINET is actually two cabinets in one, or at least two halves of a cabinet. The Controlling Logic indicates the division using the letters "a" and "b". Thus, the CONTROLLER BOARD has two identical sets of input and output logic, one for the "a" side and one for the "b". Physically, this division splits the cabinet into two vertical groupings of lamps, each 12 wide by 60 high. This $12 \times 60$ grouping defines a new type of column which is valuable in addressing the CONTROL CABINETS and in getting the data poked into the right places. To avoid confusion when discussing these different types of columns, the notation "COL" will be used to designate this new 12-lamp wide grouping. In all cases, the a-COL designates the left side of a control cabinet, the b-COL designates the right side of a control cabinet. In a similar way, the a-DRIVER and b-DRIVER BOARDS control their respective COL's.

The CONTROLLER BOARD decodes the transmitted address, picks the appropriate COL out of a line of transmission, and loads the data into the DRIVER BOARD. In addition, it remultiplexes the $\phi$ PULSES into the format necessary to output data from the DRIVER BOARD. It also contains a clock generator that produces the control signals which move the data from the DRIVER to the TRIAC BOARDS. This clock system works totally independent of the signals received from the TRANSMITTER, and its output is common to both the "a" and "b" DRIVER BOARDS.

The DRIVER BOARD stores the display data needed to drive a COL of lamps, and then outputs the decoded data to the appropriate lamp triac control circuit when needed to light a lamp at a specified brightness.

This brings us to the TRIAC BOARD. The TRIAC BOARD contains 24-lamp triac control circuits arranged into two rows of twelve each. It controls 24 lamps arranged in the same way. Thus, 30 TRIAC BOARDS control a COL. The data from a DRIVER BOARD is multiplexed onto six ribbon cables, each of which may drive the input circuits of up to five TRIAC BOARDS.

M. SUMMARY

In reading the following detailed description, it is important to remember:

All images displayed on the matrix board come either from the VIDEO CONVERTER or the DISPLAY BUFFER, or both in combination. There is no direct path from the computer system to the TRANSMITTER, The VIDEL CONVERTER generates images in a line-at-a-time process, scanning from top to bottom, left to right. This serial image construction will be called a "video format." The timing and number of signals needed to control the image may change but this basic line-at-a-time, frame-by-frame process will always be the same.

The V/D INTERFACE under computer command routes the images.

The TRANSMITTER receives and sends the matrix images in a video format style. Except for minor buffer delays, the TRANSMITTER transmits to the video matrix display board in real time. Thus, one line received equals one line transmitted.

The matrix display board is divided into a LEFT and RIGHT half. The display board CONTROL CABINETS on the LEFT side are daisy-chained to the LEFT set of HIGH-SPEED CABLES; similarly, the RIGHT CONTROL CABINETS are connected to the RIGHT set of HIGH-SPEED CABLES.

The brightness of each lamp within the matrix is defined by a four bit word. Video formatted data always moves this word in serial transmissions of four bit parallel words. When the computer handles this data, it assembles sixteen of these four bit words into four sixteen bit words.

Between the computer and COMPUTER INTERFACE data transfers are arranged as sixteen bit words. The Display Buffer sees data as 64 bit words (or four, sixteen bit bytes). The CONTROL CABINETS see words as twelve bits. This may at first seem confusing, but remember the video formats are serial by four bits. Thus, it is very easy to cut up or assemble this video format into words of almost any size. Thus, the four, twelve, sixteen, and 64 bit divisions work our rather conveniently.

DETAILED DESCRIPTION

II. THE COMPUTER INTERFACE 114

A. Introduction

Figure 2:
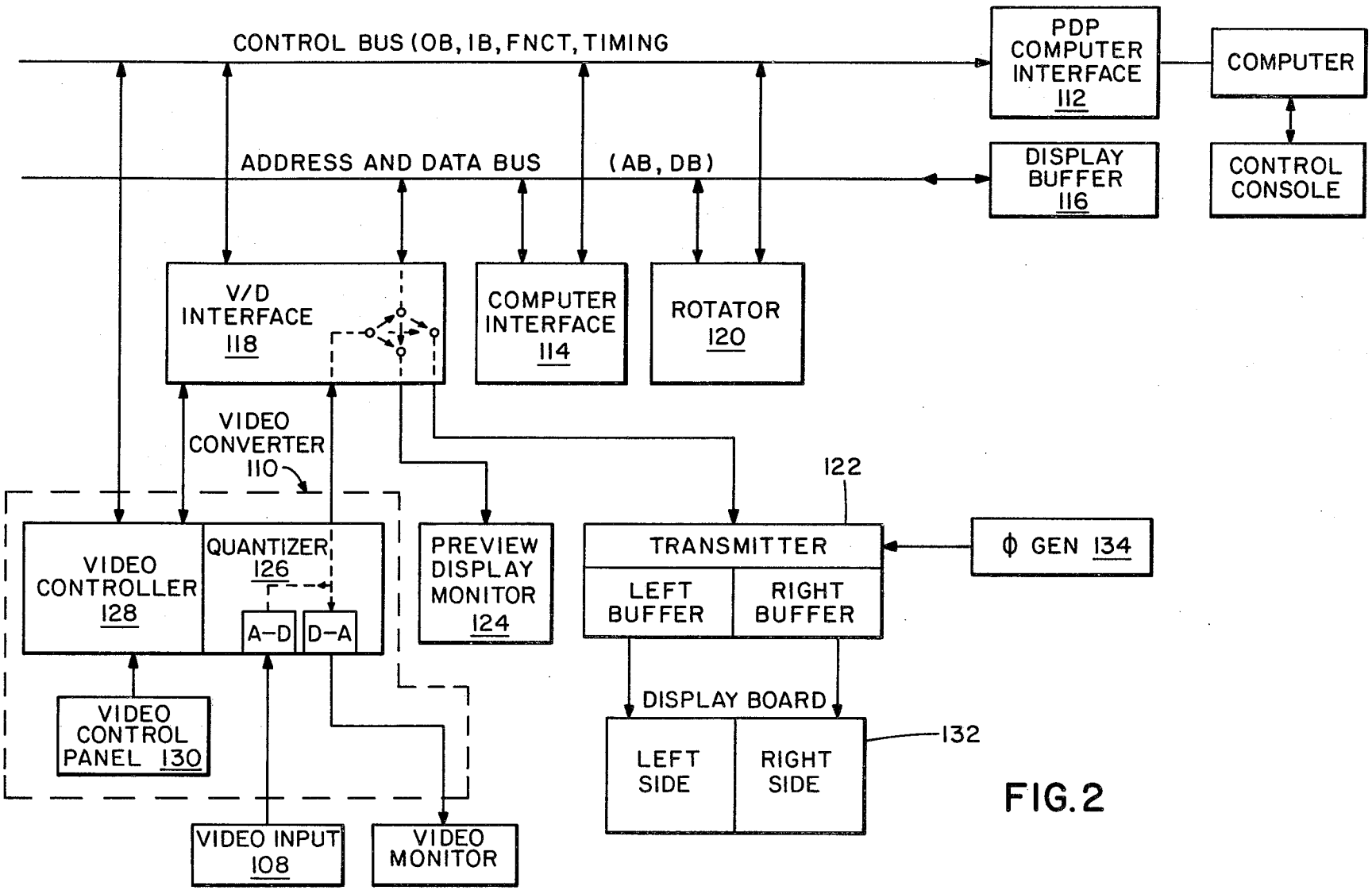
FIG. 2 is a block diagram of the control logic, its relationship to the computer and display board logic according to the invention.
Figure 3:
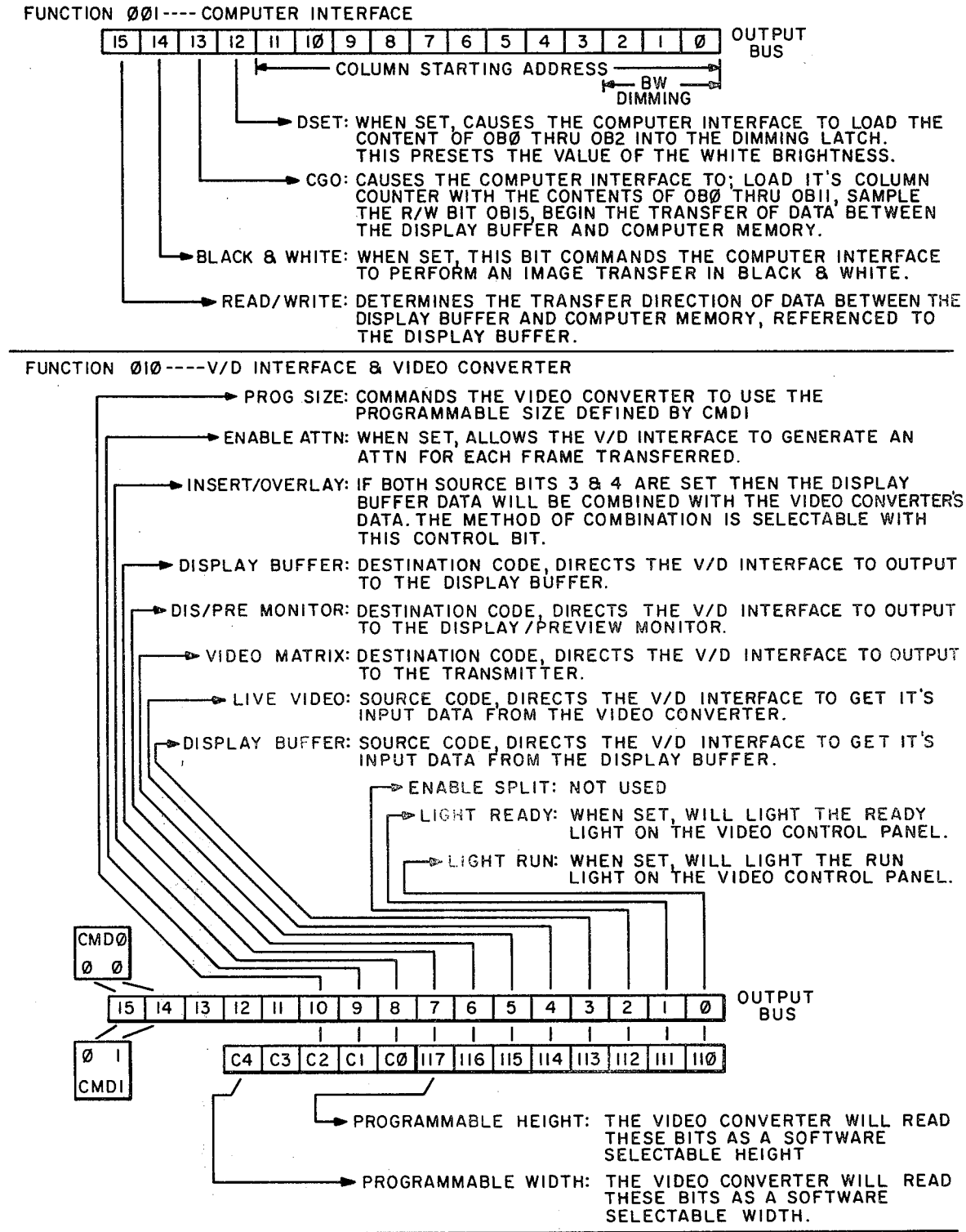
FIG. 3 is a diagram of the output bus command decoding.

The circuits of the COMPUTER INTERFACE interface the DEC PDP 11/04 computer to the rest of the control logic shown in FIG. 2. The PDP 11/04 includes a device called the DR11-B. The Dr11-B is a general purpose direct memory access (DMA) interface to the DEC UNIBUS. With this device, block data transfers may be made directly to or from memory at very high speeds, or one word at a time using program-controlled I/O instructions. Reference is made to the DR11-B User Manual for a detailed explanation of its operation.

The DR11-B interface consists of four registers: command and status (DRST), word count (DRWC), bus address (DRBA), and data (DRBD). DMA operation is initialized under program control by loading word count with the two complement of the number of transfers, specifying the initial bus address where the block transfer is to begin, and by loading the command status register with the correct function bits. The COMPUTER INTERFACE 114 recognizes the function bits and responds by setting up the control inputs. A transfer will then begin and continue until a word count overflow (WCO) is detected by the word count register. When DRWC overflows, the READY bit of the DRST is set terminating the transfer. The DMA mode is used by the control logic to transfer blocks of data between the PDP 11/04 core memory and the DISPLAY BUFFER 116.

Program-controlled data transfers can be made using just the DRST and DRDB registers. This operation is initialized by writing or reading the data from the DRDB in conjunction with a selected function set into the DRST. This mode is used to send command information between the PDP 11/04 and the various devices (functions) that make up the S-W control system. A table of functions and commands can be found in FIG. 3.

FIG. 2 indicates how the control logic is attached to the CONTROL BUS. The CONTROL BUS is merely an extension of the bus emanating from the DR11-B.

B. Interface Operation

The COMPUTER INTERFACE 114 is designed to work in conjunction with the DR11-B and the DISPLAY BUFFER 116. It directs the movement of data between these two devices at DMA rates synchronized to the computer memory cycles.

Before going into the circuits of the COMPUTER INTERFACE, a brief discussion of the DISPLAY BUFFER will prove useful. The DISPLAY BUFFER is a RAM memory organized 64×2048. It has a 12 bit address bus (BAϕ-BA11), a 64 bit data bus (ADBϕ-ADB15, BDBϕ-BDB15, CDBϕ-CDB15, and DDBϕ-DDB15), a read-write control line (R/W), and a write strobe line ($\overline{\text{WSTBE}}$). Very simply, any of its 2048 words may be read from or written to by asserting an address, an R/W control, and, if writing, a $\overline{\text{WSTBE}}$.

Figure 4:
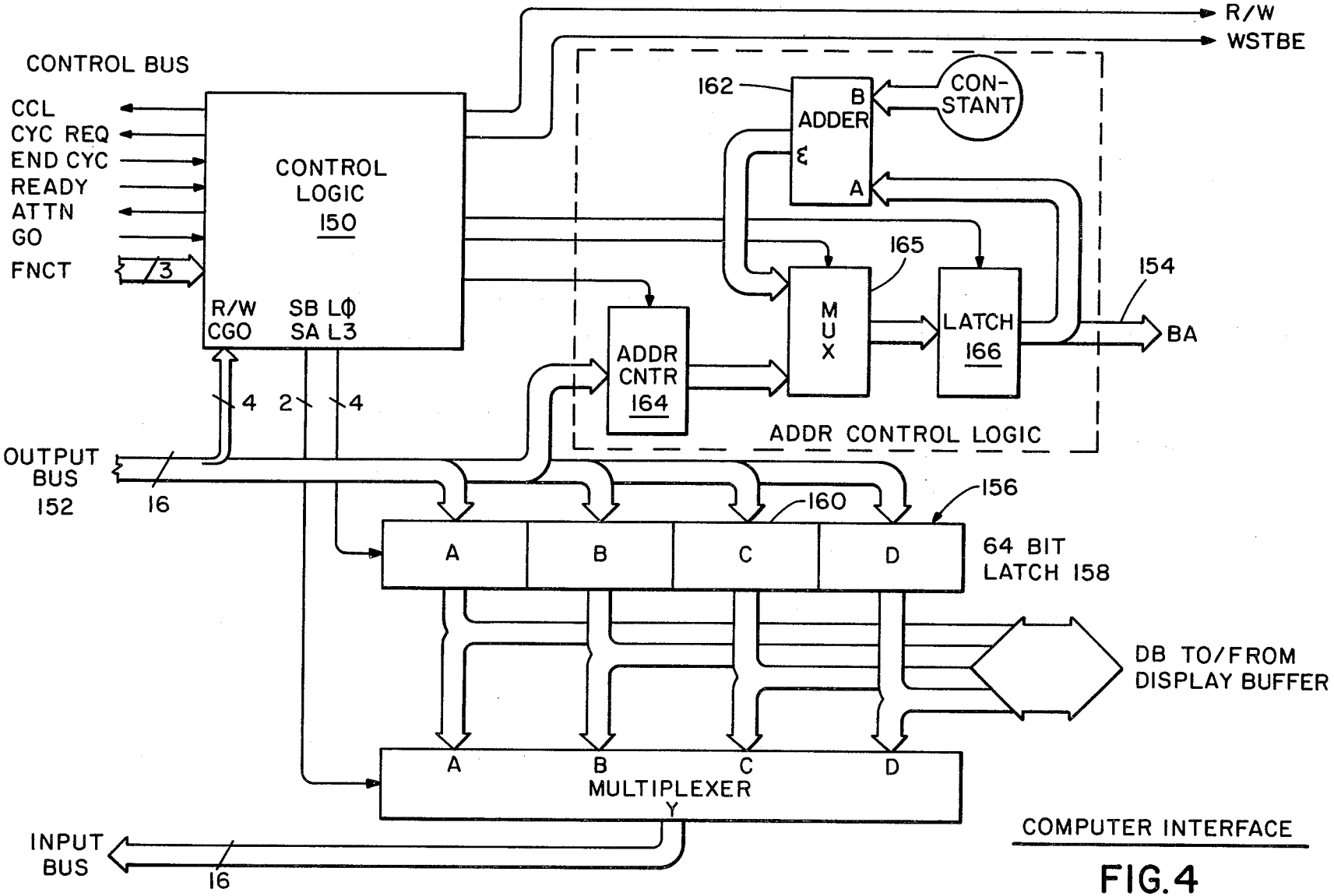
FIG. 4 is a block diagram of the computer interface according to the invention.

FIG. 4 is a block diagram of the COMPUTER INTERFACE 114. The transfer of data from the PDP 11/04 to the DISPLAY BUFFER can be seen. Under program control, the DR11-B will be loaded with the starting address of the DISPLAY BUFFER in bits ϕ-11. Bit 15 (R/W) will be zero, indicating a transfer direction writing into the DISPLAY BUFFER. A one would indicate the reverse transfer direction. Bit 13 will be set to initiate the transfer with a CGO start command. The contents of the DR-11B will appear on the output bus OB. Next, the computer will provide the DRST register with the FNCT signal 001 to select the COMPUTER INTERFACE and the GO bit set to start the transfer. The Control Logic 150 will decode the FNCT, and, upon receipt of the GO pulse, sample the command previously loaded on the OB 152.

The Control Logic will respond to the command by setting the CCl control line to read data from the DR11-B. The Address Control Circuits will place the first DISPLAY BUFFER address onto the BA bus 154. A CYC REQ pulse will be issued to the DR11-B requesting the transfer of a 16 bit word.

When the DR11-B has fetched its first word from core, it will supply it to the 16 bit OB and issue an END CYCLE pulse back to the Control Logic. The Control Logic will issue an Lϕ pulse which will cause the "D" portion 156 of the 64 bit latch 158 to be loaded from the OB. The Lϕ pulse will also cause another CYC REQ. Again the DR11-B will respond with 16 bits of data and the second END CYCLE. The L1 pulse will be generated in response and load the "C" portion 160 of the 64 bit latch. This process will continue until all four sections of the 64 bit latch have been loaded.

On the fourth END CYCLE a $\overline{\text{WSTBE}}$ signal to the DISPLAY BUFFER will cause the four transferred words in the latch to be written into memory. The next CYC REQ will be generated at the same time, beginning the transfer of the next four computer words. When the $\overline{\text{WSTBE}}$ cycle is completed, the address latch will be loaded with the contents of the next DISPLAY BUFFER address. This process of cycling four computer words into one DISPLAY BUFFER word will continue until DR11-B DRWC register overflows and causes a READY signal. The READY inhibits the Control Logic from issuing any more CYC REQ's, but causes the logic to issue an ATTN signal indicating acknowledgement of the completion of the transfer operation.

Figure 5:
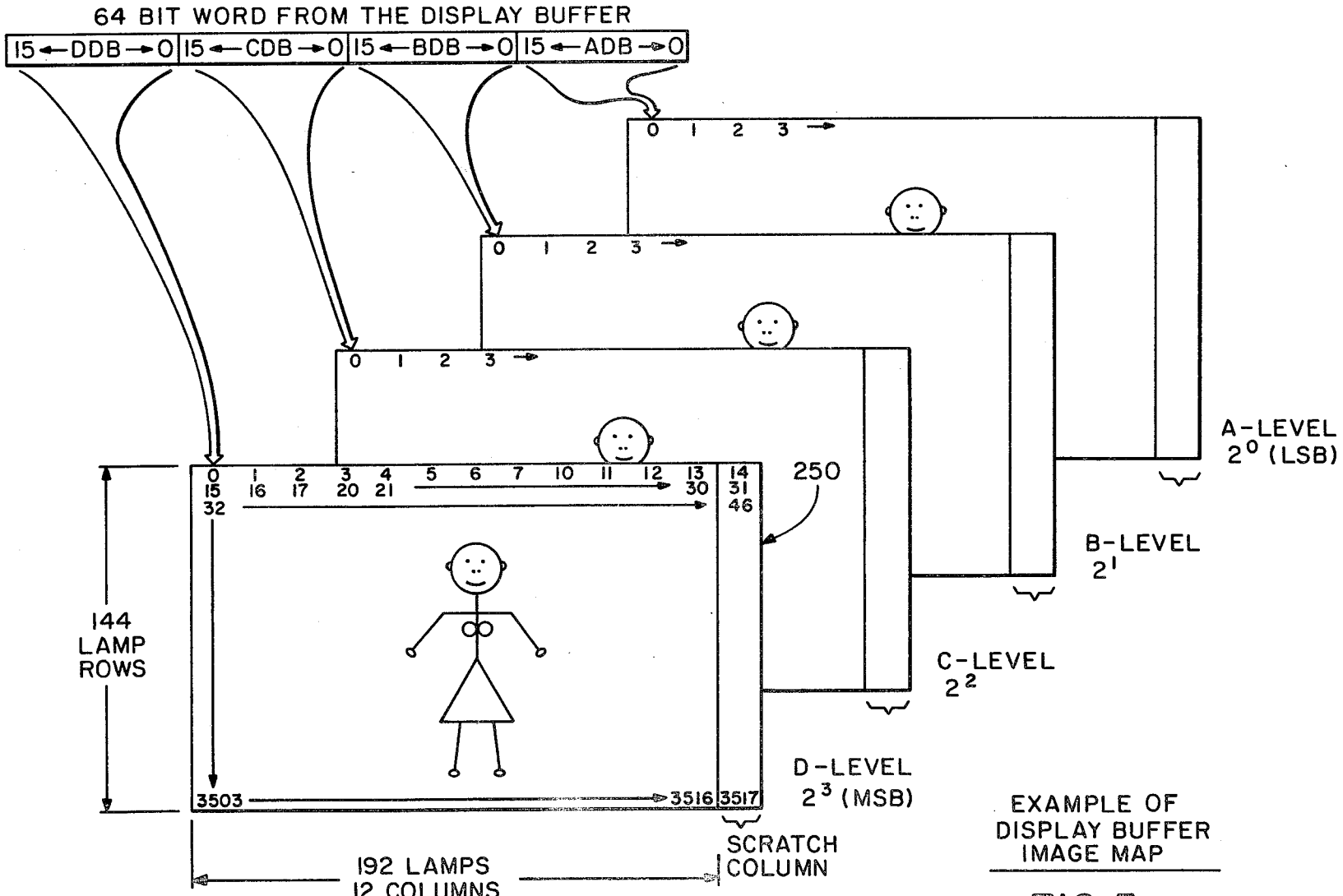
FIG. 5 is a diagram of the display buffer image mat.

The method for addressing the DISPLAY BUFFER is something other than straightforward. This is because the DISPLAY BUFFER image addressing is organized in rows, this being most compatible with video image, line at a time, processing. The computer core image, however, is organized in COLUMNS. Thus, the DR11-B must process data in COLUMNS rather than rows. The COLUMN is a grouping used to describe 16 bit words organized in columns which define the display image on the matrix. This grouping has four levels of depth, A, B, C, & D; with the D level containing only Most Significant Bit (MSB) information, and the A, the LSB information. See FIG. 5 for the organization of COLUMNS in the DISPLAY BUFFER.

Because of these COLUMN-organized transfers, the addressing circuits must increment the addresses by adding a constant to the starting address and each successive address. Thus, the ADDER 162 takes the current BA and adds to it a COLUMN constant to yield the next BA. After the transfer of 144 rows has been completed, the BA needs to return to the address at the top of the next COLUMN. The Control Logic will have incremented the 12 bit COLUMN counter 164 by one and have presented its output to the address latch 166.

The transferring of data from the DISPLAY BUFFER to the DR11-B is very similar to that just described for the reverse operation. The command and function is issued in the same way, this time with the R/W bit set to a one. The Control Logic will condition the CC1 signal to tell the DR11-B to receive data. This time 64 bits of data will come from the DISPLAY BUFFER's DB and be multiplexed onto the DR11-B's input bus (IB) 168. The SA, SB signals control which portion of the DB is presented to the IB during each L$\phi$-L3 cycle. The addressing process continues as before, until the READY is received from the DR11-B.

It will be recalled that the output registers of the COMPUTER INTERFACE consist of four 16-bit data latches 158, and the 12-bit address latch 166. The data latches are loaded directly from the OB during the DMA cycles. The L$\phi$, L1, L2, & L3 signals will load them during Write operations. The address latch is loaded from the COLUMN counter 164, which was previously loaded from the OB, when the START pulse was generated.

The output of the address latch 166 goes to both the DISPLAY BUFFER via the BA and to the "A" input of an adder circuit 162. The "B" input of the adder is loaded with a binary constant. This constant is the number of COLUMNS that make up the display matrix width plus one. The output of the adder circuit will present to the "B" input of the multiplexer 165 the current address plus the constant. This is the next address needed to advance through a COLUMN of transfers in the DISPLAY BUFFER. L$\phi$ causes the multiplexer to select its "B" input. The next address is loaded, and so on until the counter produces a CARRY. At that time, the COLUMN counter is incremented, and its contents loaded into the address latch.

III. DISPLAY BUFFER

The DISPLAY BUFFER 116 is a RAM memory configured 64×2048. The DISPLAY BUFFER includes the ROTATOR circuits. The ROTATOR is used to move messages across the video matrix board.

It will be recalled that the DISPLAY BUFFER is used as a temporary place to store an image. The manner in which the COMPUTER INTERFACE can load or retrieve images from the DISPLAY BUFFER has been previously described. It is important to understand how the board image is mapped into the DISPLAY BUFFER memory to perceive the operation of the ROTATOR circuits.

The DISPLAY BUFFER is used to contain pictoral images in a digital form. The organization of the image is arranged in such a way as to allow efficient design of the addressing circuits which must interface with it. Since video data is received at high speeds, the most efficient interface techniques would favor an addressing scheme organized around data in a video format. This yields the arrangement shown in FIG. 5.

The image is arranged in horizontal rows of addresses, with address $\phi$ in the upper lefthand corner and the last address (in this case 3517 octal) in the lower righthand corner. The actual area of the image which appears on the display matrix is bounded by the corners defined in the drawing as addresses $\phi$, 13, 35$\phi$3 and 3516. The COLUMN 250 formed by addresses 14 to 3517 is called the "scratch" COLUMN, and is needed in the application of the ROTATOR circuits.

The image is formed by COLUMN's and rows of 16-bit words. Since we are defining an image in sixteen shades of brightness and four bits are needed to define sixteen shades, we will need four levels of depth for every 16-bit word. In other words, four 16-bit words can define the brightness of sixteen lamps: or, one 64-bit word consisting of four parts; A, B, C & D, will do the same job. The sixteen bits of the A level of address $\phi$ will define the $2^0$ or (LSB) for the first sixteen lamps starting in the upper righthand corner. The B level will define the $2^1$ bits of the first sixteen lamps. The C level will define the $2^2$ bits. The D level will define the $2^3$ (MSB) data. If we remove the fifteenth bit from the A, B, C & D levels and reassemble them into a 4-bit word, we would have a new word which would define (in binary) the brightness of the lamp in the upper lefthand corner. The sixteen possible brightness values in descending order of magnitude are as follows:

| DECIMAL VALUE | D $2^3$ | C $2^2$ | B $2^1$ | A $2^0$ | |
|---|---|---|---|---|---|
| 15 | 1 | 1 | 1 | 1 | LIGHTEST |
| 14 | 1 | 1 | 1 | 0 | |
| 13 | 1 | 1 | 0 | 1 | |
| 12 | 1 | 1 | 0 | 0 | |
| 11 | 1 | 0 | 1 | 1 | |
| 10 | 1 | 0 | 1 | 0 | |
| 9 | 1 | 0 | 0 | 1 | |
| 8 | 1 | 0 | 0 | 0 | |
| 7 | 0 | 1 | 1 | 1 | |
| 6 | 0 | 1 | 1 | 0 | |
| 5 | 0 | 1 | 0 | 1 | |
| 4 | 0 | 1 | 0 | 0 | |
| 3 | 0 | 0 | 1 | 1 | |
| 2 | 0 | 0 | 1 | 0 | |
| 1 | 0 | 0 | 0 | 1 | |
| 0 | 0 | 0 | 0 | 0 | DARKEST |

These 4-bit words are handy ways of ordering the brightness data. This 4-bit word we will call a "pixel," as it completely defines the brightness of one picture element.

IV. ROTATOR

The purpose of the ROTATOR is to cause lines of text to move across the DISPLAY BUFFER from right to left. The hardware allows the height and location of the line to be defined by the software. In addition, the software controls the speed of travel and composition of the text. The hardware will, in response to a command, perform a single column left shift of all the data contained within a defined area of the buffer.

Figure 6:
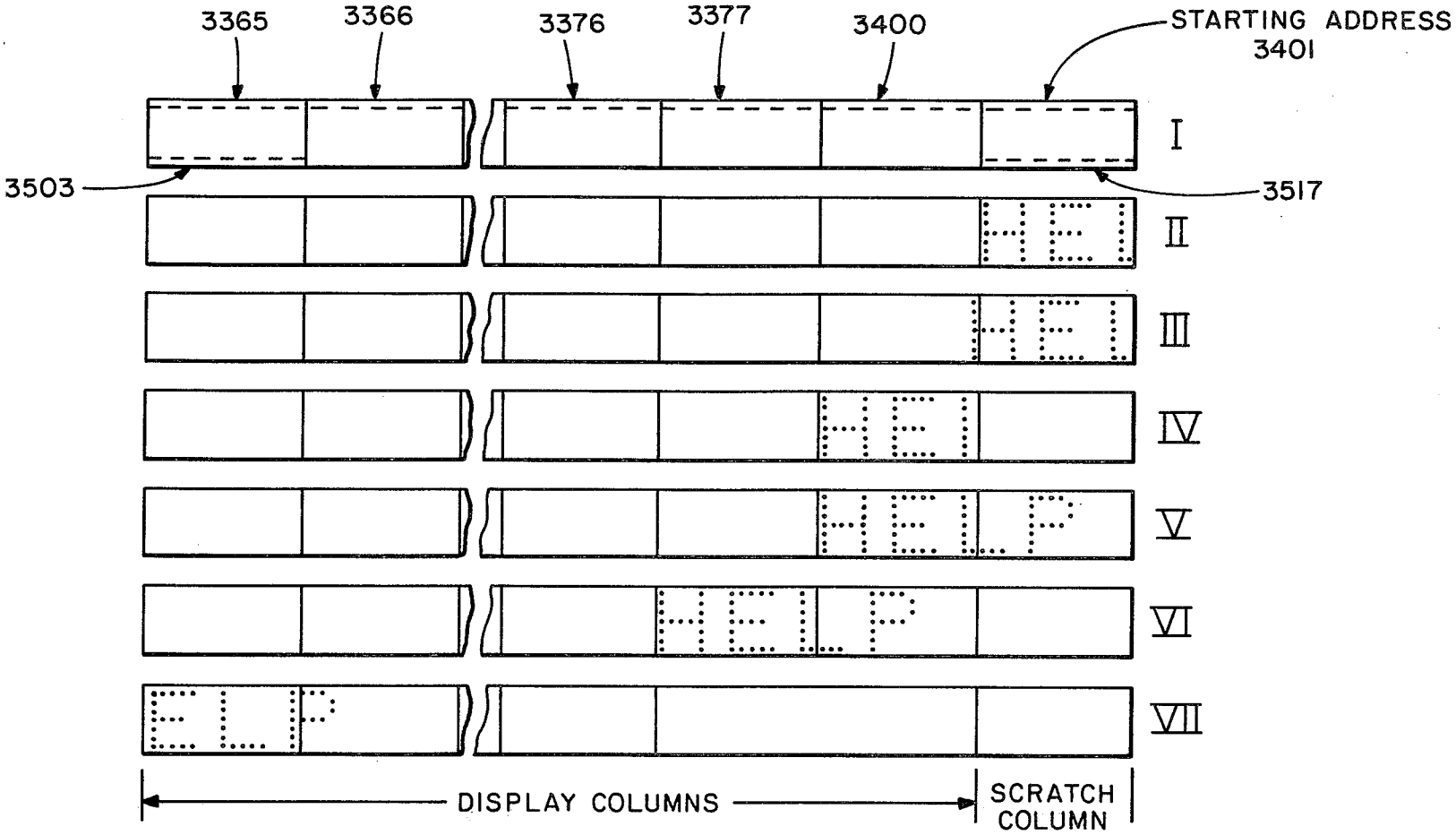
FIG. 6 is a diagram useful in explaining operation of the rotator circuit.

FIG. 6 shows an area of the DISPLAY BUFFER as it might be defined for rotation. (FIG. 6 will detail only the D-level but it should be understood that the action of rotation affects all levels of the DISPLAY BUFFER simultaneously.) In "I" the buffer and text area is empty. In II the COMPUTER INTERFACE has loaded the scratch area with data that begins the text of a message.

III shows the message after a rotation command has been issued. IV shows it after the sixteenth rotation command. The scratch area is now empty and the next part of the message text must be loaded into it as shown in V. Another sixteen rotations and again the scratch COLUMN is empty. This process continues under software control until an entire message has travelled across the DISPLAY BUFFER. Of course, after each rotation the resulting image would be transmitted to the matrix display board.

The image shifts in from the scratch COLUMN on the right. The data in the far left column shifts out the left side and is lost. Notice also that if something was left in the text area prior to starting the travelling message, it will shift out with the incoming data.

Figure 7A:
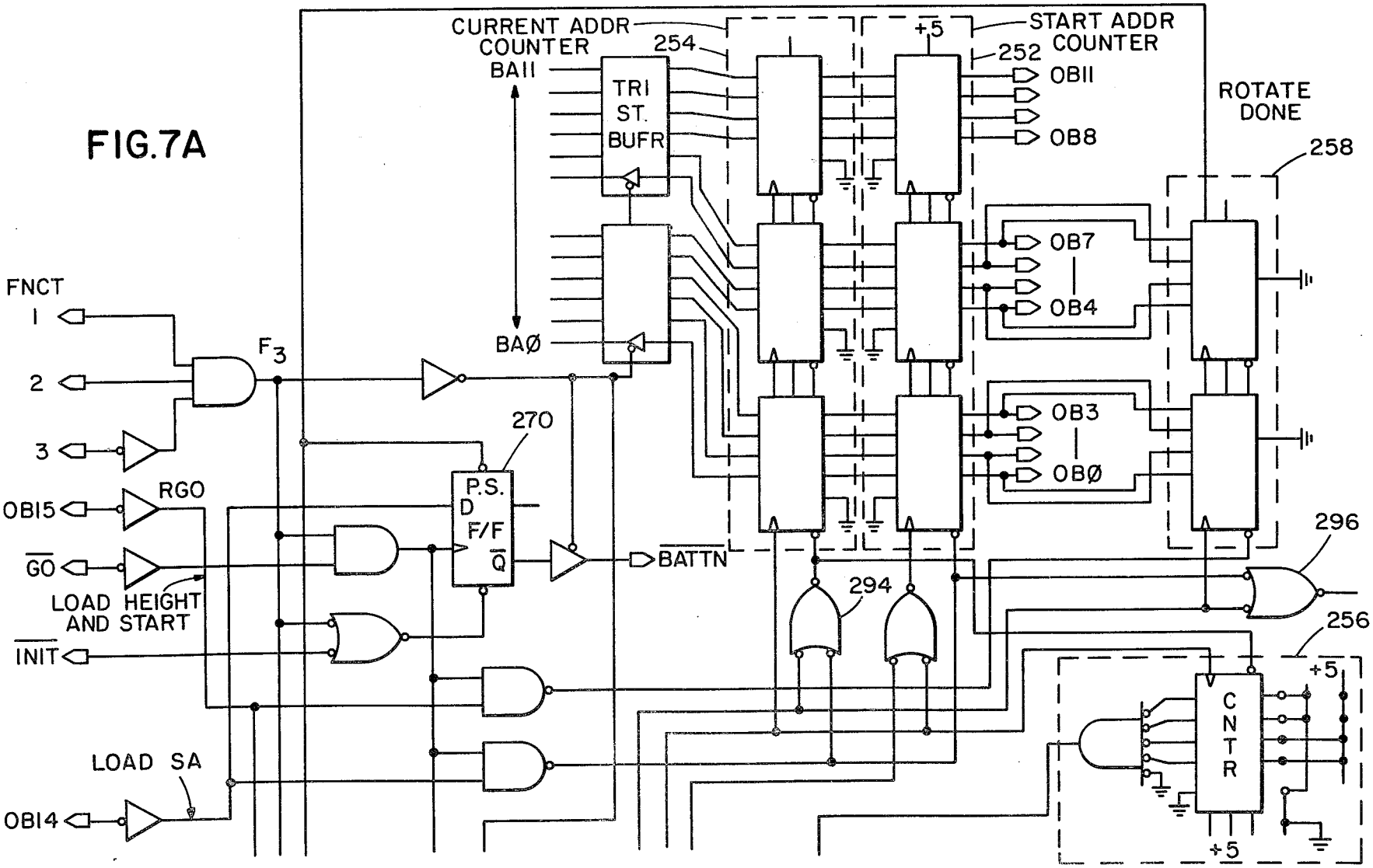
FIGS. 7A–7C are schematic diagrams of the rotator circuit according to the invention.
Figure 7B:
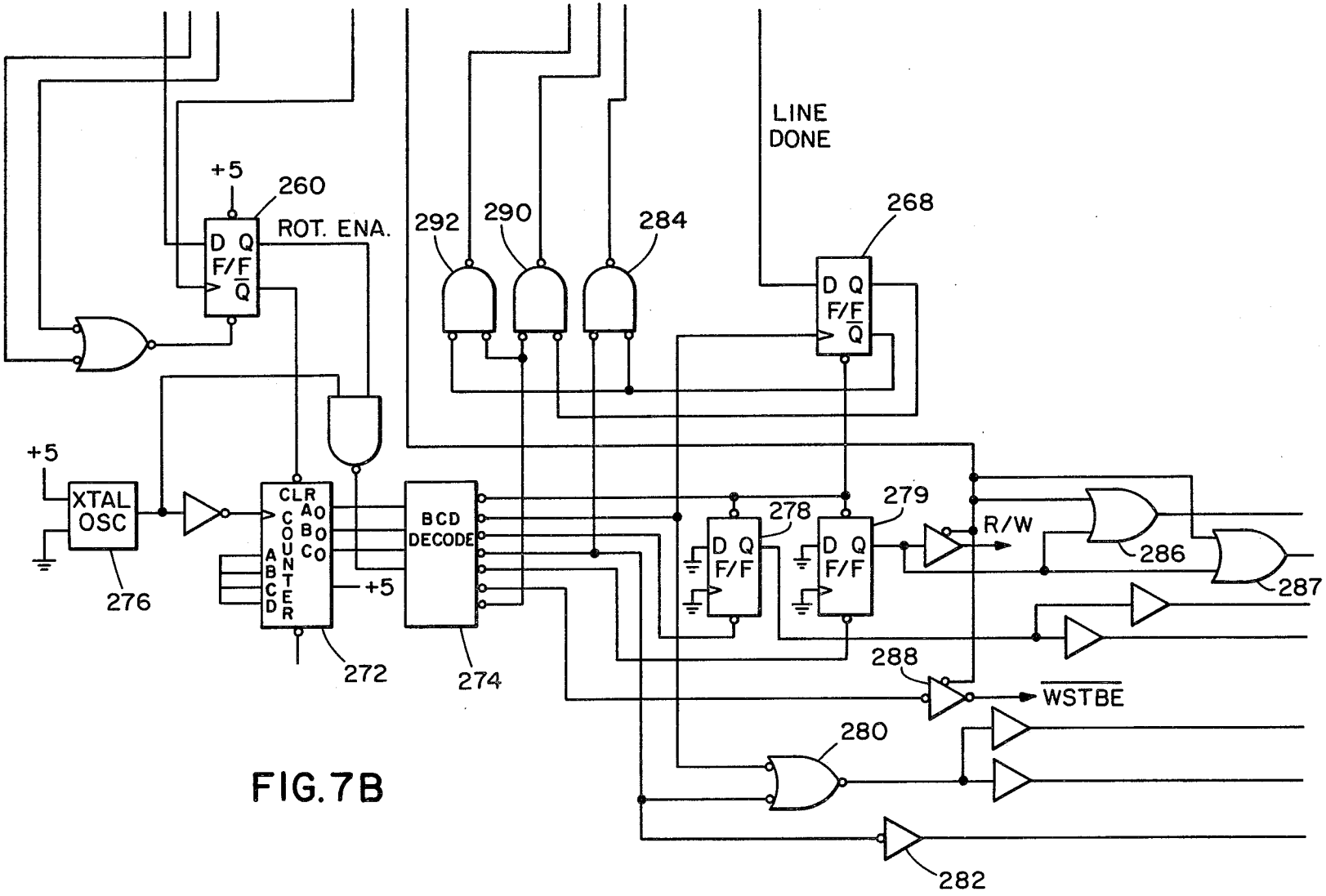
Figure 7C:
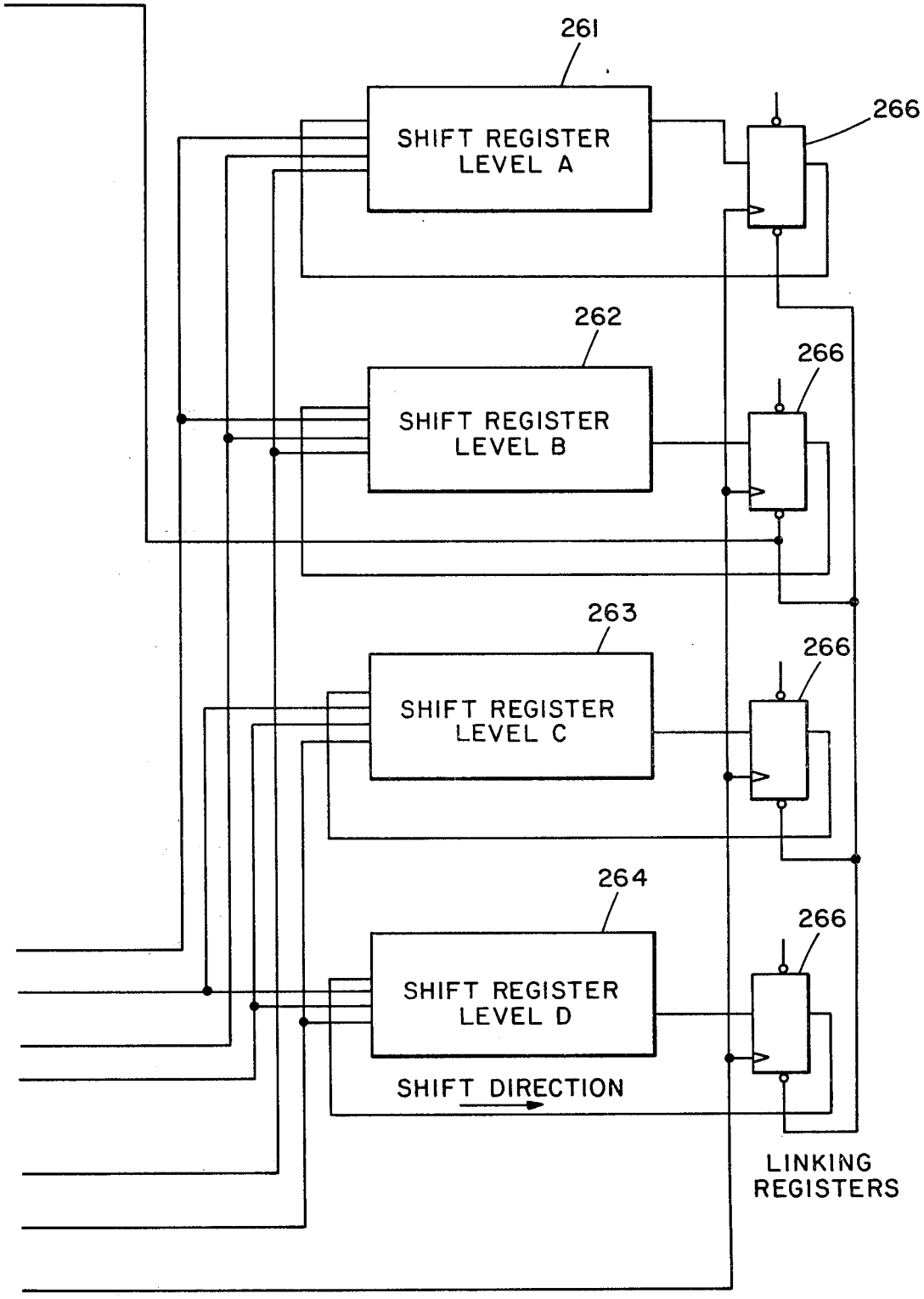

Referring to FIG. 7 the operation of the ROTATOR will be described. A command is issued by the computer (function 3) which loads the starting address (upper righthand corner) of the area to be rotated. This is always the top address in the scratch COLUMN. This address is loaded into the SA (starting address) counter 252. At the same time the SA counter is loaded, its outputs provide the inputs to the CA (current address) counter 254 and it, too, is loaded. The Width Counter 256 is preset at this time. It loads the width of the display in COLUMNS.

A second command is issued which loads the Height Counter 258 with the binary value of the number of rows comprising the Rotation Area minus 1. At the same time the Height is loaded, the rotate enable F/F 260 is set, beginning the rotation process.

The rotation process begins in the upper righthand corner. The contents of the DISPLAY BUFFER are read into a set of four shift registers, 261-264; one each for the four levels A, B. C & D of the DISPLAY BUFFER. We will confine our discussion to just the D level, register 264. After the data is loaded, the control logic will cause it to shift one bit to the left. (Note that "left" is actually "right" on the schematic. The left/-right references used here pertain to what will be seen on the matrix display). The leftmost bit is provided to a Linking Register formed by the F/F 266. This will save it to be used as the right side input when we shift the next word. After shifting, the contents of the SR will be written back into the DISPLAY BUFFER.

Next the CA Counter 254 will be decremented, moving to the adjacent address on the left. The SA Counter 252 will be incremented. The Width Counter will be decremented 256. Again, the contents of the DISPLAY BUFFER will be read into the SR, another shift cycle occurs, and then the data is written back into the DISPLAY BUFFER. Notice the contents of the Linking Register became new data on the right side of the second word to be shifted. This process will continue moving the data across the DISPLAY BUFFER until the last word in the row is processed. At that time the output of the Width Counter 256 will be zero, setting the end of row F/F 268. This causes the SA Counter to increment to the starting address of the next row to be shifted, and the CA Counter will then load the new value from the SA. It will also decrement the Height Counter, reset the Width Counter, and clear the Linking Registers. We are now ready to begin shifting the second row of data.

The second and subsequent rows will be processed in the same way until the last word of the last row is shifted. At that time the Height Counter will generate the ROT DONE signal. This will cause the ROT ENA F/F 260 to be reset and the ATTN F/F 270 to set, causing the $\overline{\text{BATTN}}$ signal to tell the DR11-B that it has finished a rotation cycle.

Figure 8:
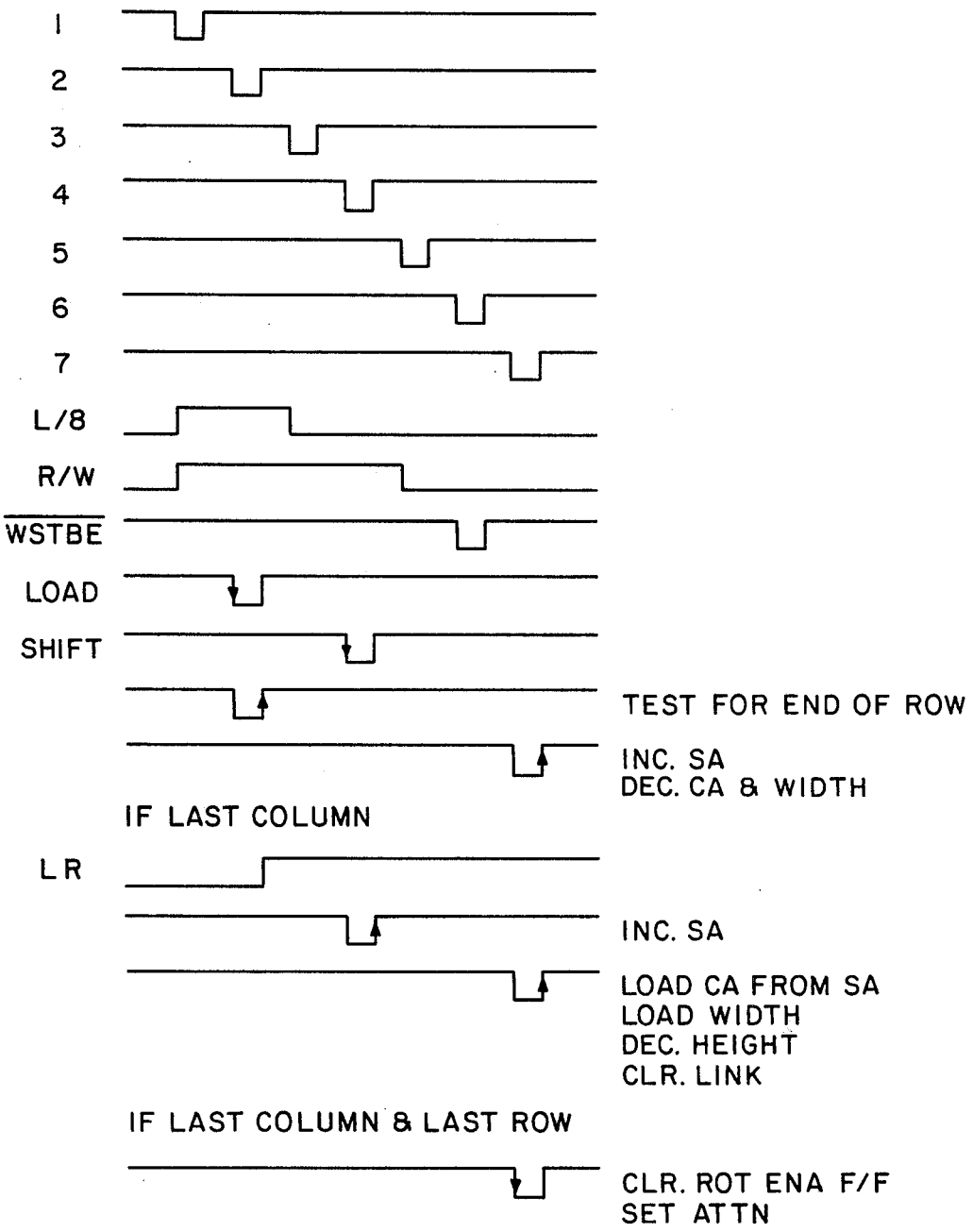
FIG. 8 is a timing diagram useful in understanding the rotator circuit according to the invention.

The foregoing action is controlled by the timing circuits now to be described. When the ROT ENA F/F 260 was set, a timing pulse generator formed by a counter 272, a binary-to-decimal decoder 274, and a 4 MHz xtal oscillator 276, was turned on. The results are a cyclical set of seven timing pulses eminating from decoder 274. These seven pulses are shown in FIG. 8, numbered 1 to 7. They cause the read-shift-write process.

One cycle of pulses from 1 through 7 will shift the contents of one DISPLAY BUFFER memory address. Thirteen cycles will shift one row of data, 91 cycles will shift the seven rows of FIG. 6.

Pulse 1 presets the two F/F's 278 and 279. F/F 278 sets the L/S (Load/Shift) mode of the SR's to load data from the DB. The F/F 279 sets the R/W of the DISPLAY BUFFER to read. Pulse 1 also clears the end of row F/F 268.

Pulse 2 generates a LOAD clock via OR gate 280. This causes the contents of the DB to be read into the SR's. It also clocks the end of row F/F 258 testing for the end of row condition.

Pulse 3 clears F/F 278 which controls the L/S signal. This sets the SR's into the shift mode.

Pulse 4 generates a SHIFT clock via OR gate 280 and buffer 282. This causes the contents of the SR and Link registers 266 to shift one bit to the left. If the end of row F/F was set by pulse 2, then pulse 4 is allowed through AND gate 284 to provide an extra clock pulse to the SA Counter.

Pulse 5 clears F/F 279 changing the R/W from the read to the write mode. The output of this F/F also causes the OC (output control) inputs of the SR's to go low via two OR gates 286 and 287. OC low places the contents of the SR's onto the DB, making its data available to be written into the DISPLAY BUFFER.

Pulse 6 becomes the $\overline{\text{WSTBE}}$ pulse at tri-state buffer 288. This writes the data into the DISPLAY BUFFER.

Pulse 7 via AND gate 290 decrements the CA counter, and increments the SA Counter. If the end of row F/F was set by pulse 2, then pulse 7 will have an alternate purpose. It will instead load the CA Counter, decrement the Height Counter, load the Width Counter, and clear the Linking Registers. This is accomplished via AND gate 292 and 293, OR gates 294 and 296. If, in addition to being the end of row it is also the last row, then the Height Counter 258 will deliver pulse 7 as its borrow output generating the ROT DONE pulse. This terminates the rotators' operation by clearing the ROT ENA F/F and setting the ATTN F/F.

V. VIDEO CONVERTER

The VIDEO CONVERTER (FIG. 2) consists of three parts. They are:

1. The QUANTIZER 126;
2. The VIDEO CONTROLLER 128; and
3. The VIDEO CONTROL PANEL 130.

A standard composite video signal is fed into the QUANTIZER. The QUANTIZER will convert this analog signal into digital data representative of signal brightness. These data are referred to herein as pixels. The pixels may be transferred to either the DISPLAY BUFFER 116 or the TRANSMITTER 122 via commands from the computer system to the V/D INTER- FACE 118. The QUANTIZER will also convert the pixels back to an analog signal which will drive a television monitor.

Figure 9A:
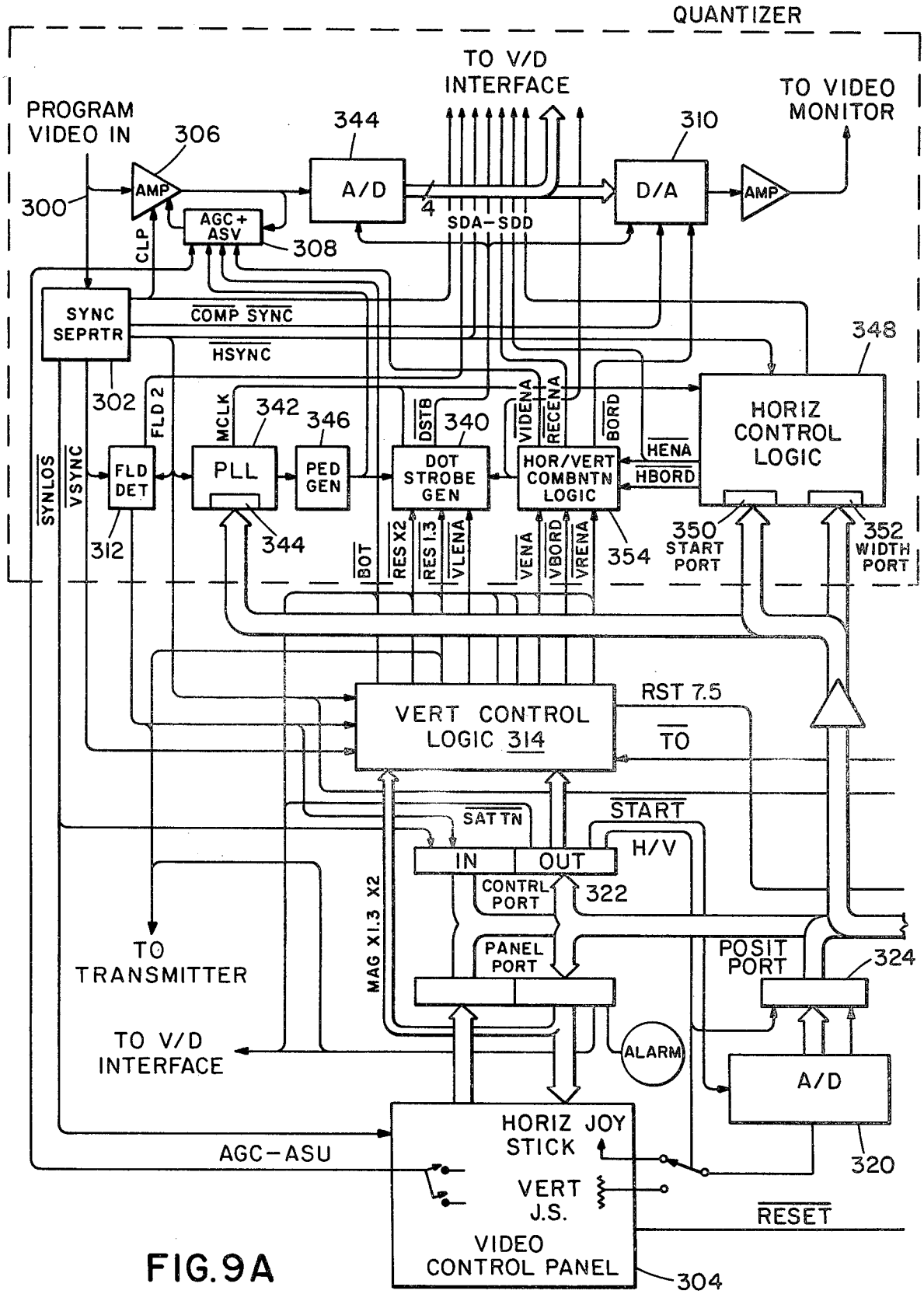
FIGS. 9A & 9B are block diagrams of the video converter according to the invention.
Figure 9B:
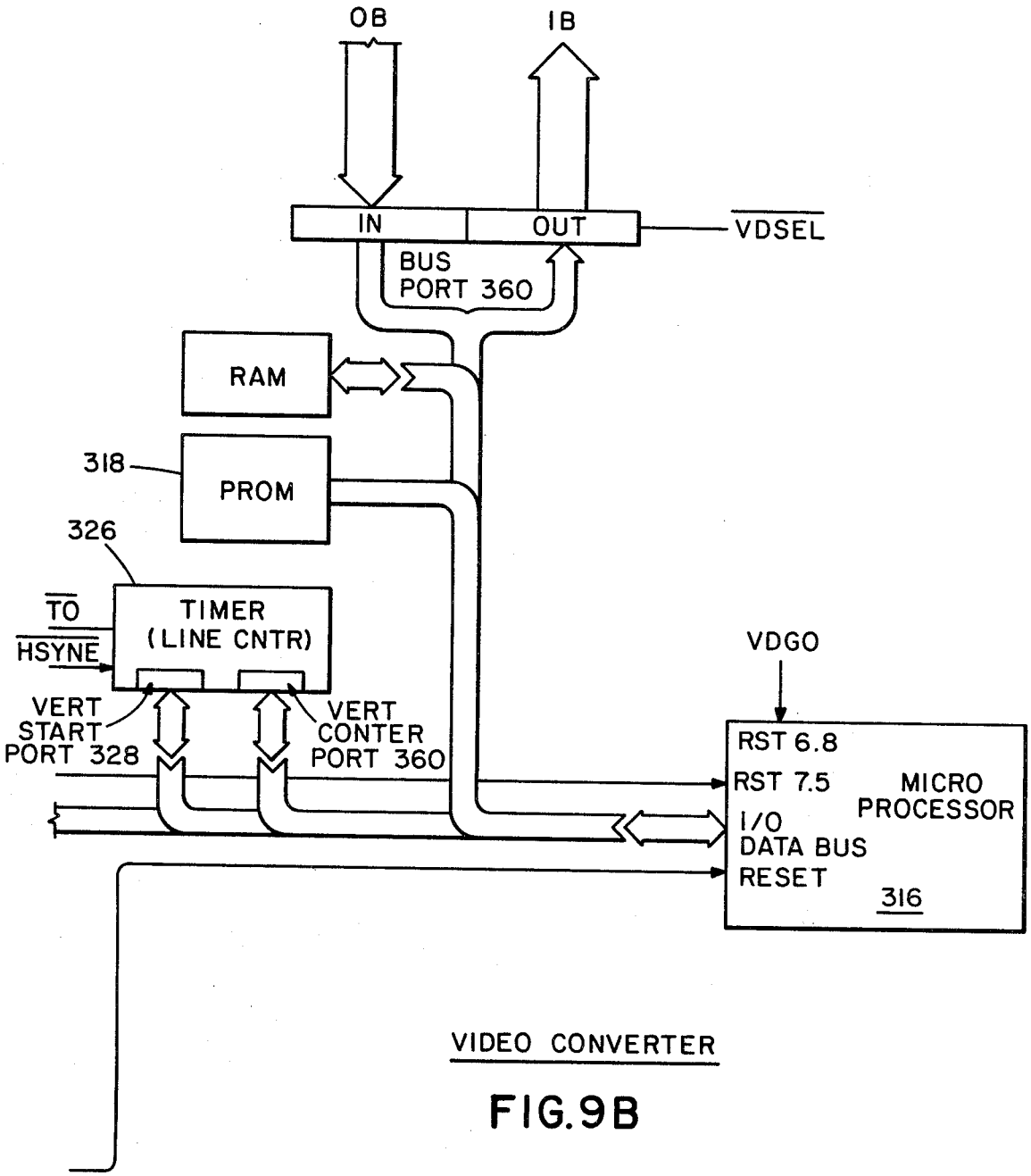

FIG. 9 is a block diagram of the VIDEO CONVERTER. As stated earlier, the prime function of the VIDEO CONVERTER is to connect an analog video signal into digital data. Since a standard frame of video contains 525 lines of data transmitted in two video fields, and the matrix board contains a lesser number of lines, for example 144, some resolution must be lost. According to the invention it is possible to use every third line of the video frame (both fields) and yield a total raster coverage encompassing 432 lines ($144 \times 3 = 432$). Alternatively an image can be generated which will sample every other line in one held or, for zoom applications, every line in one field for selected portions of the field. These last two modes give a reduced coverage of the raster, only 288 lines, but will yield an image of higher resolution than the first mode.

FIG. 10 shows the relative sizes of the two modes hereinafter referred to as x1.3 and x2 images overlayed onto a full raster of video. The x1.3 image covers almost the entire usable viewing area, while the x2 much less. To give the video operator control over what portion of the raster is selected for display a joystick is employed to move the display window horizontally (left and right) and vertically (up and down).

Locating the window and setting up the control parameters necessary to generate the correct timing for sampling the analog data is the primary function of the microprocessor circuits (FIG. 9). Establishing the basic timing pulses which the microprocessor will reference is the function of the sync separator, field detector and phase locked loop (PLL) circuits of the QUANTIZER.

The operation of the VIDEO CONVERTER can be understood with reference to the block diagram of FIG. 9. The converter operates independent of the V/D INTERFACE, so those features which are provided for the purpose of interfacing with it will be reserved for later explanation. The program video signal 300 is received by a Sync Separator 302. Here the composite video will be broken into three sync components; $\overline{\text{HSYNC}}$ (horizontal sync), $\overline{\text{VSYNC}}$ (vertical sync) and $\overline{\text{COMP SYNC}}$ (composite sync). In addition, the Sync Separator will generate a signal called $\overline{\text{SYNLOS}}$ (sync lost) and CLAMP. $\overline{\text{SYNLOS}}$ will light an LED on the VIDEO CONTROL PANEL 304 when a malfunction occurs indicating to the video operator that video program source has been lost. CLAMP will be used by the input video amplifiers 306 and AGC-ASU (automatic grain control-automatic setup) circuits 308. It will clamp the video to specific reference levels.

$\overline{\text{COMP SYNC}}$ is recombined with the digitized video at the D to A converter 310. This yields a composite video output from the D to A. After amplification this signal can directly drive a monitor and give the video operator a method for viewing the converter's output prior to or simultaneous with displaying it on the matrix board. Another feature of the monitor is to display the data outside the matrix window. This allows the operator to view the entire image and select the portion of interest. $\overline{\text{VSYNC}}$ and $\overline{\text{HSYNC}}$ go to the Field Detector circuit 312. The FLD1 output from the Field Detector identifies the presence of field one and field two. $\overline{\text{VSYNC}}$, $\overline{\text{HSYNC}}$ and FLD1 will be used by the Vertical Control Logic 314 to help generate a set of control signals. These signals will govern the outputting of the vertical lines of data. As noted earlier in x2, only data from field one will be used on the matrix display. In x1.3 both fields will be used.

The Vertical Control Logic 314 determines which lines of each field will be displayed on the matrix, the monitor or both. At the beginning of each field one the $\overline{\text{VSYNC}}$ pulse will sample the picture status information; REM 0, 1, 2 (remainder 0, 1, 2), MAG x1.3, x2 (magnification x1.3, x2). At the same time $\overline{\text{VSYNC}}$ will generate a RST 7.5 pulse. The RST 7.5 will cause an interrupt in the microprocessor 316. In response to this interrupt the microprocessor will read the CNTLP (control port) and test for the presence of the FLD1 bit. This will identify the start of the new video frame.

It will be helpful to examine what the microprocessor was doing prior to the $\overline{\text{VSYNC}}$ interrupt. The primary task of the microprocessor is to determine the position of the display window. Programmed in its firmware (PROM 318) are the necessary equations and constants needed to calculate the size and positional parameters. Obviously the way it will apply these equations depends on the magnification selected, the position of the joystick, and field being processed. We have already mentioned how the field was determined. It can learn the magnification by reading the PNLP (panel port) and looking at the RB 1.3 or RB 2 bits.

To get the positional data requires a little more work. The microprocessor must first command the A to D converter 320 to do an A to D conversion on either the horizontal or vertical joystick potentiometers (pots) located on control panel 304. It does this by writing a command into the $\overline{\text{START}}$, and H/V bits of the CNTLP (control port 322). A high on the H/V selects the horizontal pot, a low the vertical pot. When the $\overline{\text{START}}$ bit is received the A to D converter 320 performs the conversion. The microprocessor will now monitor the POSP (position port 324). When the EOC (end of conversion) bit goes high the microprocessor will read the digitized value of the horizontal pot into its memory. It will do the same with the vertical pot.

This digital position information will be used to determine numbers corresponding to the vertical start line of the window, and the horizontal starting point for each line. Let us suppose that the reading from the vertical pot determined that the picture was to begin on line 50. Assuming a display board containing a matrix of 144 lines then line 50 is the top and 193 the bottom. For this example we have also selected the x2 magnification.

To find the top of the picture it is necessary to preset a counter to 50 and decrement it once for each line. The microprocessor will preset the counter in response to each RST 7.5, while the $\overline{\text{HSYNC}}$ pulse will be used to clock it. In the block diagram of FIG. 9 a timer circuit 326 has a presetable up counter that can be loaded via the VSHP (vertical start height port 328). Its VCCP (vertical counter control port 330) can tell it when to begin counting and what to do when the counter times out. When the timer is started (immediately after $\overline{\text{VSYNC}}$) it will begin counting the $\overline{\text{HSYNC}}$. While it is counting out its first value (50) it is programmed to restart its second value (144) immediately after it counts out the first. When line 50 is reached the timer will generate the $\overline{\text{TO}}$ (time out) signal telling the vertical control logic 314 that it has reached the top line of the displayed image. The timer will now reload with the 144 value and start looking for the bottom of the picture. When it reaches the bottom a second $\overline{\text{TO}}$ will occur.

The previous paragraph was somewhat of a simplification of what actually happens.

The vertical window's position and therefore its motion is determined by purely on the count of the lines in field one. Thus each window and its corresponding lines of data will always start on field one.

The outputs of the Vertical Control Logic 314 will now be considered. $\overline{BOT}$ is a pulse which occurs as the last line of the bottom border is being displayed on the monitor. $\overline{RES\ x1.3}$ and $\overline{RES\ x2}$ inform the Dot Strobe Generator 340 what the horizontal sampling frequency is to be. $\overline{VLENA}$ (vertical line enable) identifies every line in a field which will be displayed on the monitor, and this will also include those lines which will appear on the matrix. $\overline{VLENA}$ is used by the Dot Strobe Generator to gate the clock pulses needed to sample and display the dots seen on the monitor. $\overline{VENA}$ identifies all the lines located inside the vertical borders without regard to size or field. $\overline{VBORD}$ identifies just those lines which are to make up the vertical borders, both top and bottom. By gating this last signal with another the vertical borders will be generated. $\overline{VRENA}$ (vertical record enable) identifies those lines between the vertical borders which will be displayed on the matrix board. In x2 magnification this will mean consecutive lines of field one. In x1.3 it will mean every third line of both fields. $\overline{VDENA}$ (vertical display enable) is formed by ANDing VLENA with VENA. $\overline{VDENA}$ identifies all the video lines between the vertical borders which will be used on the monitor display.

Four of the signals just discussed ($\overline{VLENA}$, $\overline{VENA}$, $\overline{VBORD}$ and $\overline{VRENA}$) are the primary control signals generated by the VIDEO LOGIC 314 and are the results of the microprocessor's efforts in defining the image's vertical position. To define the horizontal position will require that the 63.5 usec period of each horizontal line be divided into a fixed number of sampling points. Then the horizontal position of the window can be determined similarly to the vertical, only this time by counting sampling points instead of horizontal sync pulses. Dividing the horizontal line into sampling points is accomplished by the PLL (phase locked loop) circuit 342. The sampling points are defined by its output MCLK (master clock). Actually MCLK runs at twice the x2 sampling frequency, but any MCLK may determine a sampling point because horizontal motion of the joystick is based on the MCLK count.

The exact number of MCLK's between the leading edges of the adjacent $\overline{HSYNC}$'s is programmable by the microprocessor 316. PLL 342 contains a presetable counter whose carry will be synchronized with the $\overline{HSYNC}$ pulse. If the counter is preset, for example, to count 780 MCLK's between carries, the horizontal line will then be divided into 780 parts by the action of the PLL circuit. The value of the counter preset value is controlled via the HMP (horizontal modulus port 344).

The MCLK output of the PLL is fed to the Dot Strobe Generator 340. Here it will be reduced to the correct frequency needed to convert and display the video on a monitor. The MCLK generated by the PLL will run at 12.28 MHz. If $\overline{RES\ x2}$ is chosen a $\overline{DSTB}$ (dot strobe) signal will result at 6.14 MHz. If $\overline{RES\ x1.3}$ is selected the resulting $\overline{DSTB}$ will be at 4.09 MHz. $\overline{VLENA}$ will allow $\overline{DSTB}$'s only on those lines which the monitor will display. The resulting $\overline{DSTB}$ is applied to both the A to D and D to A converters 344 and 310. At the A to D it will cause the input video to be sampled and form a for bit digital pixel at its output. The D to A will combine $\overline{DSTB}$ with the pixel value enabling it to convert back to an analog level. This will cause a dot to be strobed on the monitor.

There is a period of time around each HSYNC pulse which is referred to as horizontal blanking. During this time no picture information is available. To inhibit the action of $\overline{DSTB}$ during this time a Ped. Gen. (pedestal generator) circuit 346 is employed. It will derive its output from the count of the PLL counter. The PED signal which results will feed into the Dot Strobe Generator 340 to be ANDed with the $\overline{VLENA}$ signal.

The action of the PLL, Ped. Gen. and Dot Strobe Generator yields an entire raster of pixels on a monitor, using only those lines selected by the $\overline{VLENA}$ signal. Next we must locate the horizontal edges of the window used by the display. For this we turn to the Horizontal Control Logic 348. The Horizontal Control Logic has two ports. The HSP (horizontal start port 350) and the HWP (horizontal width port 352). The horizontal joystick on the control panel is read to determine the horizontal starting point of the window. This value is loaded into the HSP where it can be used to preset a counter at each $\overline{HSYNC}$'s leading edge. The counter will count MCLK's until the counter carries out and indicates the start of the horizontal window. The counter will reset to the value contained in the HWP, and begin counting MCLK's until it carries once more. The two carries will define the left and right horizontal edges of the window. The microprocessor will have determined their locations.

Desirably a right and left border is generated and the counter preset values must be altered to provide for them. The borders on the left and right sides each consist of four MCLK time periods, and they are solid lines, not formed by $\overline{DSTB}$.

The primary outputs of the Horizontal Control Logic produces only two signals, one called $\overline{HENA}$ (horizontal enable) and $\overline{HBORD}$ (horizontal border). $\overline{HENA}$ defines the area between the inside edges of the left and right borders. $\overline{HBORD}$ defines the borders. It is worth noting at this time that both $\overline{HENA}$ and $\overline{HBORD}$ operate on every line of the raster and are not gated by any vertical signals. They thus encompass the entire height of the raster. The Hor/Vert Combination Logic 354 gates these signals.

The Combination Logic 354 takes the output of the Vertical and Horizontal Control Logic and yields signals that define the total roster. $\overline{HENA}$ combined with $\overline{VENA}$ will yield $\overline{VIDENA}$ (video enable). $\overline{VIDENA}$ defines the entire area located within the borders. This signal will tell the AGC and ASU circuits 308 when to sample the video. $\overline{HENA}$ combined with $\overline{VRENA}$ will yield $\overline{RECENA}$ (record enable). This signal defines only those lines within the border that may be displayed on the matrix board. $\overline{VBORD}$ and $\overline{HBORD}$ are combined to produce the $\overline{BORD}$ (border) signal. This signal will drive the D to A converter to trace the white border onto the monitor.

Interfacing of the converter to the PDP computer and to the V/D INTERFACE is accomplished. For example, the microprocessor 316 will tell the PDP computer when the $\overline{RNSW}$ (run request switch) on the VIDEO CONTROL PANEL 304 has been turned on. The $\overline{RNSW}$ is switched on by the video operator to begin the transferring of video to the display matrix. The $\overline{SSB}$ (snapshot button request) will indicate that the video operator wants to transfer one frame of video. The $\overline{RB\ 1.3}$ and $\overline{RB\ 2}$ will tell the computer which image magnification is being processed. The OBIBP communicates data from the computer via the OB.

When commands are being issued from the computer to either the V/D INTERFACE or the VIDEO CONVERTER, the V/D INTERFACE will generate the $\overline{\text{VDSEL}}$ and $\overline{\text{VDGO}}$ signals. $\overline{\text{VDSEL}}$ will enable the OBIBP's output to the IB. $\overline{\text{VDGO}}$ will generate an interrupt at the microprocessor RST 6.5 input. For each $\overline{\text{VDGO}}$ received the microprocessor will respond by generating $\overline{\text{SATTN}}$ (set ATTN). $\overline{\text{SATTN}}$ will go back to the V/D INTERFACE and cause a $\overline{\text{BATTN}}$ to be returned to the computers DR11-B. If the command sent was to cause the transfer of a video frame, then the $\overline{\text{BATTN}}$ will be inhibited until the V/D INTERFACE completes the transfer.

The VIDEO CONVERTER continuously outputs video frames to the monitor and the V/D INTERFACE so long as a video source is applied at its input. If a frame of video is to be transmitted to the matrix board or to the display buffer, then that operation must be performed by the V/D INTERFACE.

FIRMWARE

As stated earlier, this specification will not detail the instruction by instruction operation of the firmware. What will be given here is a functional flow diagram which should give the reader a better understanding of the microprocessor's part in the operation of the VIDEO CONVERTER.

The microprocessor executes the firmware in one of three possible levels. These three levels and their definitions are as follows:

1. Restart—The Restart level is used whenever the power is first applied, or when the reset switch is depressed. This level calculates a starting set of port variables and initializes the ports.

2. Background—This is what the microprocessor is doing when it is not servicing an interrupt. At this level the housekeeping operations are done. Here the microprocessor periodically monitors the VIDEO CONTROL PANEL and performs the necessary calculations needed to update the port variables.

3. Foreground—This is the microprocessor's interrupt service level. There are two of these levels; the RST 7.5 and the RST 6.5. The RST 7.5 is the interrupt response to the VSYNC signal. The RST 6.5 is caused by the V/D INTERFACE's VDGO signal. This level is entered from the Background level and will return to it after the interrupt service routine is completed.

Figure 11A:
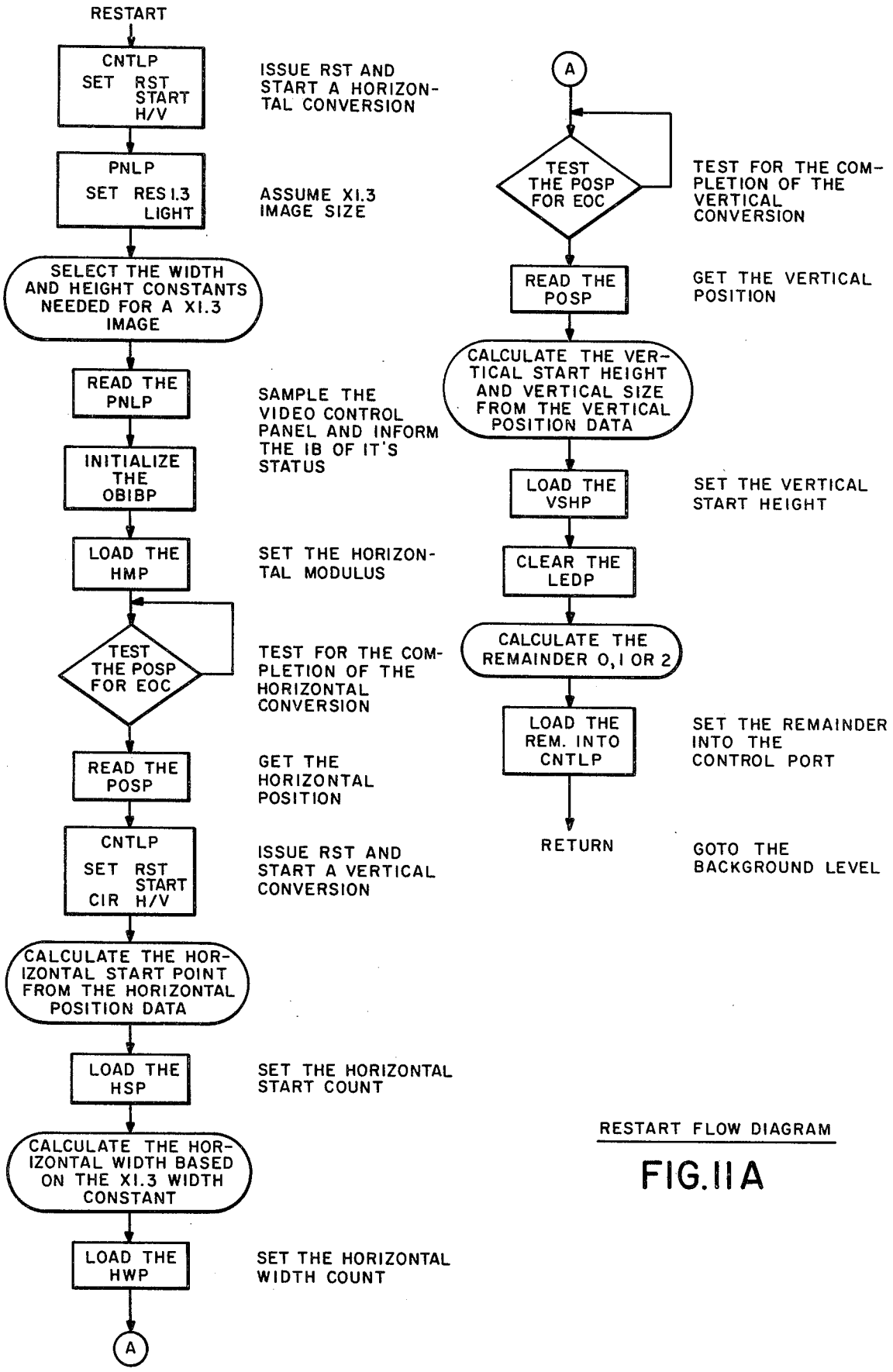
FIG. 11A is a restart flow diagram.

FIG. 11A shows the Restart flow diagram. Notice that the initial image size is assumed to be x1.3, and that all the initial port variables are set based on that size plus the joystick position. The Restart level is entered by any one of four different ways. First, when power is first applied. Second, if the computer issues an $\overline{\text{INIT}}$ (initialize) pulse. Third, if the video operator depresses the RESET button on the VIDEO CONTROL PANEL. Fourth, if the RESTART switch on the VIDEO CONTROLLER is operated.

Figure 11B:
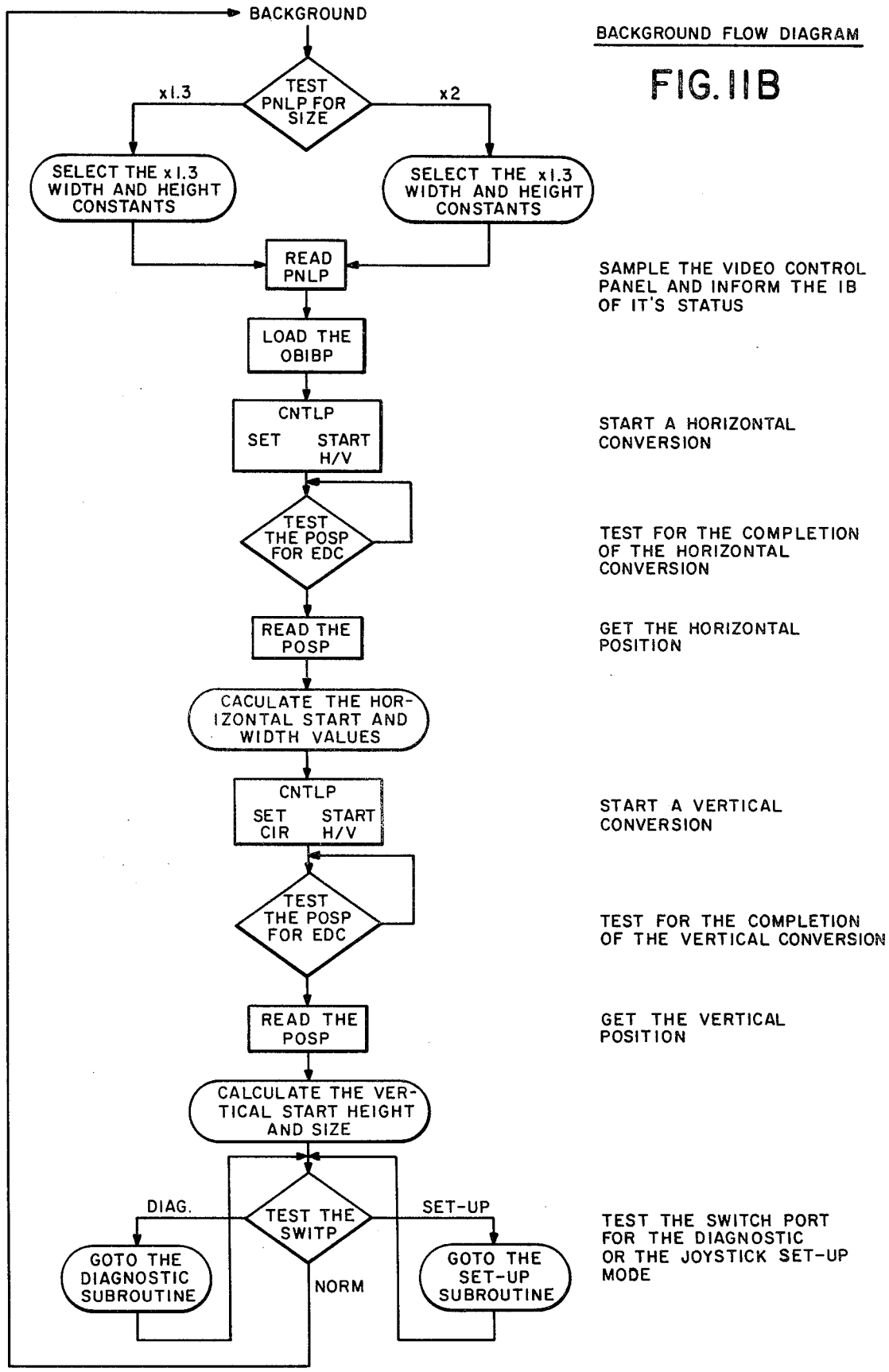
FIG. 11B is a background flow diagram.

The Background flow diagram is shown in FIG. 11B. The Background is entered from the Restart level, and exited whenever an interrupt occurs. After an interrupt is serviced the Background level is re-entered at the point where the interrupt occurred. If either the Diagnostic or Setup switch is active, the program will branch to subroutines which alter the operation of the VIDEO CONVERTER. Deactivating the switches will restore normal converter operation.

The Foreground level has two parts. One is entered by a RST 6.5 interrupt. The other via a RST 7.5 interrupt. The first is triggered by $\overline{\text{VDGO}}$ and describes a Command Interrupt. This occurs when the computer issues a command to the V/D INTERFACE. The second by the $\overline{\text{VSYNC}}$ pulse and begins a test of status and initiates port variable setup.

Figure 11C:
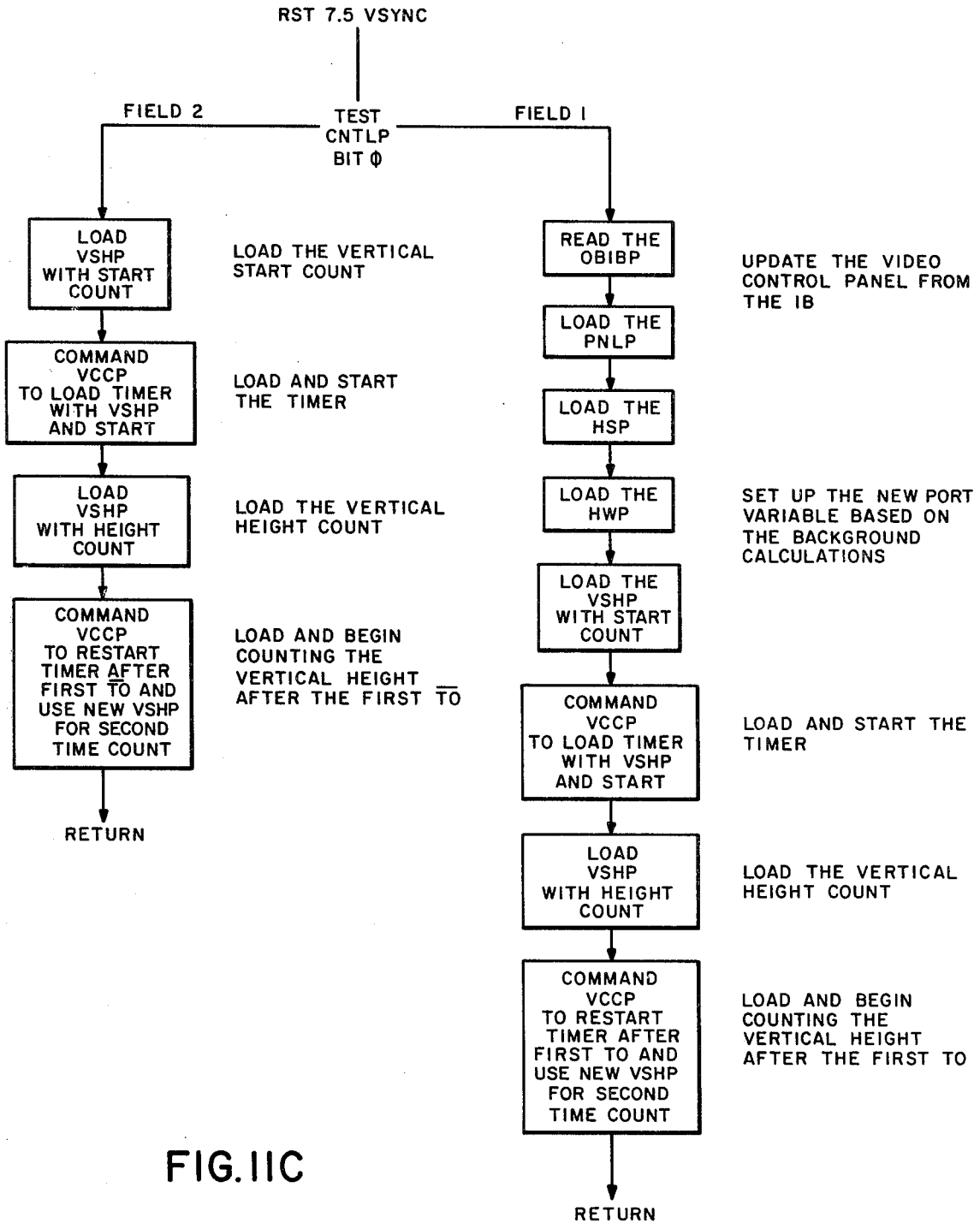
FIG. 11C is a foreground flow diagram.

Since $\overline{\text{VSYNC}}$ will happen once for field one and once for field two there will be two ways of responding to this interrupt. FIG. 11C diagrams the RST 7.5 Foreground level.

VERTICAL POSITION CONTROL

The microprocessor will issue a command to the CNTLP 322 setting the H/V bit low (for vertical) and the START bit high. This selects the analog output of the vertical joystic and, via one shot IC-59, triggers an A to D conversion cycle in 320. When the digital conversion is complete ND 320 sets the EOC bit in the POSP 324. The Processor will test this bit, and read the POSP value in response to its going high. The POSP data will be converted by the Processor to two binary values. One representing the vertical images starting line value, and one representing the image height. The first value will be loaded into the VSHP, in response to a vertical sync interrupt (RST 7.5). A command will then be issued to the VCCP 330 to start the timer 326.

$\overline{\text{HSYNC}}$ is the timer's clock input. The timer 326 will count $\overline{\text{HSYNC}}$'s (video lines). While the timer is counting out the starting line value, the Processor will load it with the line height value and issue it a command to start counting out the height as soon as it finishes with the start value. The timer will issue a $\overline{\text{TO}}$ (time out) pulse each time it counts the number of preset lines. Thus, the first $\overline{\text{TO}}$ will indicate the start of the vertical image, the second $\overline{\text{TO}}$ indicates the bottom.

Figure 11D:
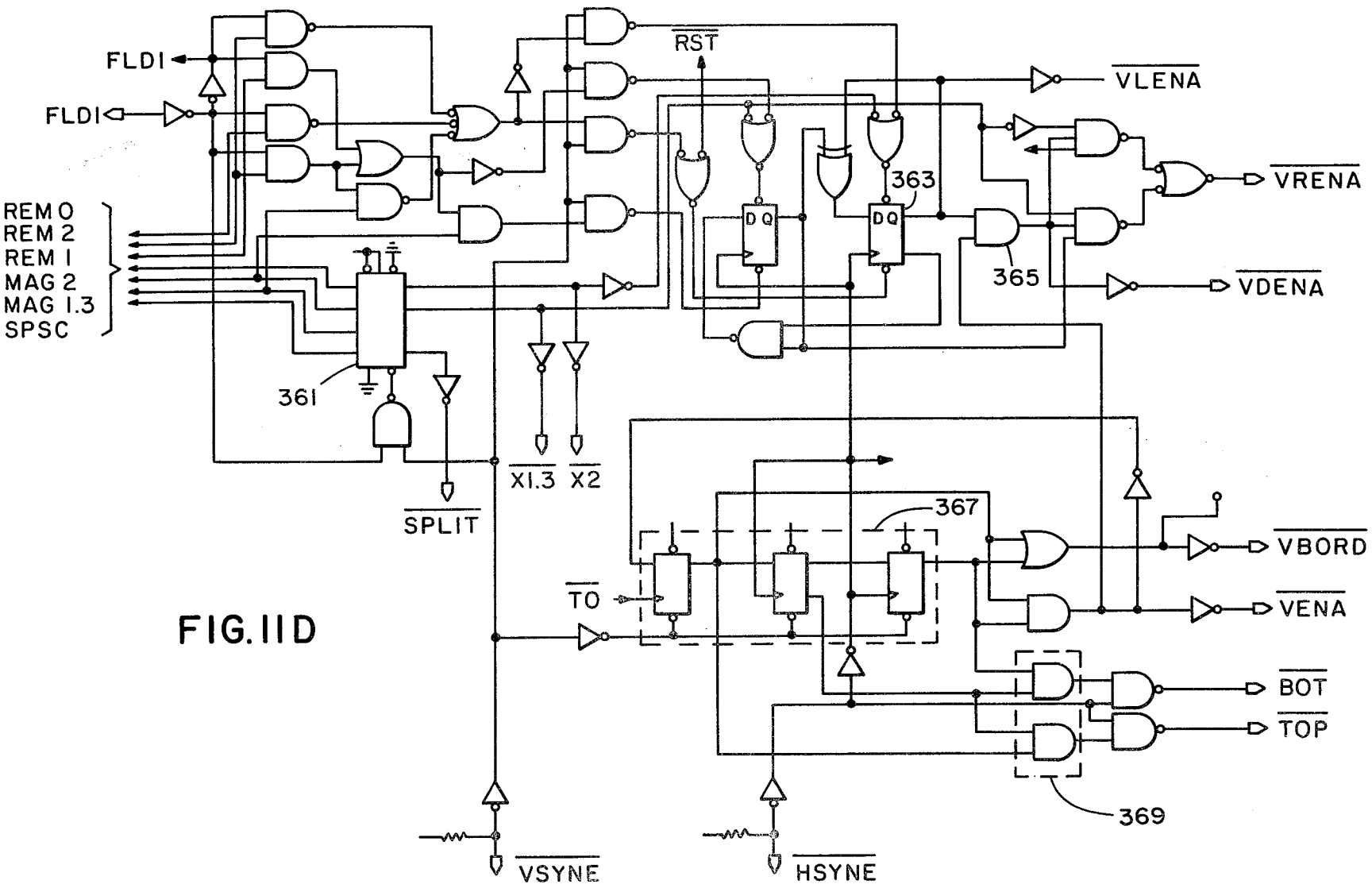
FIG. 11D is a schematic diagram of vertical control logic of the video converter.
Figure 11E:
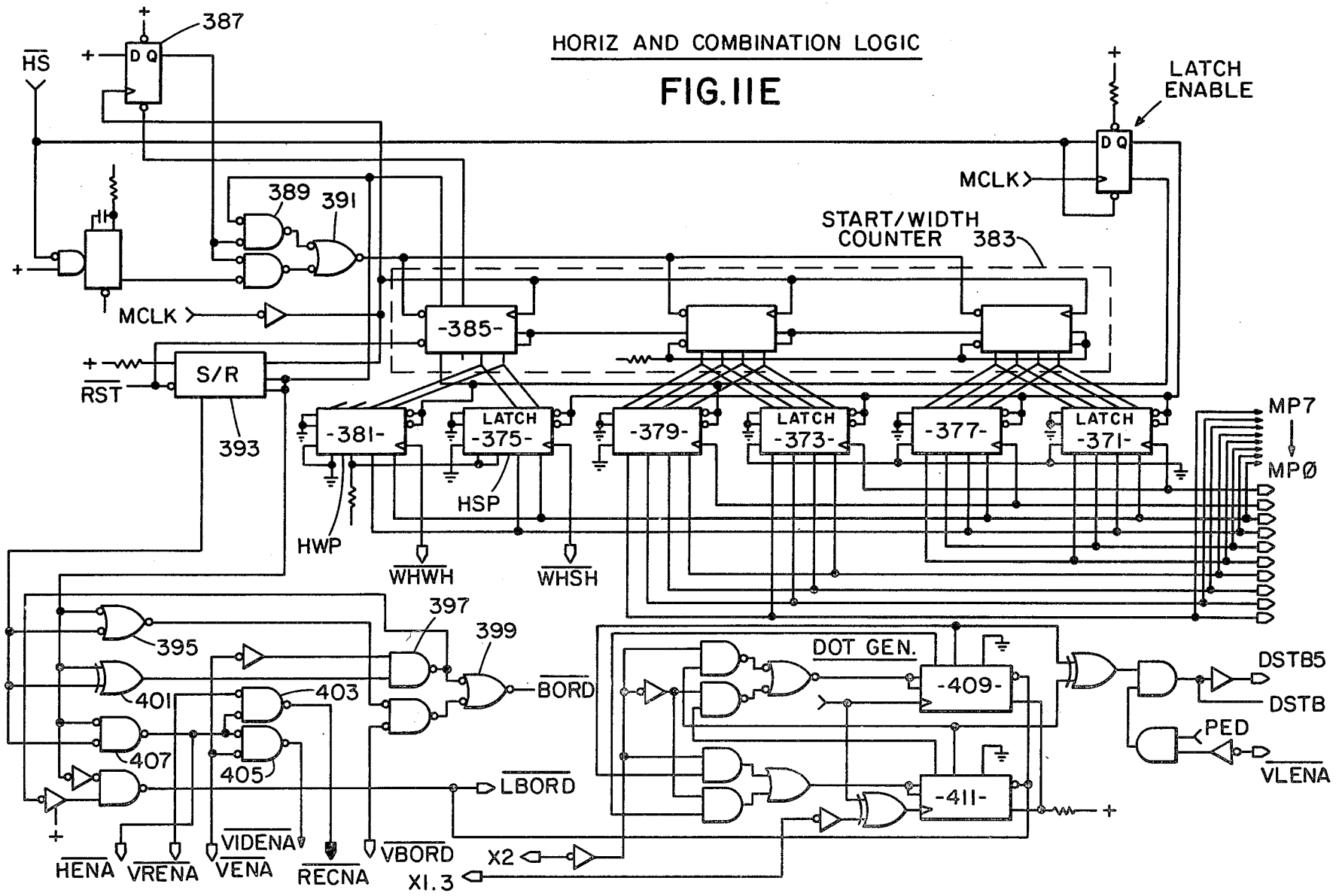
FIG. 11E is horizontal and combination control logic of the video converter.

At the same time the Processor calculated the start and height values it determined by REMϕ, 1 or 2 value. The REM value selects on which video line the image must begin. This is the uppermost line above the top border. This value only applies when the X1.3 size is selected. For X2 the REM values have no meaning since, for this size, lines are displayed on the monitor. FIG. 11D uses the control logic 314. Assuming the MAG2 image size is sampled by latch 361 (by each $\overline{\text{VSYNC}}$ starting a video field 1), it's output will hold F/F 363 preset. This will force $\overline{\text{VLENA}}$ low indicating that all lines are to be processed to the monitor. AND gate 365 will also be enabled. The other input to this gate is waiting to be set by a signal indicating the vertical images window within the field. This window indicator is derived from the $\overline{\text{VENA}}$ signal, which is generated by the $\overline{\text{TO}}$'s from the Timer.

The first $\overline{\text{TO}}$ pulse will cause the first bit of a three bit SR 367 to be set. The remaining two bits of the SR are clocked by $\overline{\text{HSYNC}}$. For the next two $\overline{\text{HYSNC}}$'s the SR will be loaded with all ones. The first bit going high will begin the $\overline{\text{VBORD}}$ signal and generate a $\overline{\text{TOP}}$ pulse out of the next $\overline{\text{HYSNC}}$. The second bit going high will disable the $\overline{\text{TOP}}$ and ages 369. The third bit going high will terminate the $\overline{\text{VBORD}}$ and set $\overline{\text{VENA}}$ low. $\overline{\text{VENA}}$ will remain low until the next TO arrives clearing the first element of the SR. This causes $\overline{\text{VBORD}}$ to once again go low. The next two $\overline{\text{HSYNC}}$'s will clear the second and third bits of the SR. This generates the $\overline{\text{BOT}}$ pulse and terminates $\overline{\text{VBORD}}$.

Returning now to the AND gate 365 we have as its output all the monitor displayed lines between the top and bottom vertical border, in both video fields. This is the $\overline{\text{VDENA}}$ signal. NANDing this with FLD1 signal will yield $\overline{\text{VRENA}}$. $\overline{\text{VRENA}}$ identifies only those lines which contain information which may appear on the matrix. We shall call this a real data line. The data that is later extracted from these lines will be called real data. All the lines not indicated by $\overline{\text{VRENA}}$ exist only for operator convenience, and to reduce field flicker on the monitor.

HORIZONTAL POSITION CONTROL

The Processor will collect the horizontal position data from the POSP 324 in the same manner in which it determined the vertical. This time the H/V bit will be set high to select the horizontal joystick. Analogous to the vertical method, the Processor will compute the horizontal start and horizontal width values. These values are based on the number of MCLK's contained between two adjacent $\overline{\text{HSYNC}}$'s. (The PLL modulus). FIG. 11 E shows the horizontal control logic and the combination logic 354.

Latches 371, 373, 375 make up the HSP 350 value, while latches 377, 379 and 381 form the HWP 352. The Processor will load the current horizontal start and width values after each $\overline{\text{VSYNC}}$ interrupt. Each $\overline{\text{HS}}$ pulse will cause the counter 383 to load the HSP value. The counter will be clocked by MCLK until counter segment 385, bits C and D simultaneously toggle low. This identifies the start of the video image's left hand border. The C output of 385 will clear the F/F 387, which will, in turn, place the counter into a load condition via gates 389 and 391. The next MCLK will cause the counter to load the value contained in the HWP. When the horizontal width value is clocked out segment 385, bit C will again go low, but bit D will go high.

SR 393 has a D output which follows segment 385, D output, delayed by four MCLKs. By exclusive ORing these outputs at gates 395 we form HBORD. Combining HBORD with $\overline{\text{VENA}}$ at NAND gate 397 yields the right and left borders ($\overline{\text{R/L BORD}}$). The output of the OR gates produces a signal that windows the horizontal image, including the right and left borders. Combining this output with $\overline{\text{VBORD}}$ yield the top and bottom borders ($\overline{\text{T/B BORD}}$). Oring at 399 $\overline{\text{R/L BORD}}$ with $\overline{\text{T/B BORD}}$ yields $\overline{\text{BORD}}$, a signal which will sketch the border around the moveable display window.

By combining the same D outputs mentioned in the preceding paragraph in yet a third way, gate 401 will yield the $\overline{\text{HENA}}$ signal. $\overline{\text{HENA}}$ identifies the data inside the right and left borders, on every video line. ANDing at 403 $\overline{\text{HENA}}$ with $\overline{\text{VRENA}}$ yields $\overline{\text{RECENA}}$; a signal which identifies only the real image data on only the real image lines. ANDing at 405 $\overline{\text{HENA}}$ with $\overline{\text{VENA}}$ yields $\overline{\text{VIDENA}}$. $\overline{\text{VIDENA}}$ identifies all the data (real and monitor) that lies within the four borders.

One final signal generated by the combination logic is $\overline{\text{LBORD}}$ (left border) from gate 407. $\overline{\text{LBORD}}$ will clear the dot strobe counters 409 and 411, so that when the left border terminates the DSTB pulse clocking begins left justified to the border, no matter which sampling rate is selected.

VI. VIDEO/DISPLAY INTERFACE

The V/D INTERFACE 118 (video/display interface) is the focal point of data routed between three of the systems major elements. FIG. 12 shows the significance of its operation.

Display images may be generated from two sources; the computer system via the DISPLAY BUFFER, or the video system via the VIDEO CONVERTER. To indicate the image sources let us use SDBF to mean "source: DISPLAY BUFFER" and SLV to mean "source: live video" (from the VIDEO CONVERTER). A sourced image must have a destination. The destinations will be called DDBF for "destination: DISPLAY BUFFER"; DVM for "destination: video matrix"; and DDPM for "destination: display/preview monitor".

Not all combinations of source and destination are valid. The following list indicates those which are:

SLV→DVM

SDBF→DVM

SLV→DDBF

SDBF→DDPM and DDPM

SLV and SDBF→DVM

The last item in the list combines an image in the DISPLAY BUFFER with one coming from the video converter. The V/D INTERFACE provides for two methods of combinations, one called insert and one called overlay. The insert-overlay (IN/OV) command will be discussed later in this specification.

FIG. 3 indicates all the possible commands that may be issued to the V/D INTERFACE. An analysis of all the possible combinations of source and destination is unnecessary since the operation of the interface can be understood by reference to two descriptions: one based on the SLV command and one based on SDBF command. In the SLV mode the V/D INTERFACE derives its timing signal from the VIDEO CONVERTER since this information is already in the video converter output. When the SDBF mode is used the V/D INTERFACE must generate its timing signals locally.

In addition to the timing source we will also consider the difference in moving data from or to the DISPLAY BUFFER. This is the only bi-directional device which the V/D INTERFACE must handle, and there are some timing differences which result.

Thus, for the most part, the following description will relate to the operation of the V/D INTERFACE first in the SLV→DDBF mode and second in the SDBF→DVM mode.

SLV→DDBF

Figure 13A:
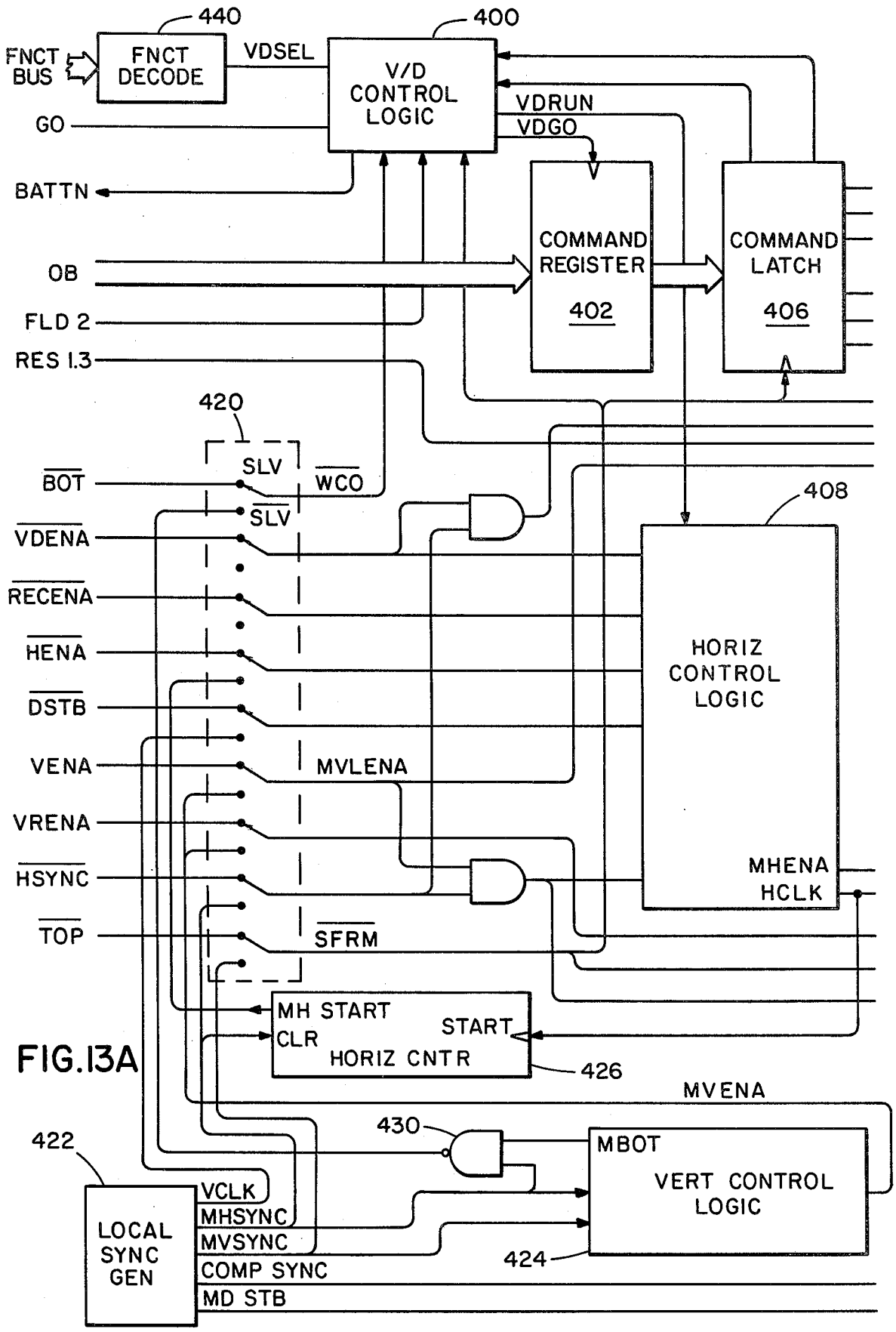
FIGS. 13A & 13B are block diagrams of the V/D interface.
Figure 13B:
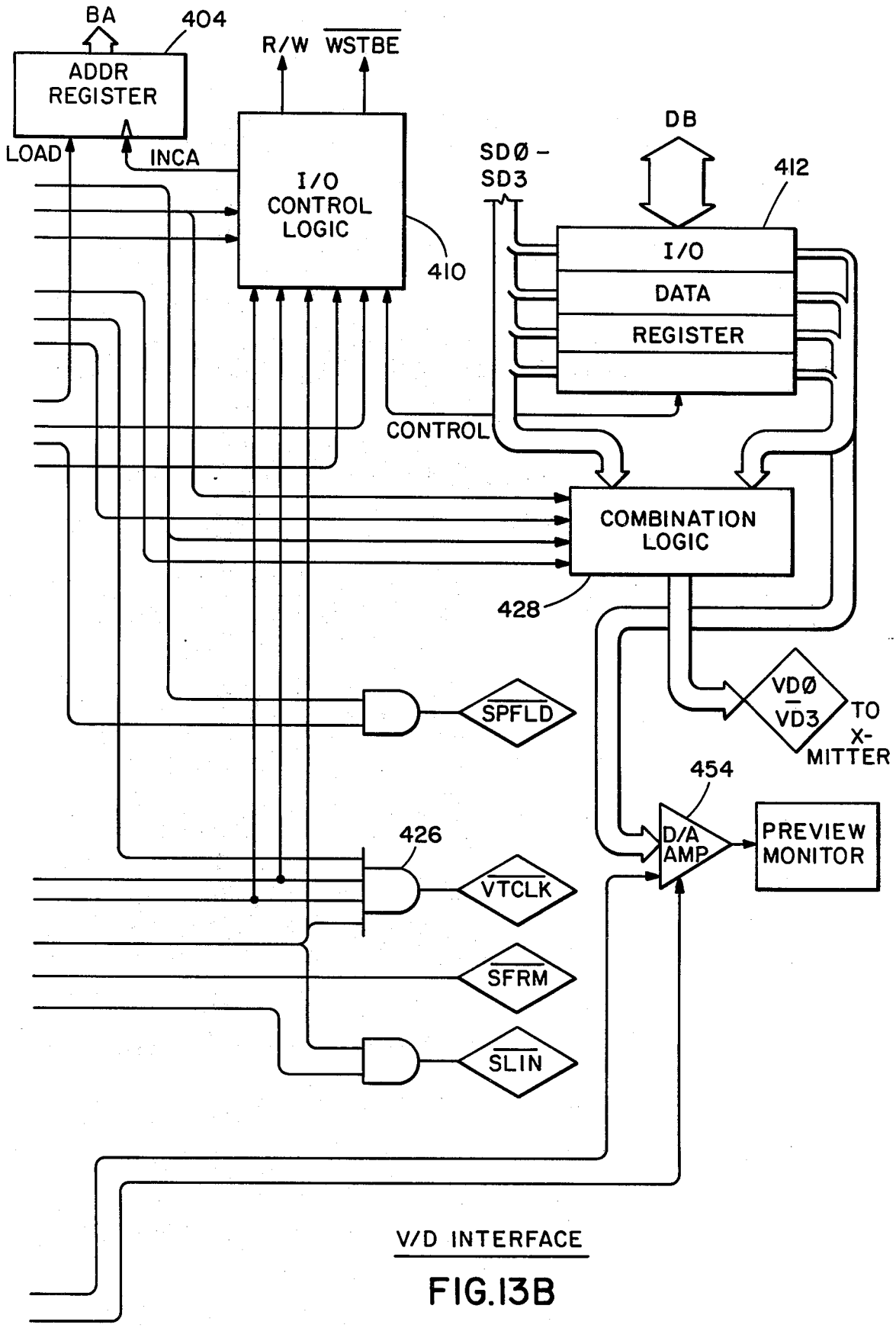

The block diagram of the V/D INTERFACE is illustrated in FIG. 13. In describing this complex circuit it will be assumed that x2 is in effect; thus $\overline{\text{RES 1.3}}$ is always high.

The PDP 11 will set up function $\phi 1 \phi$ and issue a command to the V/D INTERFACE. This command will set the following bits: SLV, DDBF, EA. The V/D Control Logic 400 will issue VDGO to load the Command Register 402. The $\overline{\text{TOP}}$ signal generated by the VIDEO CONVERTER will become the $\overline{\text{SFRM}}$ signal on the V/D INTERFACE. $\overline{\text{SFRM}}$ will cause the Address Register 404 to load its starting address (in this case zero) and also transfer the contents of the Command Register to the Command Latch 406. If the command is a valid one and the image is coming from field one (FLD2 low), then $\overline{SFRM}$ will set the VDRUN condition in the V/D Control Logic. VDRUN will enable the Horizontal Control Logic 408 to process a line of video data.

The leading edge of HENA will cause the F/F in the Horizontal Control Logic 408 to set. The output of this F/F ($\overline{MHENA}$) combined with $\overline{VDENA}$, $\overline{HENA}$ and $\overline{DSTB}$ will generate HCLK. HCLK (Horizontal Clock) will follow $\overline{DSTB}$ for all pixels which appear inside the borders on the VIDEO CONVERTER monitor. HCLK is the prime mover of data on the V/D INTERFACE. The Horizontal Control Logic keeps track of how many HCLK's occur in each line. When it counts, in the case of a video board 192 pixels wide, 192 it toggles the MHENA F/F low. Thus the V/D INTERFACE will never process more than the number of pixels at the display board. If, however, the VIDEO CONVERTER provides a line of data less than 192 pixels long, it will fill in the balance by gating VCLK to become HCLK.

The I/O Control Logic 410 utilizes MHENA and MVLENA to shift the VIDEO CONVERTER serial data (SDA-SDD) into the I/O Data Register 412. The I/O Data Register is divided into two parts. The first eight out of sixteen pixels will shift into the lower half of the register, the second eight into the upper half. The I/O Control Logic 410 directs this operation via the output of a 16 bit word counter. The specific circuits performing these operations are shown in Figures and described later on.

Immediately after the lower 8 bits are shifted in, they are transferred to a latch. After the upper 8 bits are received, they too will be transferred to a latch. At this time 64 bits of received data are now waiting on the Data Bus, while the next 16 pixels begin to load into the I/O Data Register's lower half. If VRENA is enabled, (signifying a valid line of data, i.e. not just a line used on the monitor) then the I/O Control Logic 410 will issue a $\overline{WSTBE}$ to the Display Buffer, causing the 64 bits of data to be written into RAM. Simultaneous with the $\overline{WSTBE}$ an $\overline{INCA}$ pulse will be generated. INCA will clock the Address Register 404 on its trailing edge, thus setting up the next address to be written in the Display Buffer. Note that $\overline{INCA}$ occurs independent of the $\overline{VRENA}$ signal. This fact will become important later when we discuss the differences associated with the x1.3 mode.

The foregoing shift, latch, write and increment process will repeat for every group of 16 pixels received from the VIDEO CONVERTER. At the end of each horizontal line the Display Buffer contains one additional address, the scratch column. The scratch column is now written to by the V/D INTERFACE. Thus one additional $\overline{INCA}$ pulse is needed to skip to the address beginning the next video line. $\overline{HSYNC}$ will be ANDed with $\overline{VDENA}$ to produce the extra $\overline{INCA}$.

After 144 lines of data are received the VIDEO CONVERTER will generate $\overline{BOT}$ as previously described. $\overline{BOT}$ will produce the $\overline{WCO}$ (word count overflow) signaling the V/D Control Logic 400 that the end of the video frame has been reached. $\overline{WCO}$ will cause the $\overline{BATTN}$ signal to set, thus informing the PDP 11 computer that the frame was received and transferred to the Display Buffer. Notice that $\overline{WCO}$ does nothing else and that VDRUN is still set, allowing the next frame of video to arrive and write over the frame just received. If only one frame is to be captured the PDP 11 must issue a new command cancelling SLV and DDBF. This will cause VDRUN to clear when the next SFRM arrives.

SDBF→DVM

For this mode of operation the switches 420 shown in FIG. 13 all toggled to the lower position. This conditions the interface to use the Local Sync Generator 422, and the outputs from the Vertical Control Logic 424 and Horizontal Start Counter 426. Using the local sync generator produces the following conditions:

1. All timing will be based on an x2 image size.
2. The position of the image within the sync generators video format is fixed both vertically and horizontally by the Vertical Control Logic and the Horizontal Start Counter.
3. The height and width of the image is fixed by hand wired switches.
4. None of the VIDEO CONVERTER's output has any effect on the operation of the V/D INTERFACE.

As in the SLV mode, the PDP 11 will issue a command to the Command Register 402, this time setting SDBF, DVM and EA. SFRM will again be used to transfer the command to the Command Latch, and also to set VDRUN. The SFRM signal is generated by MVSYNC (monitor vertical sync), one of the five outputs of the Local Sync Generator 422. MVSYNC will reset the line counters of the Vertical Control Logic and send $\overline{SFRM}$ to the TRANSMITTER. The $\overline{MHSYNC}$ signal will now begin to increment the Vertical Start line counter (IC-87 and 88) contained in the Vertical Control Logic 424. After a preset number of horizontal lines have been counted the MVENA F/F will be set.

In the Horizontal Control Logic 408 VCLK is selected to generate HCLK. The MHSYNC pulse will enable the Horizontal Start Counter contained therein to count multiples of 12 HCLK's. After the preset value of HCLK's has been counted MHSTART will cause the MHENA F/F to be set. MHENA ANDed at gate 426 with MVENA, HCLK and DVM will send $\overline{VTCLK}$ (video transmit clock) to the TRANSMITTER. The Horizontal Control Logic's width counter will allow 192 HCLK's for each horizontal line. The Vertical Control Logic's height counter will count 144 lines in the case of a MXN matrix where M is 144 and N is 192.

The I/O Control Logic 410 is conditioned, when SDBF is high and DDBF is low, to read and transfer data from the DISPLAY BUFFER to the TRANSMITTER in synchronization with MHENA, MVENA and HCLK. Prior to MHENA and MVENA going high, the latches and SR's of the I/O Data Register 412 are constantly being loaded by the action of HCLK. This preloads the first 8 pixels of data for each line. When MHENA and MVENA are both high the contents of the lower 8 pixels will shift through the Combination Logic 428 and pass to the TRANSMITTER as VDϕ through VD3. While 8 pixels are shifting out of the lower half of Register 412 the upper half will be loaded. After the eighth pixel has been sent on its way the I/O Control Logic 410 will direct the upper SR to output and the lower will be set to load its next 8.

Each time the upper half of the I/O Data Register is parallel loaded, an $\overline{INCA}$ is sent to the counters of the Address Register 404. Thus each successive 16 pixels will come from the next DISPLAY BUFFER address. After MHENA goes low (the end of the line) one more $\overline{INCA}$ is needed to increment past the Scratch Column. This is accomplished by allowing the V/D INTERFACE to actually output the scratch column as though it were part of the visible line. MHENA3 will delay the effect of MHENA going low for 16 HCLK's, causing the scratch column to be processed through to the TRANSMITTER. The scratch column's data will, however, not be read by the TRANSMITTER because MHENA going low will disable $\overline{VTCLK}$.

In this manner each line of data will be addressed, read and shifted to the TRANSMITTER. After the 144th line has been outputted the Vertical Control Logic 424 will generate the MBOT signal. MBOT ANDed at gate 430 with MHSYNC will produce $\overline{WCO}$. $\overline{WCO}$ will set $\overline{BATTN}$ which will inform the PDP 11 that a frame has been transmitted.

VIDEO/DISPLAY INTERFACE CIRCUIT OPERATION

Figure 14A:
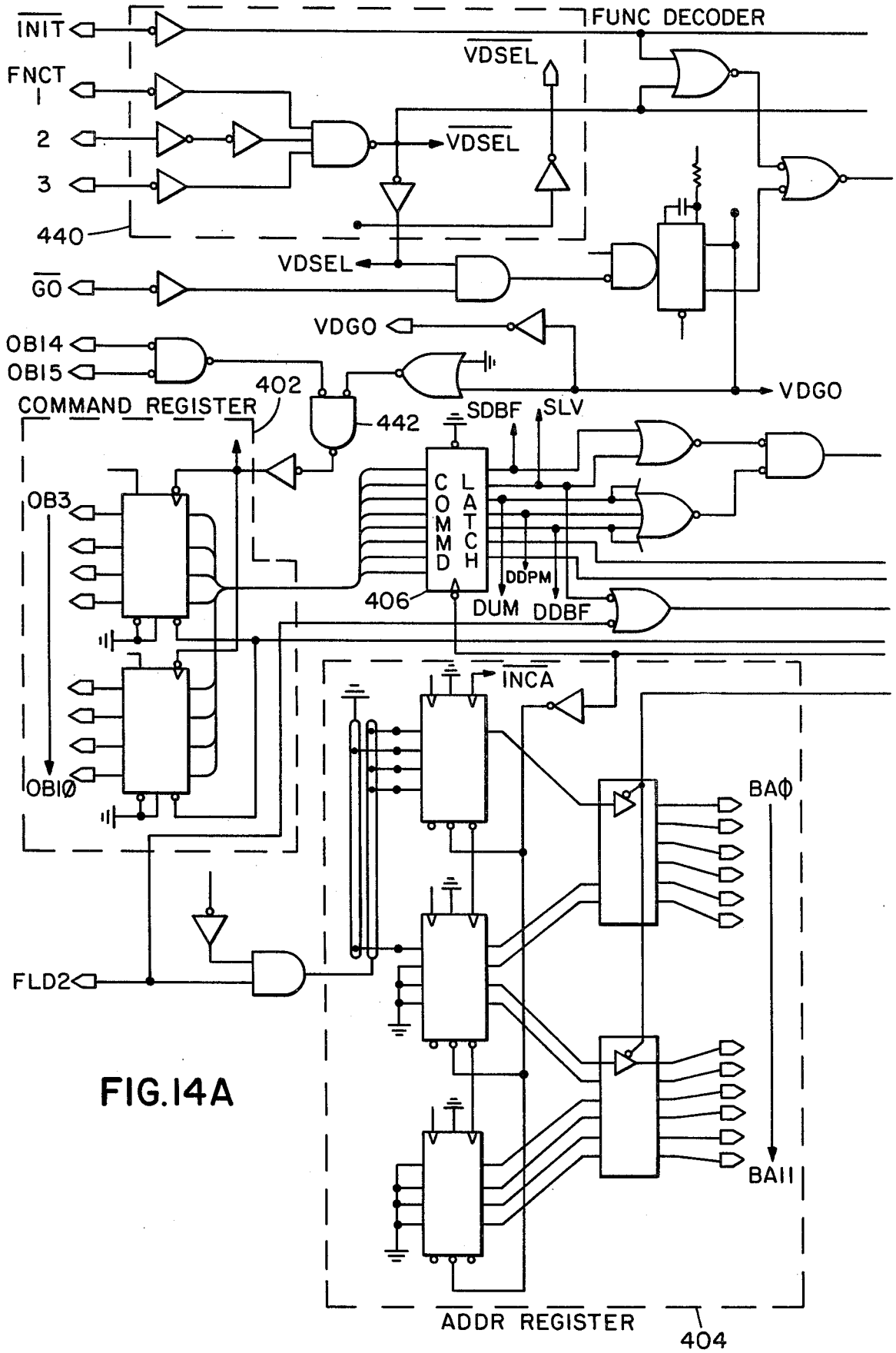
FIGS. 14A & 14B are schematic diagrams of a portion of the V/D interface.
Figure 14B:
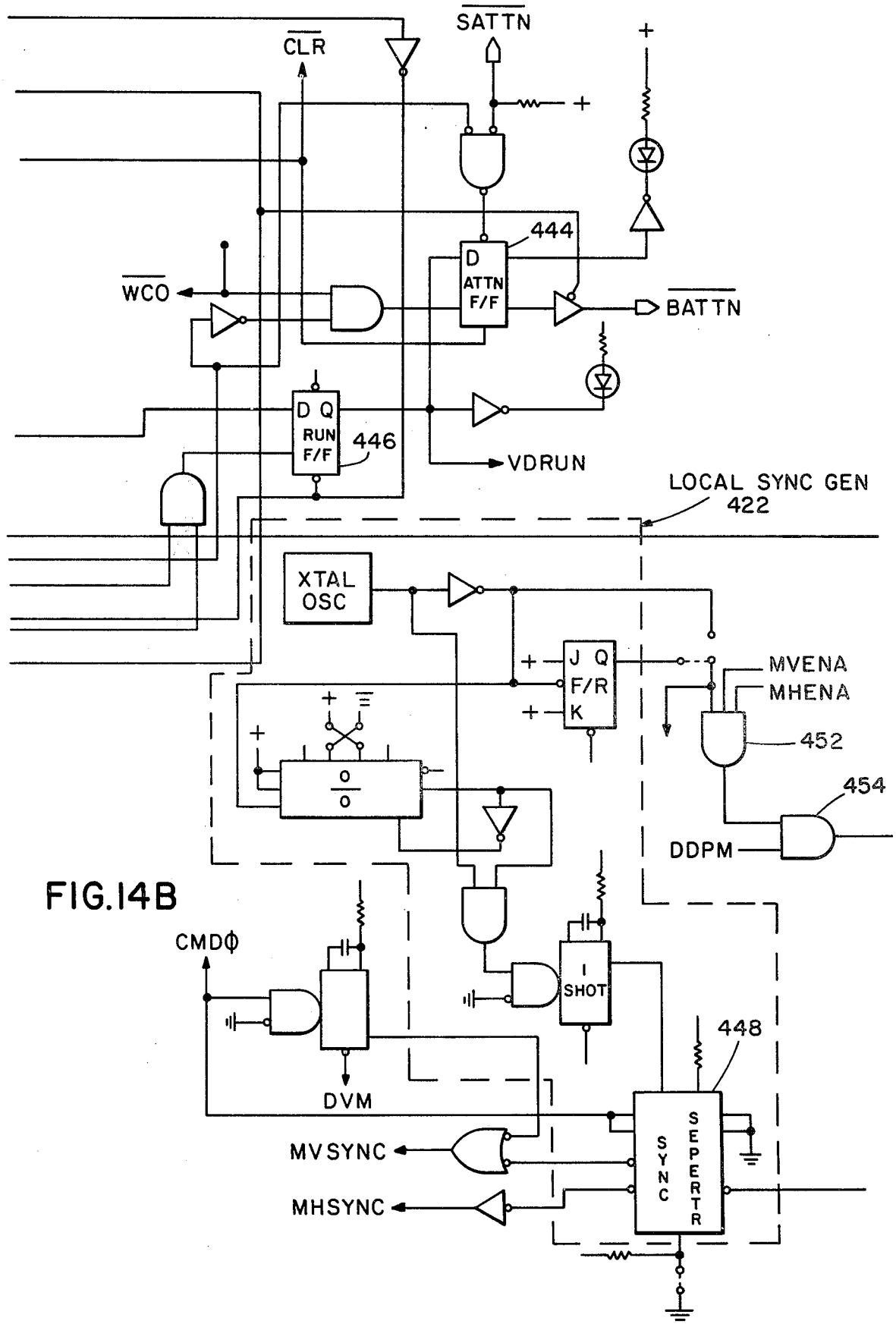
Figure 14C:
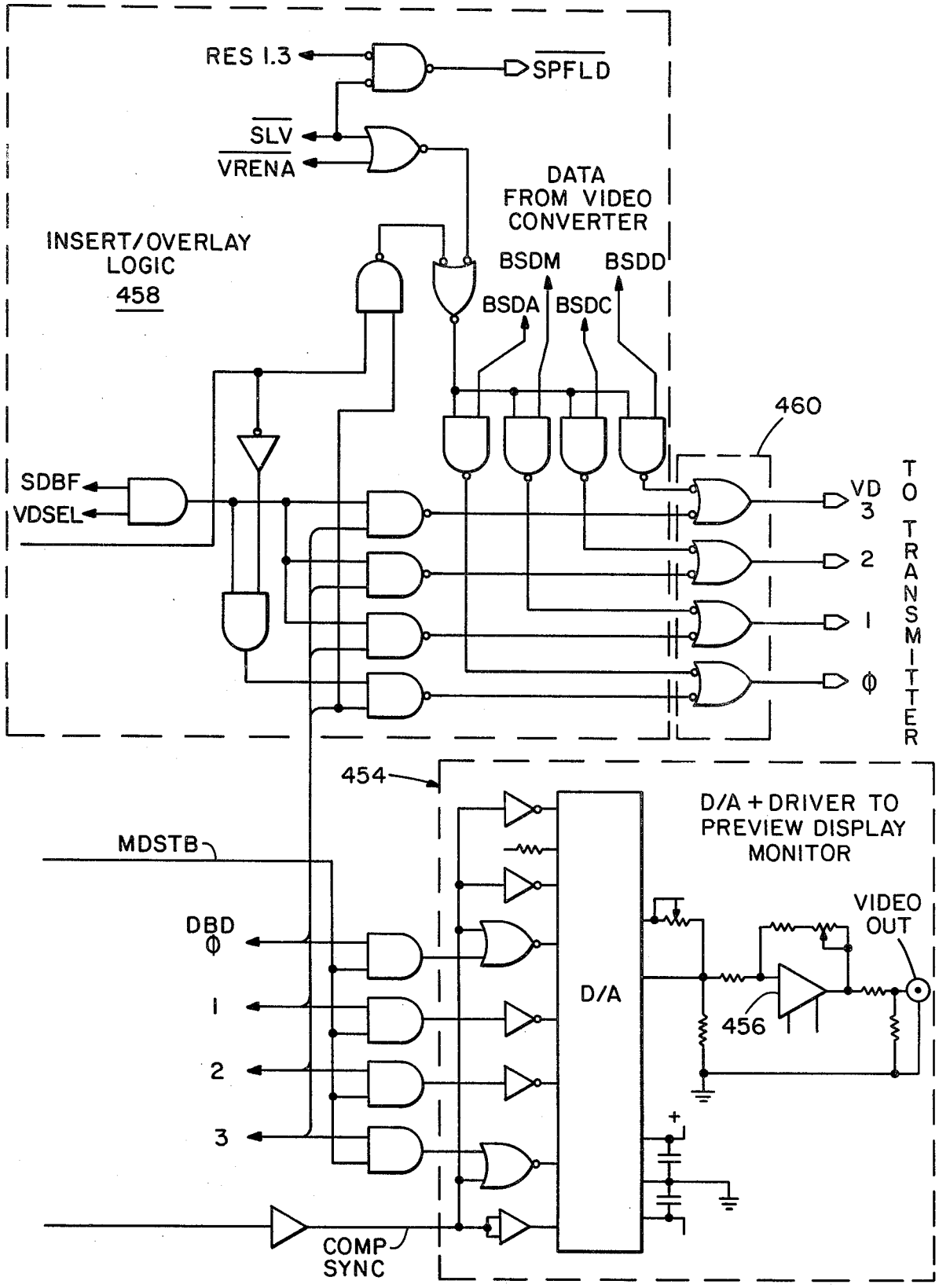

Referring to FIGS. 14A-C, the upper left hand corner of FIG. 14A contains the Function Decoder 440 and V/D Control Logic. OB14 and OB15 are ANDed at gate 442 with VDGO to decode the type of command (CMD$\phi$). This will, in turn, load the command from OB3 to OB1$\phi$ into the Command Register 402. $\overline{VDGO}$ is also sent to the VIDEO CONVERTER microprocessor to generate an interrupt at RST 7.5. Some commands may be issued which only affect the VIDEO CONVERTER. When this is the case the V/D converter will acknowledge receipt of the command by sending back the $\overline{SATTN}$ signal. If EA (enable attention) is low $\overline{SATTN}$ will set the attention F/F 444, sending the $\overline{BATTN}$ signal back to the PDP 11. Thus, it can be seen that setting EA enables the ATTN F/F to be set only by the $\overline{WCO}$ signal.

The data in the Command Register 402 is transferred to the Command Latch 406 at the beginning of each frame by the SFRM pulse. Thus, the decoding and executing of commands is a continuous process and is interrupted only if a sync source is not present. The output of the Command Latch will enable the Run F/F 446 if at least one source and one destination command bit are set.

The Local Sync Generator 422 is shown in FIG. 14B. It employs a commercially available video sync generator 448. A crystal oscillator 450 is the source of the VCLK signal. Its output is divided and shaped to provide the 2.5830 MHZ clock needed by the sync generator to produce the required 525 line NTSC outputs. These outputs are MVSYNC, MHSYNC and COMPSYNC. The generator also has two reset inputs (VR & HR). A high applied to these inputs will cause the output of the device to be reset to the start of Field 1. In this way a command to transmit can be executed without waiting for the sync generator to come around to the start of a frame. CMD$\phi$ implements the reset operation for all type $\phi$ commands.

VCLK is used to generate the dots on the Display/-Preview monitor when DDPM is set. Gates 452 and 454 AND's VCLK with MVENA, MHENA and DDPM to yield MDSTB. MDSTB will strobe the data from the I/O Data Registers to the D to A converter 454. The COMPSYNC will be added in to produce an output from the D to A that may drive a video monitor. Amplifier 456 is used to invert and adjust the output level of the D to A to 1 bolt P-P into a 75 ohm load.

The insert/overlay gates 458 come into play if both source codes SDBF and SLV are selected. An image from the DISPLAY BUFFER (DBD$\phi$-DBD3) will be combined with an image coming from the VIDEO CONVERTER (BSDA-BSDD). The resulting image will be sent to the TRANSMITTER as VD$\phi$ through VD3 by gates 460. If the IN/OV command bit is low, the data from the DISPLAY BUFFER will be ORed by gates 81 with the data from the VIDEO CONVERTER. Thus, a white on black message of text, generated by the computer and stored in the DISPLAY BUFFER, can appear to overlay a video image coming from the converter.

Figure 15A:
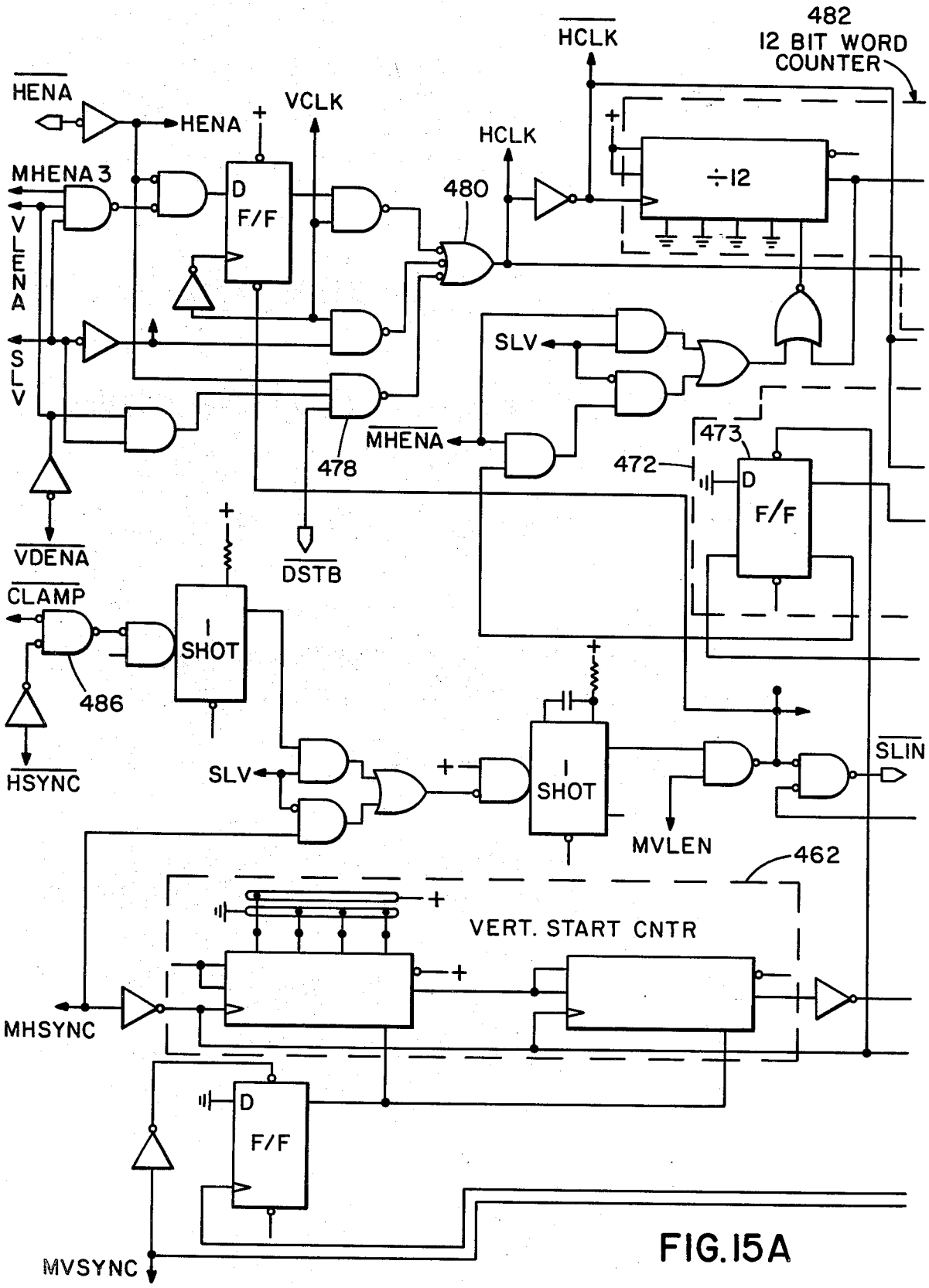
FIGS. 15A–15C schematic diagrams of a portion of the V/D interface.
Figure 15B:
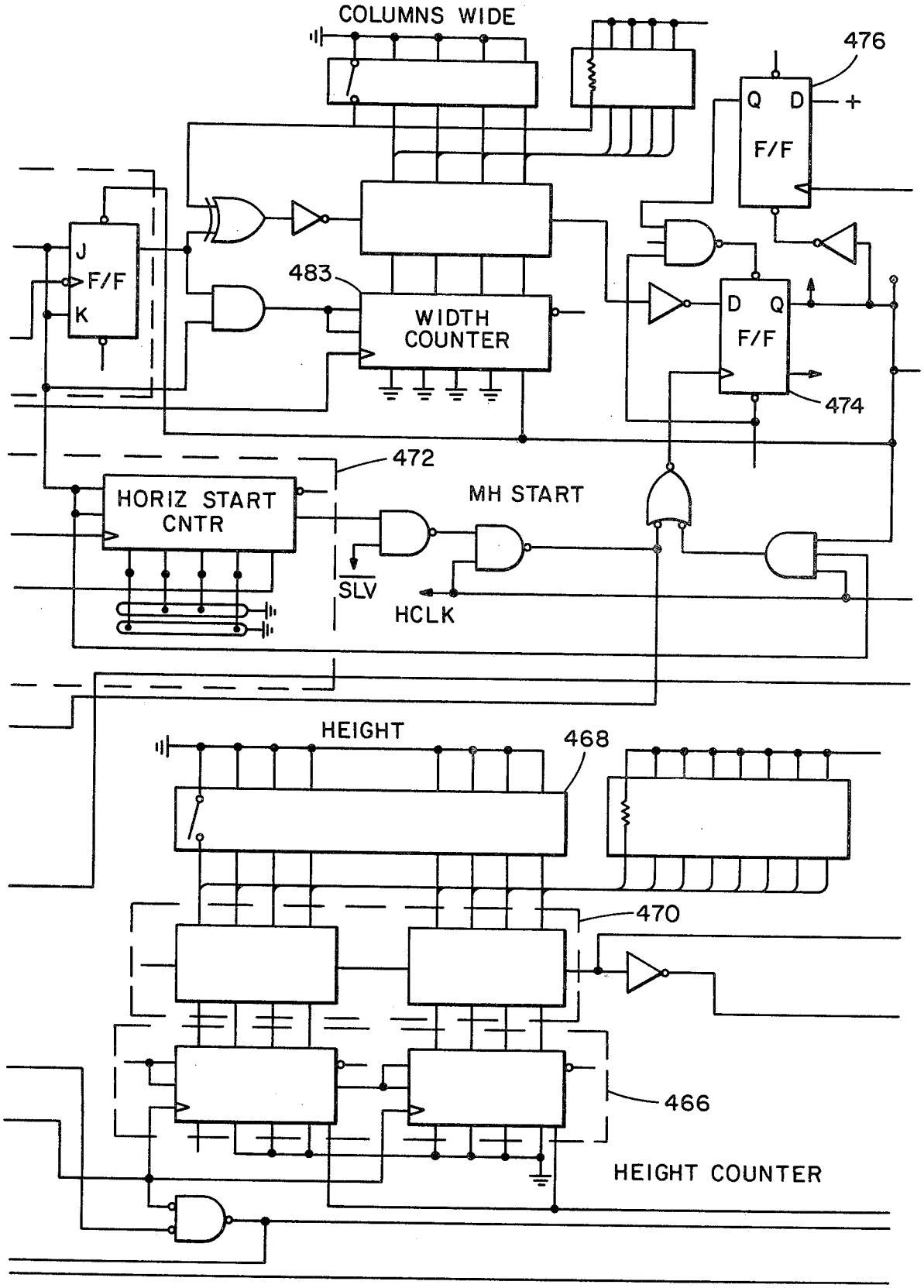
Figure 15C:
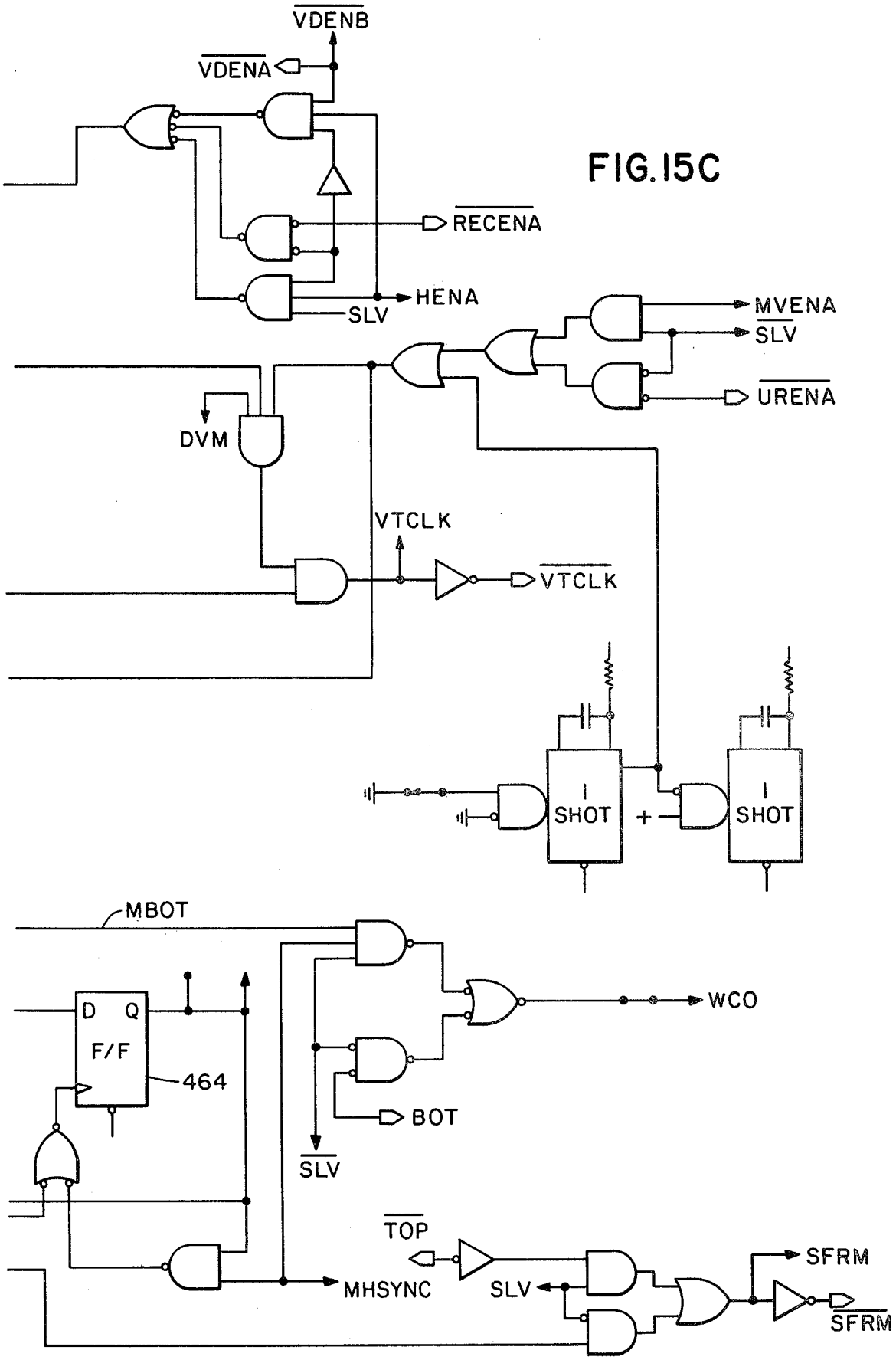

The Vertical Control Logic 424 is shown in FIG. 15. It will be recalled that this circuit operates only when the local sync is being used, i.e., SLV is low. MVSYNC will release the Vertical Start counter 462 to count the MHSYNC pulses. When this counter's carry output goes high, the next MHSYNC pulse will be allowed to set the MVENA F/F 464. MVENA envelopes all the horizontal lines of data which are to be processed. MVENA will enable the Height Counter 466 to count 144 lines of MHSYNC's. The value 143 is stored in the binary switch 468 and compared against the counter's outputs by comparator 470. When the values match the MBOT signal is generated. MBOT causes the MVENA F/F 464 to clear and allows the next MHSYNC to generate the $\overline{WCO}$ pulse.

The Horizontal Start Counter 472 is also used when the SLV signal is low. This circuit locates the starting position of the image horizontally. The MHSYNC of each line enables the counter by presetting the F/F 473. When the counter's carry output goes high, the MHENA F/F 474 will be set by the next HCLK.

When the SLV signal is high the operations described in the two preceding paragraphs are performed by outputs from the VIDEO CONVERTER. Recognize that the converter is equipped with a Joystick. This means that the vertical and horizontal window signals ($\overline{TOP}$, $\overline{VENA}$, $\overline{VRENA}$, $\overline{VDENA}$, $\overline{HENA}$ and $\overline{BOT}$) will occur at different times within a frame, depending on the position of the Joystick selected by the video operator. With this in mind, we will next examine the Horizontal Control Logic for the case when SLV is high.

The Horizontal Control Logic appears on the top portion of FIG. 15. HENA will cause the MHENA F/F 474 to be set via a NAND and F/F 476. $\overline{VDENA}$ and $\overline{HENA}$ ANDed with $\overline{DSTB}$ at IC-41 gate 478 will generate HCLK at gate 480. The length of the horizontal line will be counted out by counters 482 and 483. When 192 HLCKs have occurred the MHENA F/F 474 will be cleared.

The method for setting the MHENA F/F is modified by the circuits in the upper right hand corner if the $\overline{SPLIT\ 1.3}$ signal goes low. The special circumstances resulting when $\overline{RES1.3}$ is selected will be treated later in this specification.

At the extreme left portion of FIG. 15 $\overline{HSYNC}$ is combined with $\overline{CLAMP}$ at gate 486. A similar arrangement is provided in FIG. 16 at the lower right hand corner (gate 488). The FIG. 15 circuit isolates the second clamp pulse which occurs just following HSYNC's trailing edge. The FIG. 16 circuit isolates the first clamp pulse, which occurs just after the HSYNC's leading edge. The FIG. 15 circuit contributes to the generation of the $\overline{SLIN}$ signal needed by the TRANSMITTER. The action of MVLENA (in the local mode) and VRENA (in the SLV mode) produces $\overline{SLIN}$ pulses which precede only those lines of data that will be transmitted to the video matrix.

Figure 16A:
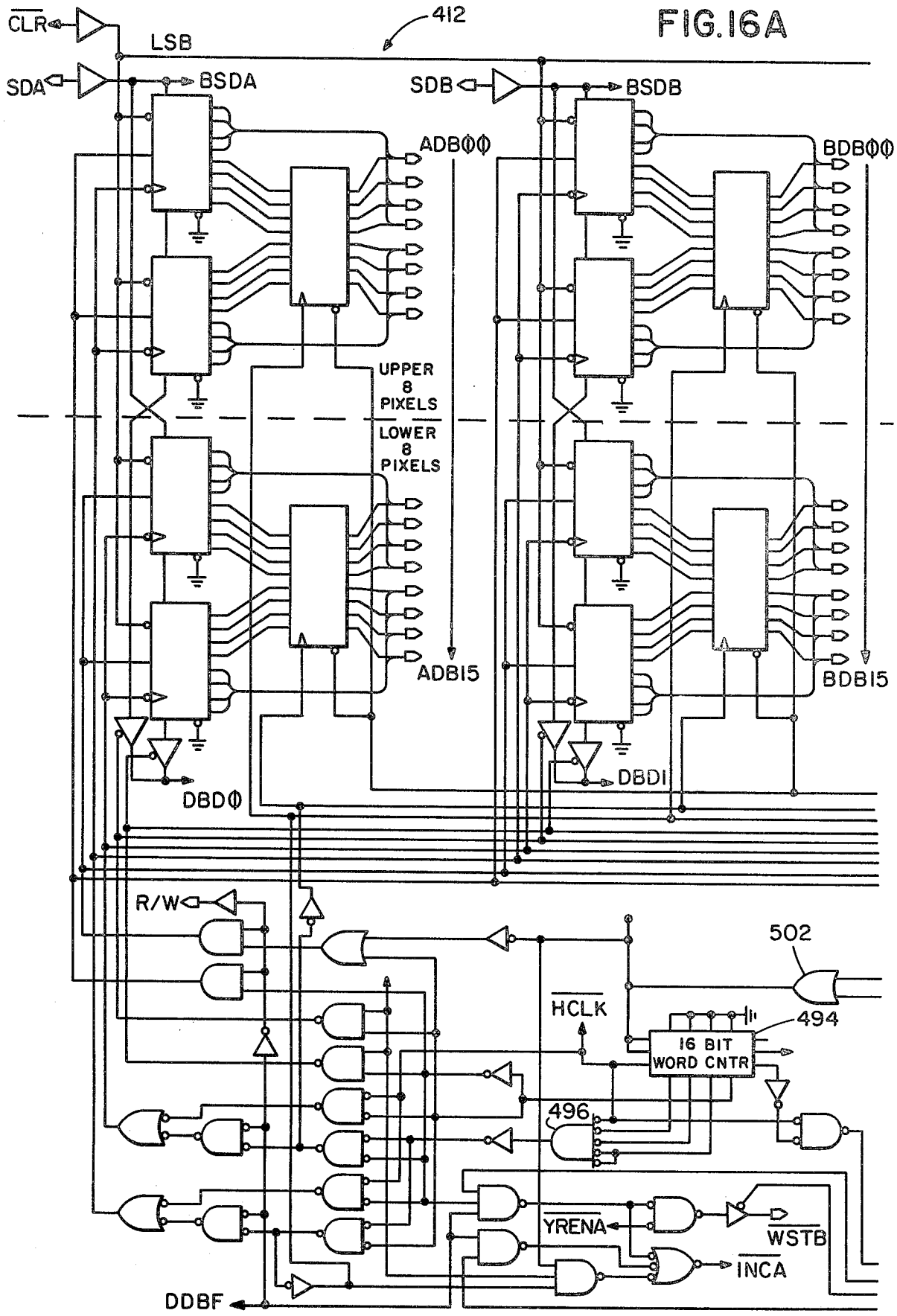
FIGS. 16A & 16B are schematic diagrams of a portion of the V/D interace.
Figure 16B:
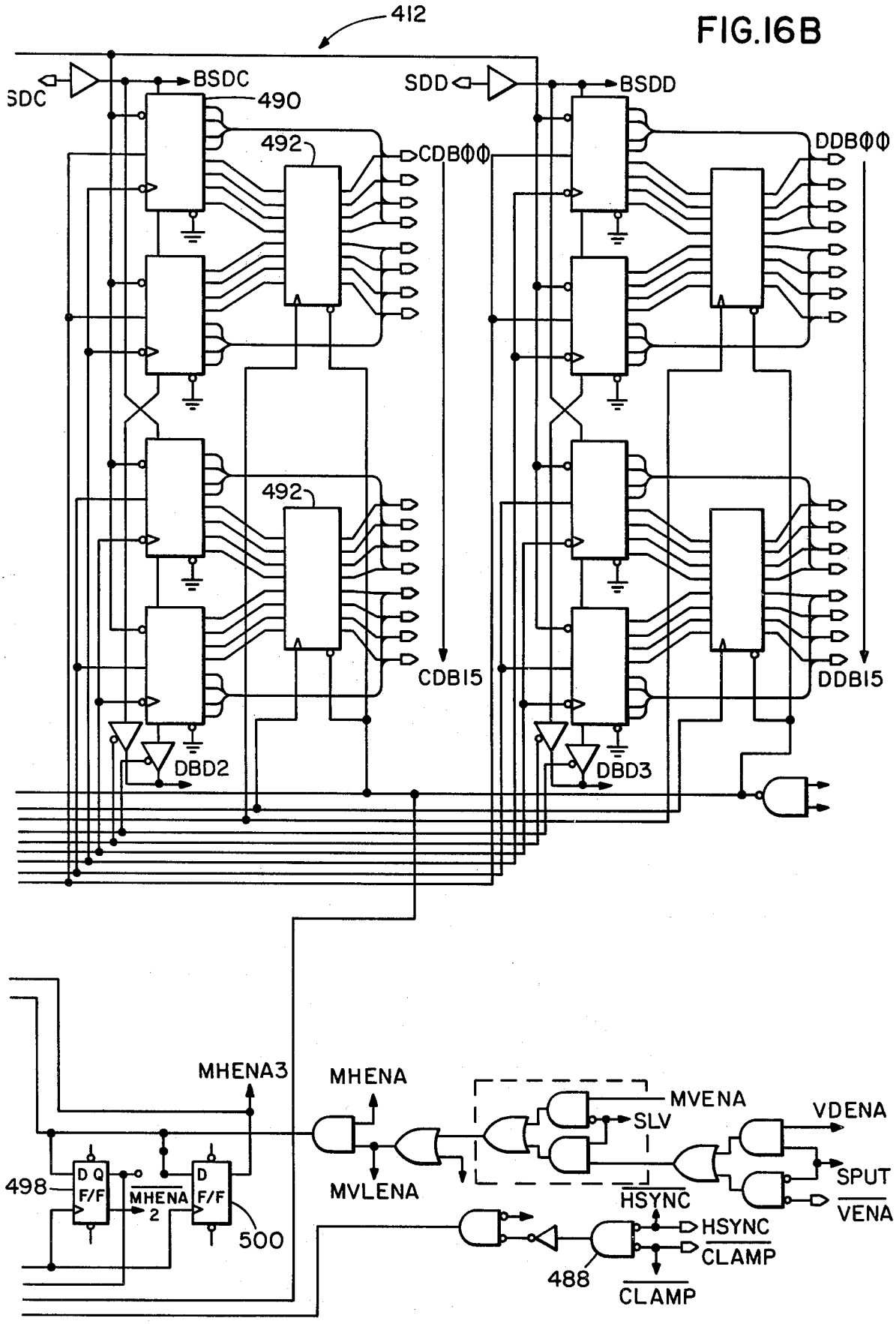

In FIG. 16 the separated clamp pulse is used to provide the extra $\overline{\text{INCA}}$ pulse needed to step the Address Register 404 past the scratch column (when operating with the DDBF bit set). This circuit is not used unless DDBF is set. FIG. 16 shows the circuits of the I/O Control Logic 410 and Data Register 412.

The circuits of the I/O Data Register occupy the upper half of FIG. 16. The I/O Control Logic 412 is shown on the bottom of the Figure. Both of these circuits are reasonably straight forward. The I/O Data Register can be split horizontally in half to show the division of operation between the upper and lower 8 pixels. Serial data received from the VIDEO CONVERTER (SDA-SDD) can be shifted into the registers 490 from the top; transferred to the latches 492; and then written into the DISPLAY BUFFER via the DB (data bus). In the reverse operation data obtained from the DISPLAY BUFFER via the DB may be latched directly into the registers and then shifted out to the TRANSMITTER or DISPLAY/PREVIEW monitor (DBDϕ-DBD3).

Movement of data through the I/O Data Register 412 is accomplished by the I/O Control Logic 410. In addition, the I/O Control Logic will generate $\overline{\text{INCA}}$, R/W and $\overline{\text{WSTBE}}$. HCLK, MHENA, MVLENA, $\overline{\text{VRENA}}$ are the I/O Control Logic's primary inputs, with DDBF and SDBF needed to determine flow directions. VRENA is used to identify only the video lines which are to be written into the DISPLAY BUFFER. MHENA and MVLENA will allow the control logic to move data independent of its source or destination. HCLK will be directed to either the upper or lower half of the I/O Data Registers by the MSB output of the 16 bit counter 494. Gate 496 acts as a decoder and will output a pulse each time the counter value is zero or eight. The zero and eighth pulses are used to alternately load the upper and lower latches 492 in the DDBF mode, or the upper and lower shift registers 490 in the SDBF condition.

The output of F/F 498 (MHENA2) will inhibit the $\overline{\text{WSTBE}}$ until after the first 16 pixels of each line are transferred to the latches. It will also remain at 16 HCLK's after the 192nd count to allow the last 16 pixels of the line to be written. The F/F 500 produces the MHENA3 output. This signal enables VCLK to produce the necessary HCLK's which, in turn, provide the extra 16 clocks needed for the last write cycle of a line. It also substitutes for the now low MHENA via OR gate 502, allowing the 16 bit counter to continue counting and to generate the final $\overline{\text{WSTBE}}$ of the line.

VII. TRANSMITTER

The TRANSMITTER receives the output of the V/D INTERFACE and ϕ (phase) GENERATOR, formats and splits it into a left and right half, and then transmits the pixel address and lamp brightness information to the display board at a 3 MHz per pixel rate.

The TRANSMITTER operates as both a master and slave device. It masters the ASYNC (address sync), WCLK (write clock), and ϕM (multiplexed ϕ pulses). These outputs are generated as soon as power is applied. When pixel data is not being transmitted, the TRANSMITTER is in the idle state. The idle state maintains a steady flow of lamp brightness data, ϕ pulses, in the form of ϕM, to the display logic. The ϕ pulses are derived from the ϕ GEN, to be described.

In the slave mode the TRANSMITTER responds to the output of the V/D INTERFACE. When the V/D INTERFACE has an image to output to the display board, its output circuits generate the necessary timing and data in a video format. The TRANSMITTER responds by collecting the data and transmitting it to the matrix board. When the TRANSMITTER begins to transmit pixel (or lamp data, LD) information it leaves the idle state and enters the transmit state. The operation of the TRANSMITTER can be best understood from a study of the purpose of its output signals.

TRANSMITTER OUTPUT

The output of the TRANSMITTER is arranged in esentially a video format. Thus it sends data in a horizontal line-at-a-time fashion. In this specification the terms "line" and "row" will be used interchangeably. Line will most often be used to refer to the transmission of data. Row will usually be used when we are speaking of "rows of lamps". Three additional terms, LEV, MEM and LINE, will also be used in the description. These make up the three parts of the address which precedes each line of transmission.

Due to design limitations the output of data from the TRANSMITTER is set at 3 MHz per pixel. The data received from the V/D INTERFACE may arrive at either 6.14 MHz in the x2 mode, or 4.09 MHz in the x1.3 mode. The data arriving in the x2 mode has a line-to-line period of 63.5 usec. Since the transmitter's output operating at 3 MHz would take more than 68 usec to process this line of data, it becomes necessary to divide each line into two halves. Thus the TRANSMITTER will have two independent sets of output signals, one to drive the left side of the matrix and one to drive the right.

Each output signal set will contain seven signal types. They are:

ASYNC—address sync; a 333 ns pulse which indicates that the next 12 LD3 data bits are to be interpreted as an address.

WCLK—write clock; a 3 MHz clock which occurs in bursts between ASYNC's. In the idle state 12 WCLK's make up a burst. In the transmit state the left output circuits generate a burst of 120 WCLK's while the rights' burst contains 96 WCLK's. The front edge of each WCLK pulse is used to sample the contents of the four LD signals, and the ϕM line. WLCK bursts always occur in multiples of 12.

LDϕ through LD3—lamp data; contains the four bits of pixel data during the transmission of each line of data. LD3 will contain the line address which begins each line of transmission. In the idle state all the LD lines will contain zeros.

ϕM—multiplexed ϕ pulses; contains the six ϕ pulses obtained from the ϕ GEN, as well as the locally generated ERA (erase) signal, time multiplexed under the last seven WCLK's of each multiple of 12 WCLK's. ASYNC indicates the beginning of a 12 WCLK cycle, but during a transmission, a local divide-by-12 will recycle the ϕM data. Thus ϕM data is continuously outputed, both during the idle and transmit states.

Figure 17:
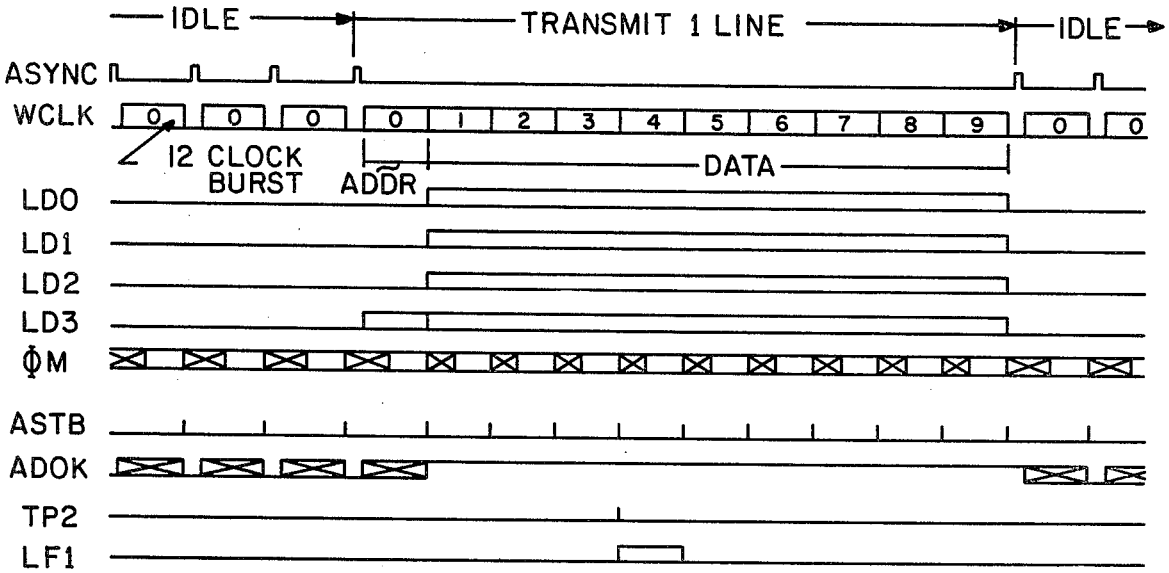
FIG. 17 is a timing diagram useful in explaining the operation of the V/D interface.

The top of timing diagram, FIG. 17, shows the relationship between the ASYNC, WCLK, LD and ϕM signals during both the idle and transmit states. The numbers written into each group of 12 WCLK's indicate the COL's of lamps within which the data belongs. Recall that the term COL refers to a positional address across each line of transmission. Its address is inferred by the matrix board logic by simply dividing a line of WCLK's by 12 and incrementing a counter. Each display board CONTROL CABINET will be coded to look for its particular COL. The transmission shown in FIG. 17 contains COL's 1 through 9 which would correspond to 108 lamps, which would mean a transmission to the left side of the matrix board. A COL designation of zero indicates a period of 12 WCLK's during which time an address is transmitted on the LD3 line. Notice the zero occurs after each ASYNC pulse.

To convert FIG. 17 into a transmission to the right side of the matrix you would simply delete COL's 8 and 9 and return to the idle state immediately following COL number 7.

Figure 18:
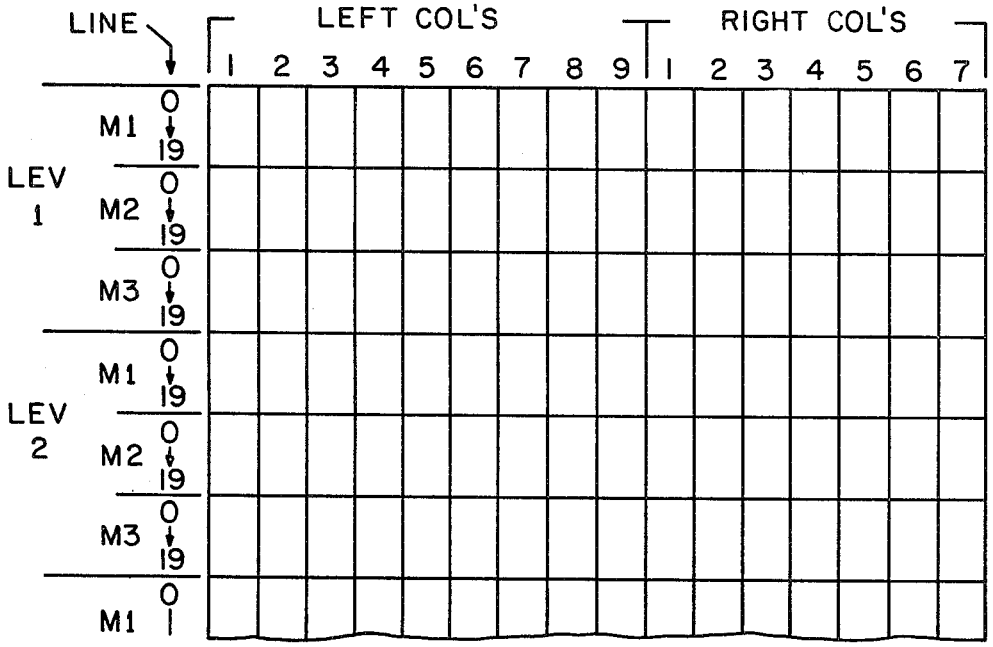
FIG. 18 illustrates the matrix board addressing scheme according to the invention.

Before sending a line of data to the matrix we must precede it with an address that will identify to the three levels of CONTROL CABINETS where it belongs. FIG. 18 shows the matrix board as it appears in terms of TRANSMITTER addresses. The three component parts that make up the address are called:

LEV—level, indicating a level of cabinets numbered from one starting at the top of the matrix. Each LEV can drive, for example, 60 rows of lamps.

MEM—memory, each LEV contains 3 MEM's numbered from the top as M1, M2 and M3. Each MEM may drive, for example, 20 rows of lamps.

LINE—line, each MEM contains 20 lines or rows of lamps numbered 0-19. To identify which row the transmission belongs to, 5 bits of the address word are identified with the LINE value.

The address is made up of 12 bits of data, and organized in the following format.

| All spare | A10 A9 A8 A7 LEV | A6 A5 MEM | A4 A3 A2 A1 A0 LINE |
|---|---|---|---|
| ϕ | ϕϕϕϕ through ϕϕ11 | ϕϕ through 11 | ϕϕϕϕϕ through 1ϕϕ11 |

This address word, combined with the COL, can locate every pixel on each half of the matrix board.

From FIG. 18 it will be clear to those skilled in the art the purpose of the addressing method and its ability to address unique groups of twelve pixel rows on both the left and right side of the matrix.

TRANSMITTER OPERATION

As stated earlier, the TRANSMITTER will receive one line of data from the V/D INTERFACE and, because of data rate limitations, divide it into two lines of output data called "left" and "right". In front of both the left and right transmission halves the TRANSMITTER will insert an address. Since each line of data has a unique address, the address stuck onto the left and right half of each line transmitted will be the same.

Figure 19:
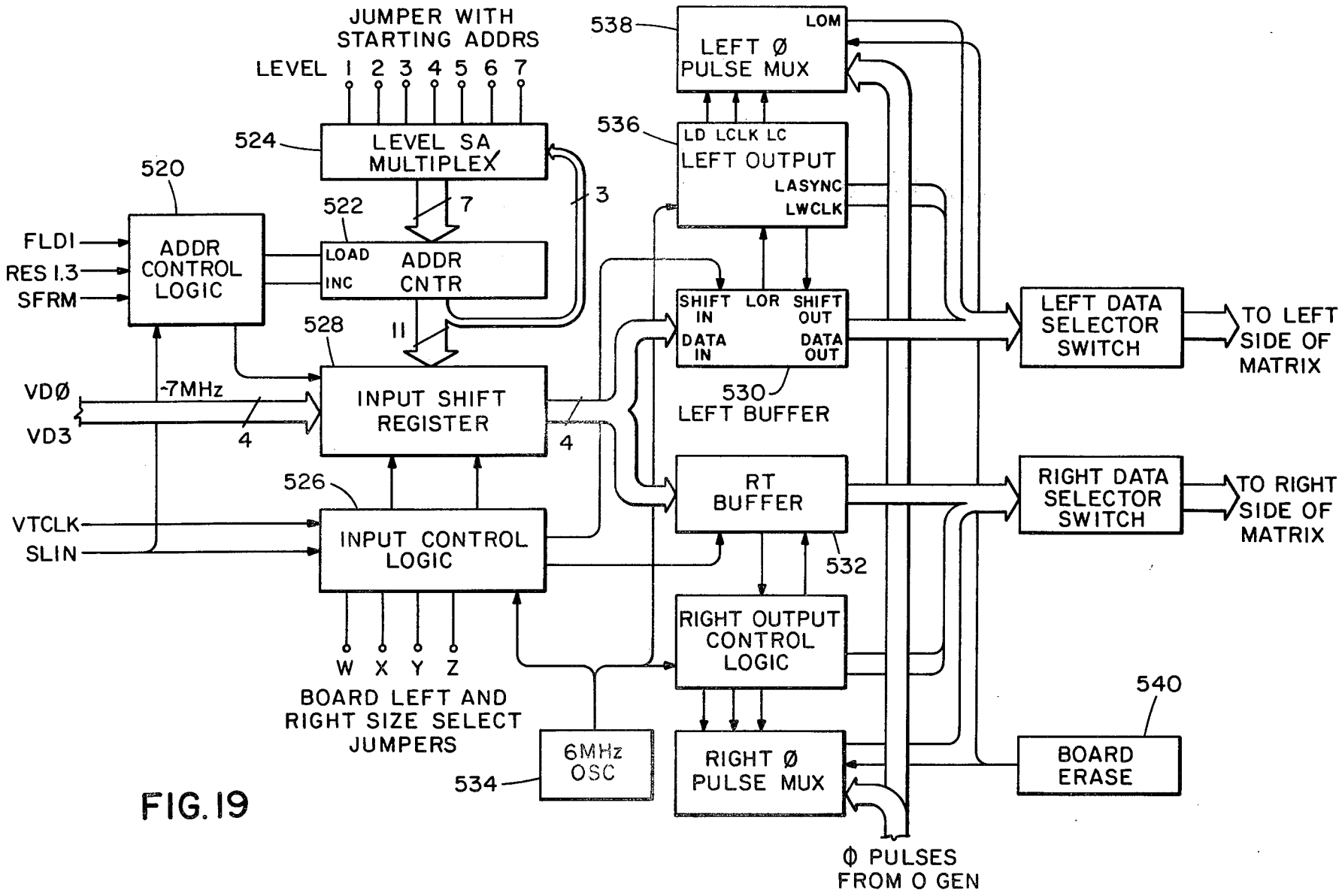
FIG. 19 is a block diagram of the transmitter according to the invention.

It will be recalled that the data received from the V/D INTERFACE is at either 6.14 MHz or at 4.09 MHz. When it departs the TRANSMITTER it is going at 3.0 MHz. To accomplish this data rate reduction, FIFO (first in, first out) shift registers are used. One is needed for each of the left and right outputs. In the TRANSMITTER's block diagram, FIG. 19, they can be seen identified as the Left and Right Buffers.

This lays the groundwork necessary to understand the input and output flow of data through the TRANSMITTER. Using the block diagram of FIG. 19, it is possible to trace the flow of data coming from the V/D INTERFACE and departing the TRANSMITTER's output. The conditions at the input will be those for a x2 image.

The $\overline{\text{SFRM}}$ (start frame) pulse arrives at the beginning of a frame and initializes the TRANSMITTER. Via the Address Control Logic 520 $\overline{\text{SFRM}}$ will set the LEV portion of the address counter 522 to ϕϕϕ1. The three LSB's of LEV will go up to the select inputs of the Level Starting Address Multiplexer 524. The data inputs to the Level Starting Address Multiplexer are the jumpered MEM and LINE starting values for each level. Selecting the LEV 0011 input will place the starting address needed for the first line of transmission into the Address Counter. $\overline{\text{SFRM}}$ goes to the $\overline{\text{MR}}$ (master reset) of the Right and Left Buffers, setting them empty.

The TRANSMITTER next receives the $\overline{\text{SLIN}}$ (start line) pulse from the V/D INTERFACE. $\overline{\text{SLIN}}$ goes to the Input Control Logic 526 and sets the input shift register 528 to the parallel load mode. $\overline{\text{SLIN}}$ causes ACLK (address clock) to be generated in the Address Control Logic. The back edge of ACLK will cause the contents of the Address Counter 522 to parallel load into the input register 528. The back edge of ACLK will also cause the Address Counter to increment, setting up the next line address to be transmitted. ACLK will also clear the parallel mode from the input shift register and allow the Input Control Logic 526 to set the shift register to the shift right mode.

The TRANSMITTER is now ready to receive the VDϕ-VD3 data from the V/D INTERFACE. VTCLK (video-transmit clock) will accompany the data and make it possible for the TRANSMITTER to shift the data into the input shift register 528. The first twelve VTCLK's will shift twelve pixels of data into the register while simultaneously shifting the previously loaded address from the address counter 522 into both the Left and Right Buffers 530 and 532.

As soon as the twelfth VTCLK has been counted by the Input Control Logic it will no longer allow the VTCLK's to shift into both buffers; it will now direct the data to only the Left Buffer 530.

The next twelve VTCLK's will shift twelve more pixels of data into the input register. As the new data comes in, the previous data flows out into the Left Buffer. As should be apparent, the Left Buffer is collecting the data which forms the first line of a transmission. It collected the address and then the lamp data.

The process continues until the Left Buffer is filled with twelve address bits and, for example, 108 pixels. The Input Control Logic has been faithfully counting the loading of the Left Buffer. When the 108th pixel is loaded, by the 120th VTCLK, the Input Control Logic will allow no more data into the Left Buffer. It will now route the VTCLK's to the Right Buffer. The Right Buffer will take the next, for example, 72 VTCLK's and load 72 additional pixels. After the 192nd VTCLK the input register will have the last twelve pixels of data still residing in it. Remember, the first twelve VTCLK's were used to load the address, so the Buffer is always lagging the data by twelve VTCLK's. The Input Control Logic will take the output of a 6 MHz xtal oscillator 534 and use it to transfer the final twelve pixels into the Right Buffer.

This completes the input transfer of one line of data from the V/D INTERFACE. Within a few short microseconds the V/D INTERFACE will be sending the TRANSMITTER the second line of data. The next line will again be preceded by the $\overline{\text{SLIN}}$ pulse. As before, the input register 528 will be loaded with the contents of the Address Counter 522, now holding the address of the second line. The next ACLK will again increment the Address Counter, this time to the address of the third line.

The VTCLK's and LD for the second line will pour in and again the Left and Right Buffers will become the depository of the address and data for the second line: And so on until 144 lines of data have been received, addressed and shifted into the Left and Right Buffers.

To keep track of the levels of FIG. 18 the Address Counter is equipped with a detector circuit which identifies the end or last line of each level. At that time the LEV bits to the Level Starting Address Multiplexer will address the next LEV and cause the subsequent ACLK to load the Address Counter with its output.

The Left and Right Buffers, in most applications, are not of sufficient length to receive an entire one. This means that the image received from the V/D INTERFACE cannot be entirely contained by the TRANSMITTER and, therefore, the outputting of data from the TRANSMITTER must begin as soon as possible to prevent the buffers from overflowing. Since the control of data from the Left and Right Buffers is vertually identical, the explanation will follow just the Left Buffer.

Data shifted into the Left Buffer 530 will quickly bubble through to its output. It will remain there until a Shift Out pulse is received to remove it. Each Shift Out will extract one pixel of data just as one Shift In loaded one pixel.

When the data loaded into the buffer appears at the output the LOR (left output ready) signal therefrom will indicate to the Left Output Control Logic 536 that a transmission can begin. Prior to receiving LOR the Output Control Logic was in the idle state, sending out ASYNC, WCLK and $\phi$M data through the Left Data Selector 538 to the left side of the matrix board. When LOR arrives the idle state will terminate with the next ASYNC pulse and the transmit state will begin. The Output Control Logic 536 will begin to empty the Buffer with each WCLK. One hundred twenty WCLK's will send the first line of pixels to the display logic on the left side of the matrix.

The Output Control Logic will send exactly 120 WCLK's after which it will generate the next ASYNC pulse. If the buffer is empty the ASYNC will cause the idle state to resume. If the next line of data is in the buffer, then the ASYNC will see the LOR set high once again. This will cause the beginning of the next transmit state to follow immediately after the previous one.

In this way the Output Control Logic will process each line of data to the matrix board. Notice that it does not care about addresses. It just passes the data along exactly as it was received.

The Left and Right $\phi$ Pulse Multiplexer 538 are identical. They each receive the six lines of $\phi$ pulse data produced by the $\phi$ GEN. A Board Erase Circuit 540 feeds the seventh piece of data to the Multiplexer. The Output Control Logic generates the timing pulses necessary to drive their respective Multiplexers. For every twelve WCLK's produced by the Output Control Logic, one multiplexing cycle of the seven data inputs will occur.

Summarizing the description of the transmitter it will be appreciated that:

The TRANSMITTER always transmits complete lines of data. If for some reason the V/D INTERFACE sends a short line, the TRANSMITTER circuits will detect the condition and fill in the remainder of the line with off lamp data. The $\overline{\text{VTCLK}}$ signal initiates the transmission. $\overline{\text{SFRM}}$ and $\overline{\text{SLIN}}$ alone will cause no output from the TRANSMITTER. Transmission may end after any line has been received. The TRANSMITTER will not fill in the balance of a short frame as it does for a short line. When an image to be transmitted is derived from the V/D INTERFACE in the x1.3 resolution, it will be coming as two frames of interlaced data. This requires the Address Control Logic to modify the way it increments the Address Counter. The FLD1 (field one) and RES1.3 (resolution x1.3) signals from the VIDEO CONVERTER will inform the Address Control Logic that a x1.3 image is coming. In response the Address Control Logic will start on either the first or second line of the display and increment by twos as each $\overline{\text{SLIN}}$ is received.

CIRCUIT OPERATION

Figure 20A:
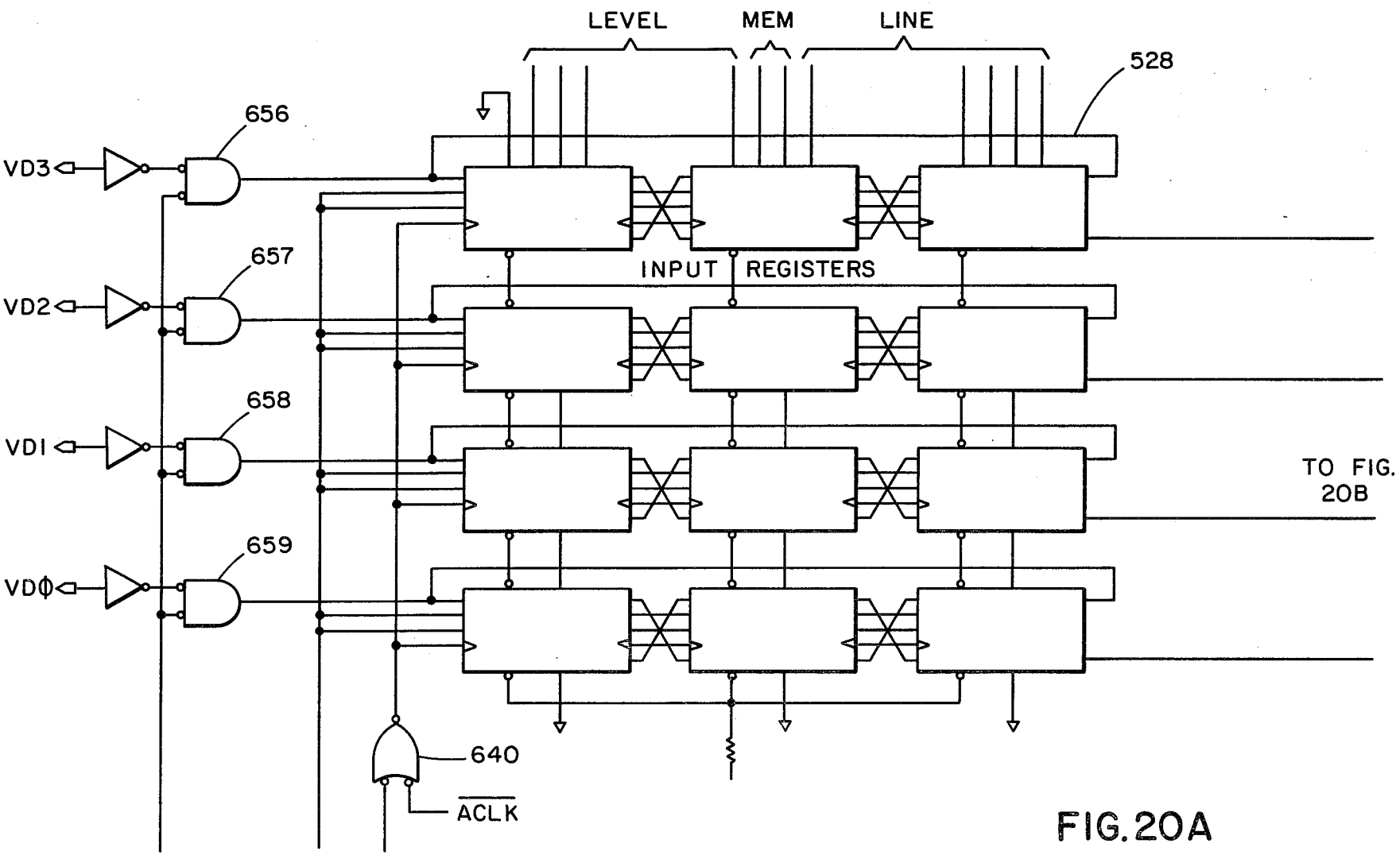
FIGS. 20A–22C are schematic diagrams of the transmitter according to the invention.
Figure 20B:
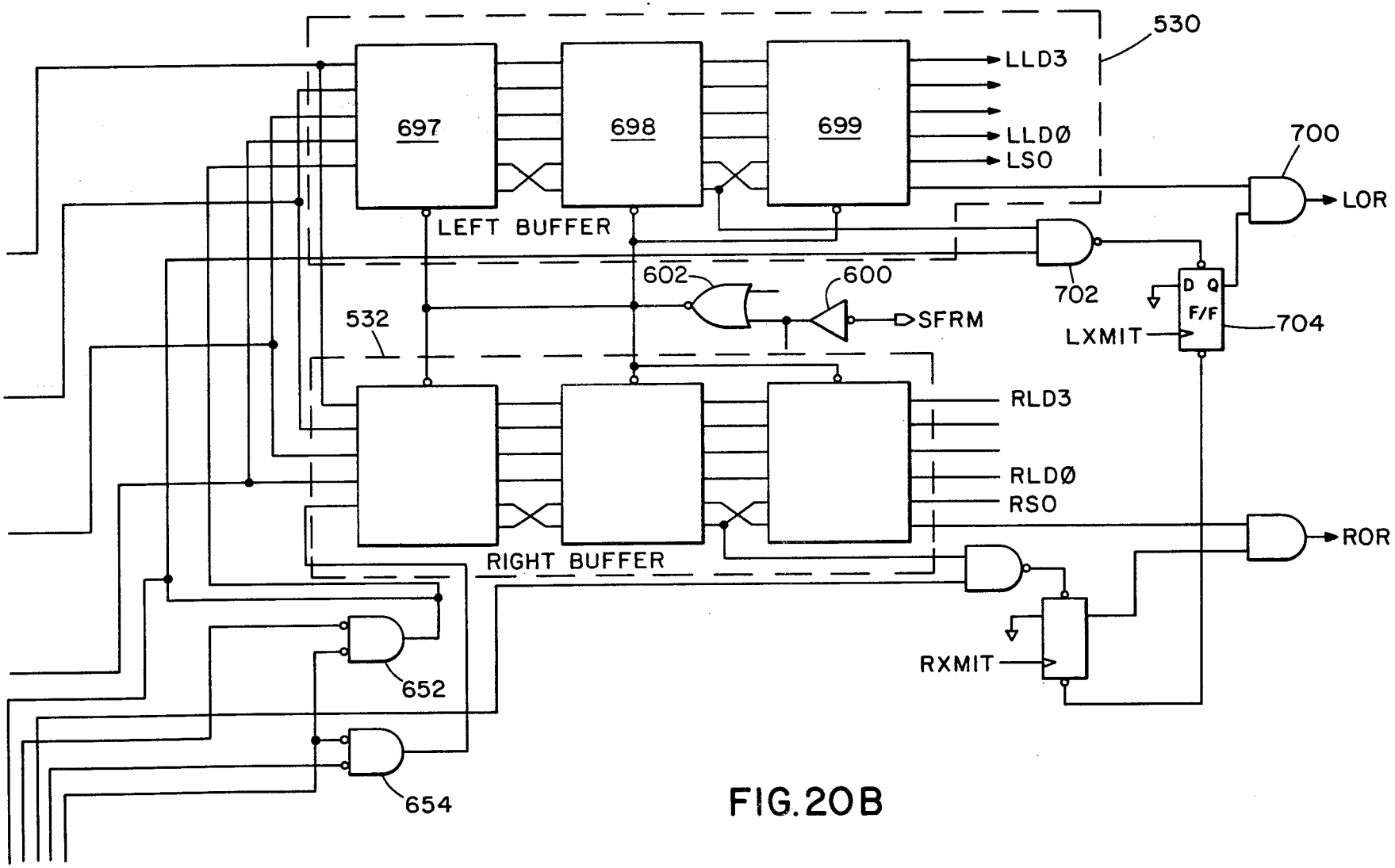
Figure 20C:
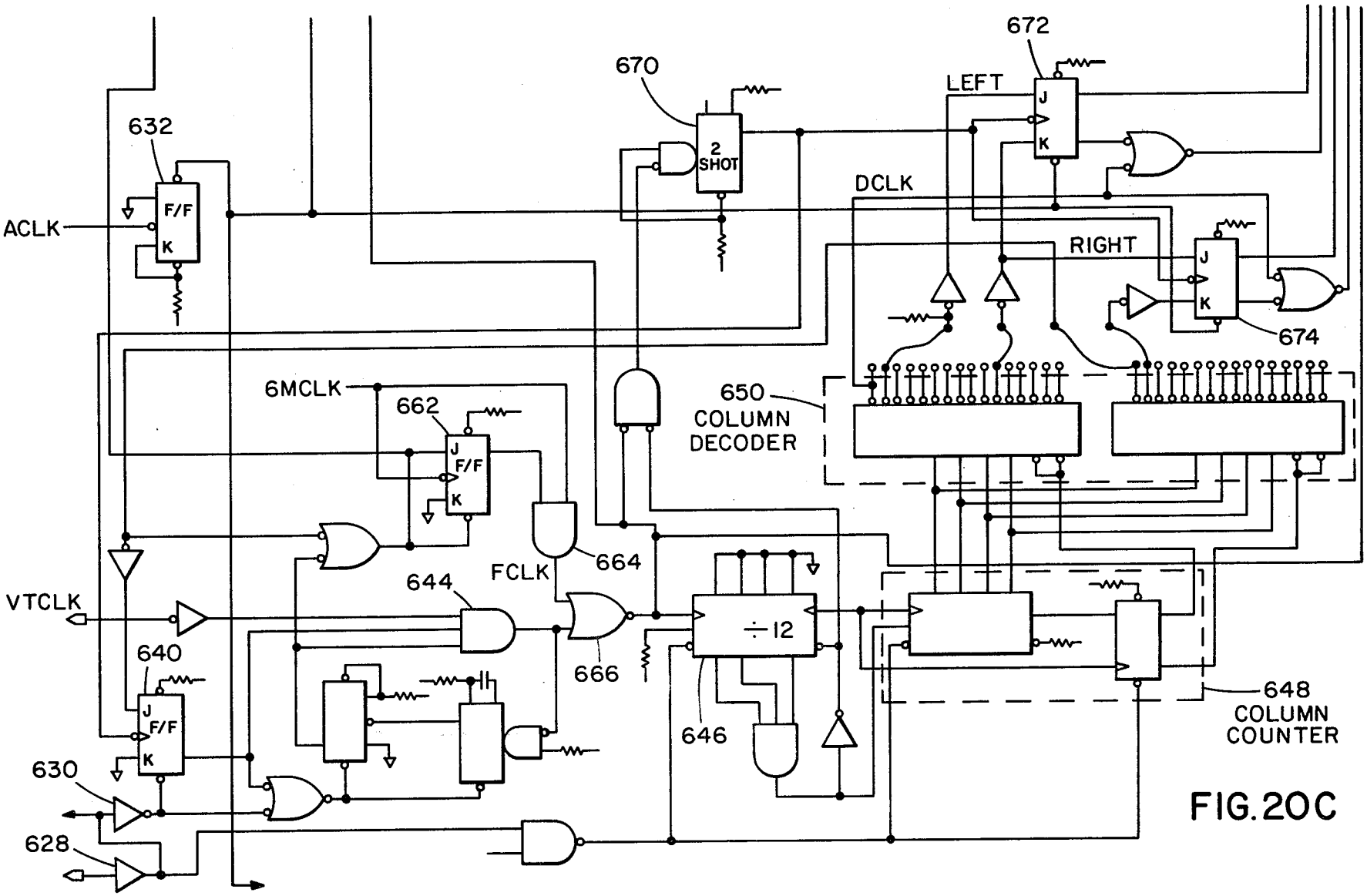
Figure 21A:
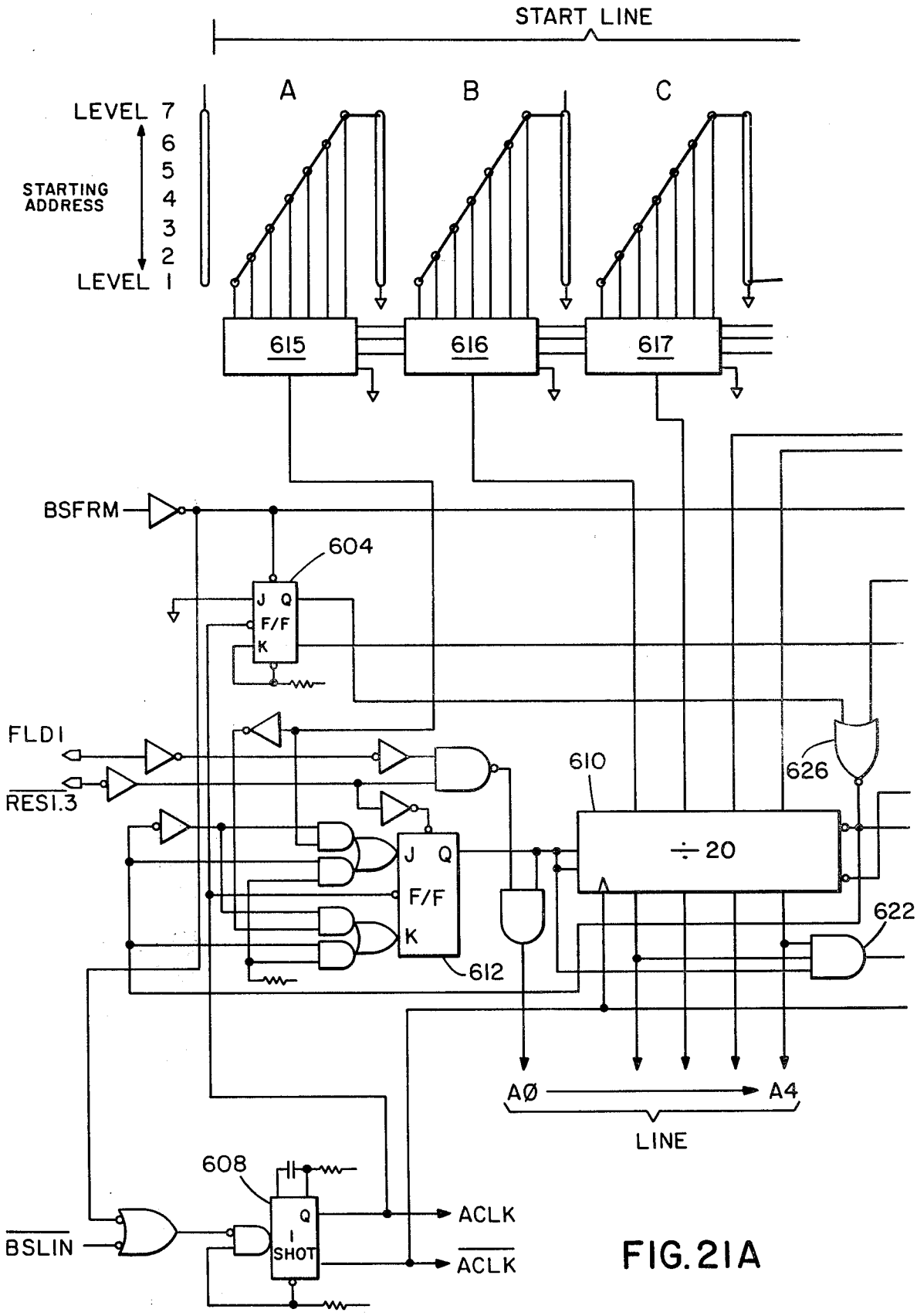
Figure 21B:
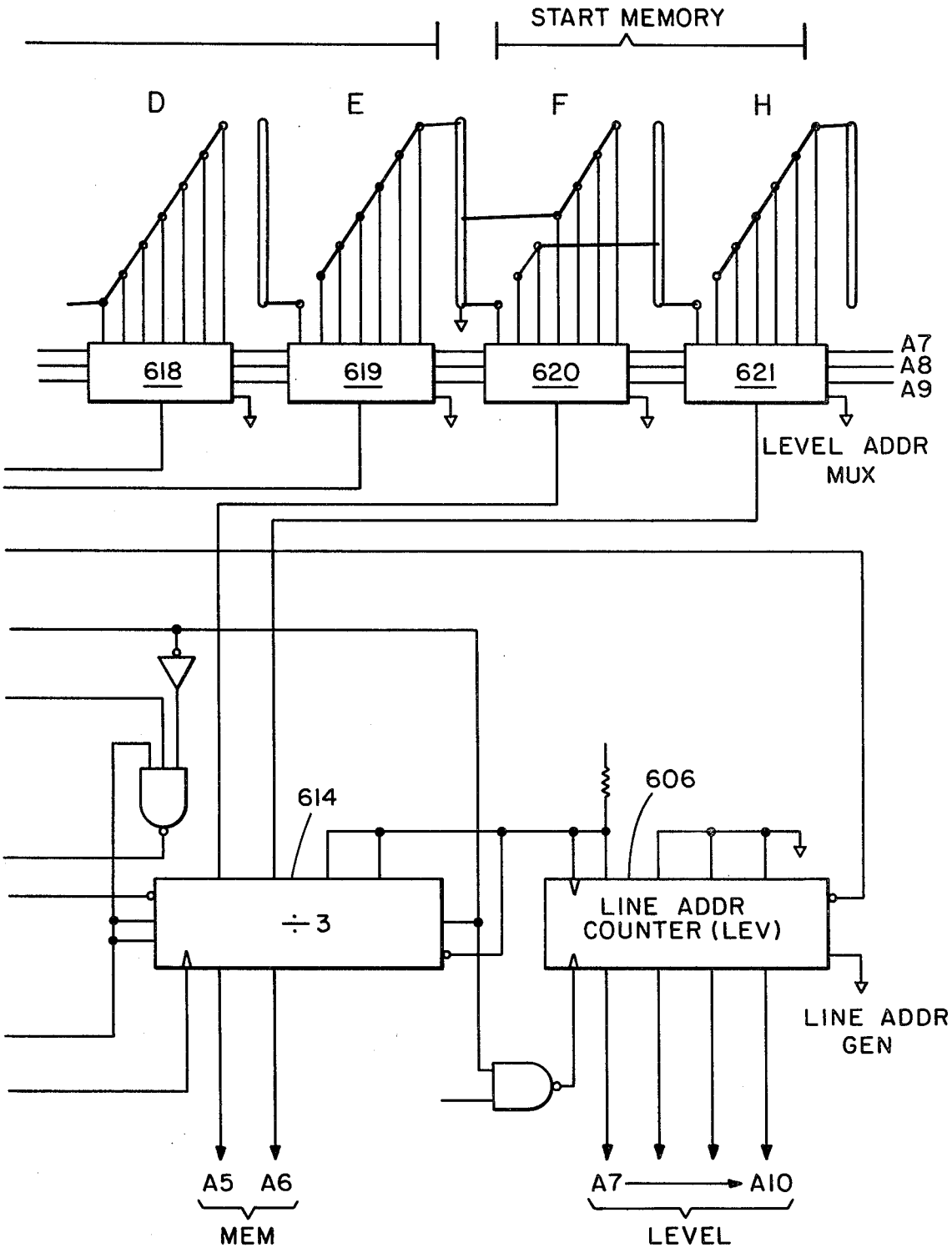
Figure 22A:
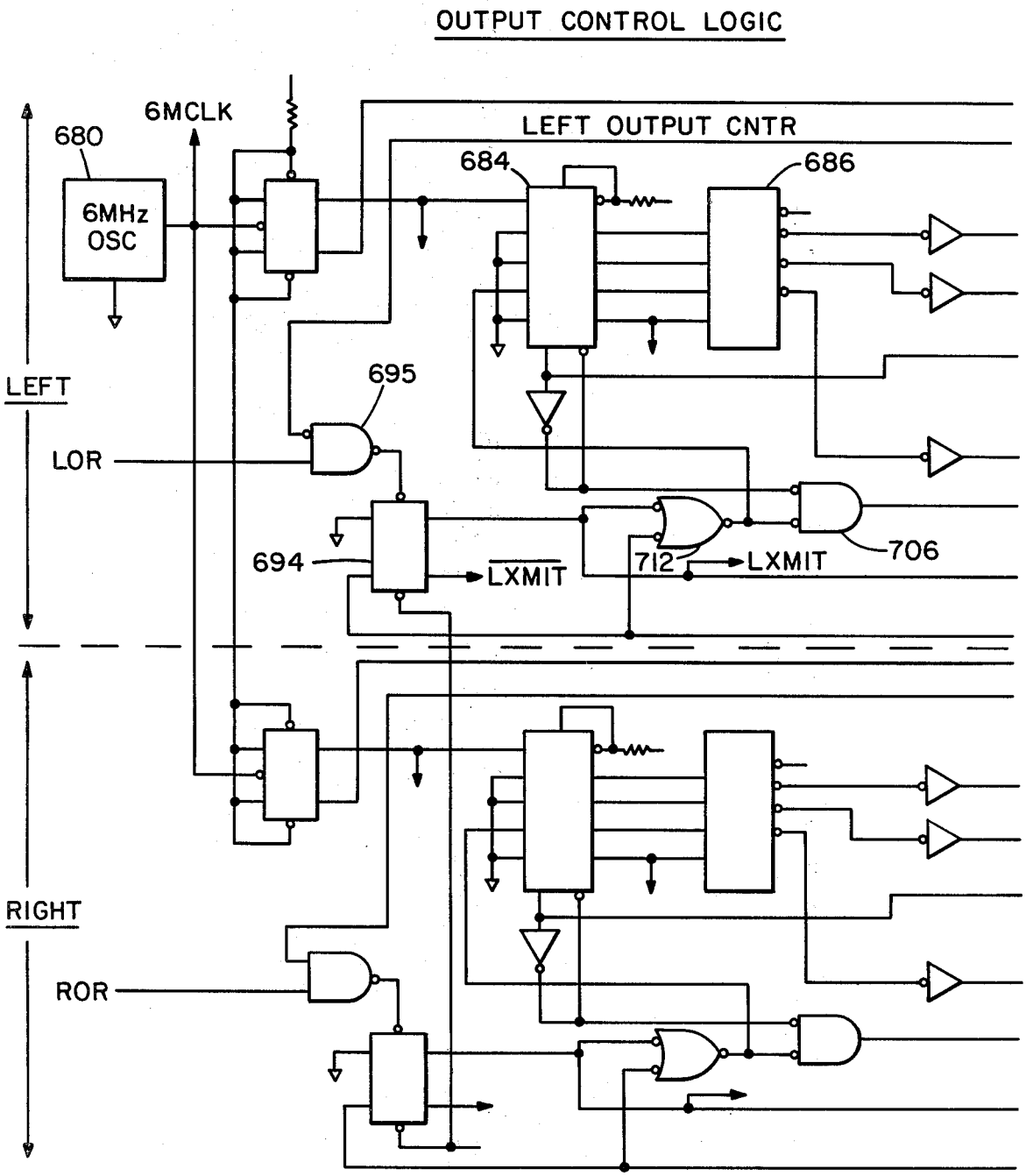
Figure 22B:
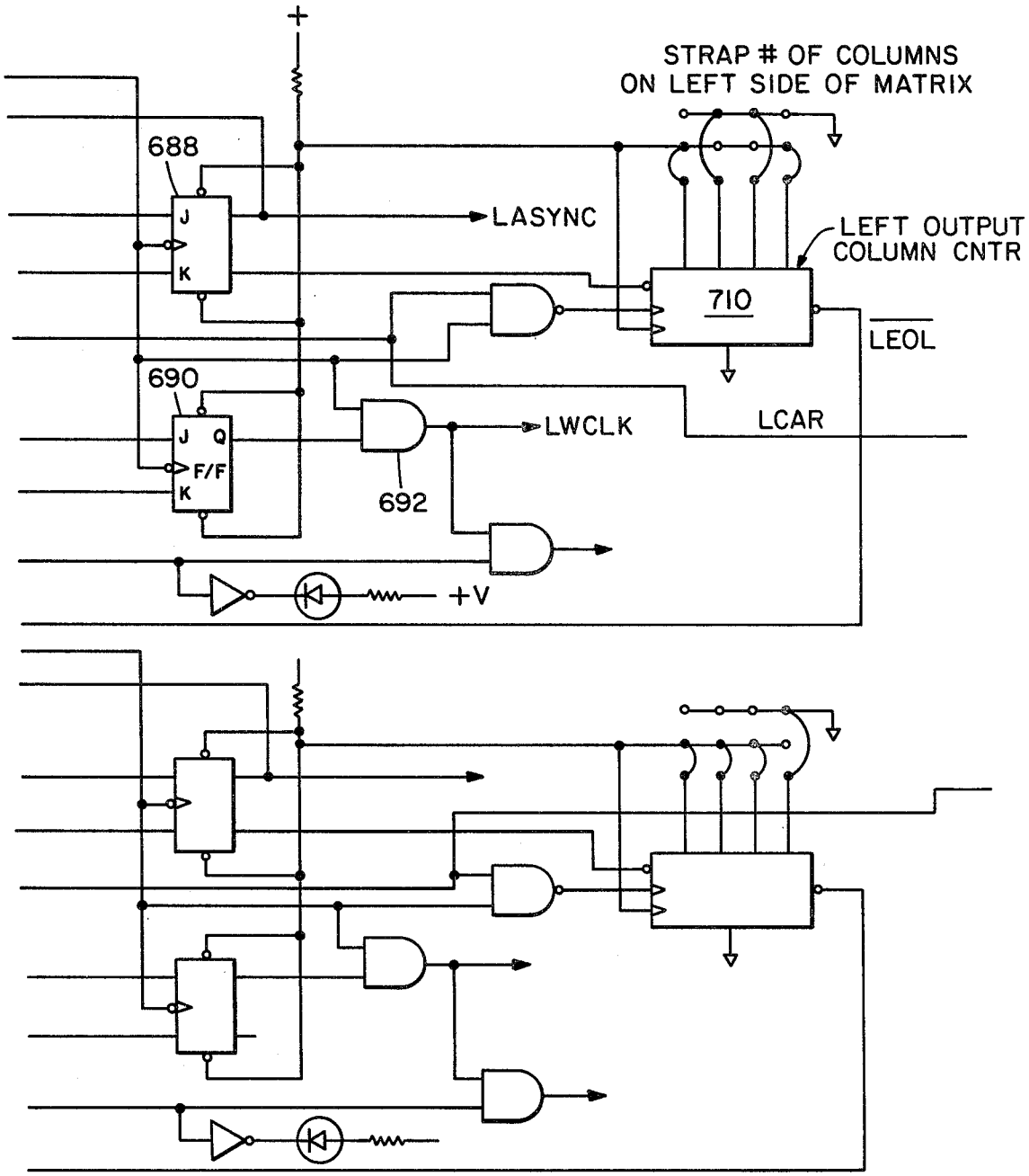
Figure 22C:
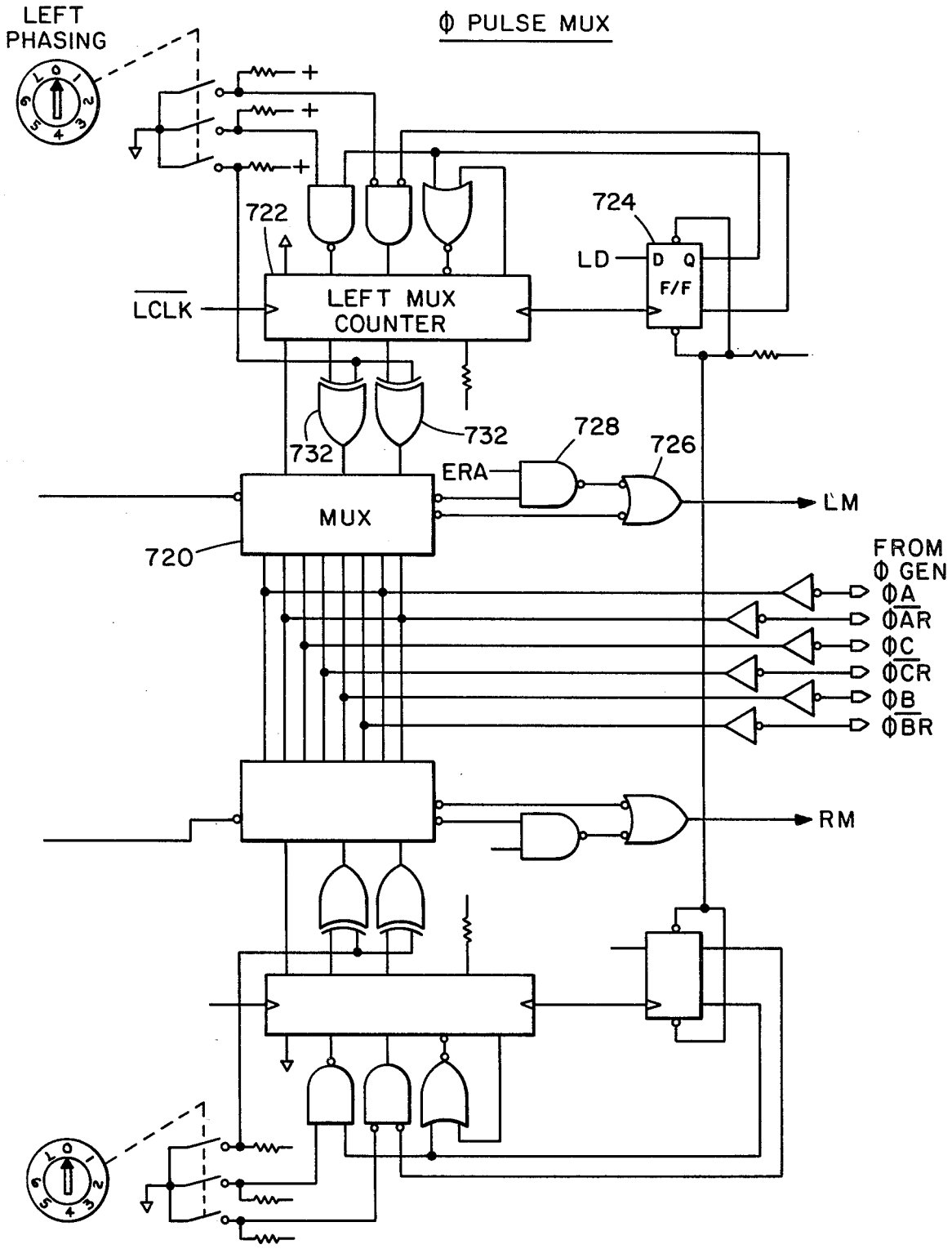

FIGS. 20 and 21 disclose the circuits of the TRANSMITTER and, in particular, the circuits which control the addressing, inputting, shifting and buffering of the data received from the V/D INTERFACE. FIG. 22 discloses the output control logic and $\phi$ pulse multiplexer. When discussing the output circuits, the text will be limited to the operation of only those circuits which transmit to the left side of the matrix. Those which operate to the right side do so in an identical manner and will not be described.

Referring to FIGS. 20 and 21, the $\overline{\text{SFRM}}$ pulse passes through gates 600 and 602 clearing the left and right buffers 530 and 532. BSFRM from gate 600 sets F/F 604 (FIG. 21), loads the LEV counter 606 with the binary value $\phi\phi\phi$1, and on its trailing edge triggers the ACLK one-shot 608. The setting of the F/F 604 causes the LINE counter 610,F/F 612 and the MEM counter 614 to enter a loading mode. The output of the LEV counter 606 drives the select lines of the seven 8-to-1 multiplexers 615–621. Their outputs, in turn, supply the starting LINE and MEM values to the parallel inputs of the LINE and MEM counters.

The trailing edge of the ACLK pulse will clock both the LINE and MEM counters causing them to load the LEV 1 starting line address. ACLK will also clear the F/F of 604 which will remove both the LINE and MEM counters from the load mode and place them into the count mode.

The LINE counter formed by 610 and F/F 612 is a presetable binary up counter decoded to function as a divide-by-20. It may count from binary $\phi\phi\phi\phi\phi$ to 1$\phi\phi$11 (0–19 decimal). At 19 the AND gate 622 generates a carry out, which enables the LINE counter to clear, and the MEM counter 614 to increment.

The MEM counter is a presetable binary up counter configured to function as a divide-by-3. It may count from binary $\phi$1 to 11 (1–3 decimal). At MEM=3, LINE=19, for example, the MEM counter's carry output enables the LEV counter 606, via NAND gate 624 to increment it. At the same time it conditions the LINE and MEM counters for another parallel load via OR 626. Each time the MEM counter's carry goes high it signifies the end or last line of the current LEVEL.

The next signal received from the V/D INTERFACE is $\overline{\text{SLIN}}$ (see FIG. 20). From inverter 628 comes BSLIN. BSLIN is inverted at gate 630, producing $\overline{\text{BSLIN}}$, which presets F/F 632. The output of this F/F goes low, enabling the outputs of the two OR gates 634 and 636. This causes the input shift registers to the parallel load mode.

On FIG. 21, BSLIN will increment the LEVEL counter 606 if the MEM counter's carry is high. $\overline{\text{BSLIN}}$ will trigger the ACLK one-shot 608 on its trailing edge. On FIG. 20 ACLK's trailing edge will, via OR gate 640, cause the input S/R528 to parallel load the address Aϕ through A1ϕ into the top three segments of the S/R. The balance of the segments will load zeros. ACLK's back edge will also clear the F/F 632 which will release the input S/R from the parallel load mode. Back on FIG. 21 the back edge of ACLK will cause the address counters to increment, setting up the next address that will be needed.

Referring again to FIG. 20, the two F/F 640 and 642 will partially enable the AND gate 644. BSLIN will clear the divide-by-12 counter 646 and the COL counter 648. The L/R output of the COL counter will thus be low. Via the OR gates 634 and 636 L/R will condition the Data Flip S/R to the shift right mode.

The COL counter's outputs go to a binary-to-decimal COL decoder 650. With the COL counter clear, the output of decoder pin 1 will go low. This is called the "A" or address output state. "A" will partially enable the two AND gates 652 and 654. The outputs of these two AND gates will provide the LSI and RSI (left shift in and right shift in) clocks to the buffers. The "A" state of the COL counter provides that the address is loaded into both the left and right buffers during the first twelve VTCLK's.

Next the V/D INTERFACE will generate twelve pixels of data at the VDϕ through VD3 inputs. Each pixel will be synchronized with a $\overline{\text{VTCLK}}$. The four VD bits will arrive via the AND gates 656–659 and become the shift right (R) inputs to the input shift register 528. $\overline{\text{VTCLK}}$ moves the data around and is the focal point of the input circuit operation.

$\overline{\text{VTCLK}}$ is inverted and passed through the AND gate 644. Here is takes a slight detour to a one-shot 660. This one-shot, combined with F/F 642, form a VTCLK detector circuit. The purpose of this circuit is to help guarantee that a complete line of 192 VTCLK's is always loaded into the buffers. It works in the following way. The one-shot 660 is retriggerable. Its output will remain high so long as VTCLK's keep triggering it. If the VTCLK's are interrupted prior to the completion of a complete line, the one-shot will time out and cause the F/F 642 to set. Its output will disable the VTCLK AND gate and enable F/F 662. This F/F will then be set in response to a 6 MHz clock (6MCLK). Its output will enable the AND gate 664 which will produce FCLK (fill clock). FCLK will take the place of VTCLK via the OR gate 666. It will run until the TRANSMITTER requirements for a complete line of clocks is satisfied. Notice also that when the detector F/F 642 was set, its output disabled the AND gates 656–659 which admit the VD data. This causes the input S/R to load only zeros during a period of FCLK's.

Continuing to trace the path of the VTCLK's, and assuming a complete line of 192, the output of OR gate 66 will clock:

The input S/R via OR gate 640.

The divide-by-12 counter 646.

The left and right buffers via AND gate 652 and 654. When the divide-by-12 counter reaches the count of 11, the twelfth VTCLK's trailing edge will increment the COL counter, reset the divide-by-12 counter to zero, and trigger the DCLK one-shot 670.

In order here is what happened. Twelve VTCLK's caused the previously loaded address in the input S/R to shift into both the left and right buffers. At the same time twelve pixels of VD data took its place in the S/R. The end of the twelfth VTCLK caused the COL counter to increment, sending the COL decoder to the "1" state.

The "1" state output of the COL decoder is jumpered to "W" (see the table of jumpers for a matrix 192 long, split 108/84). "W" enables the "J" input of F/F 672. Since the twelfth VTCLK also triggers the DCLK one-shot 670, the F/F 672 will be set by DCLK. The $\overline{\text{Q}}$ output of this F/F will enable the VTCLK's (which were previously enabled by the "A" COL decoder state) to pass through AND gate 652. This allows the next 108 VTCLK's to provide the LSI (left side information) for the left buffer.

For each group of twelve VTCLK's that comes along, the COL counter will increment. Each time a DCLK will be generated to look for the end of the left buffer's data from the "X" jumpered value of the COL decoder.

When the "X" value is reached, the left buffer has its line of data and it is now time to switch to the right buffer. The "X" value permits the DCLK to clear the left F/F and set the right F/F 674. IC-92 pin 7 enables the RSI via AND gate 654. The VTCLK still has 72 more clocks to produce before it finishes transferring its line. The 192nd VTCLK will increment the COL counter to 16, via the COL decoder. This will cause the "Y" jumper to enable the FCLK F/F 662 via the OR gate 676 and the DCLK F/F 672 to set. The FCLK F/F will enable the 6 MHz FCLK's IC to begin shifting the input S/R and load the last twelve pixels into the right buffer. The setting of the F/F 642 disables the VTCLK and gate 644 and also the VTCLK detector circuit.

The twelfth FCLK will cause the COL counter to increment to COL 17. The COL decoder will then drive the "Z" jumper low, conditioning the right F/F 674 to clear on the next DCLK. This will disable the RSI clock. Note, also, that when the "Y" COL state was cancelled so were the FCLK's. This completes the operation of the input control circuits. Each line of data received from the V/D INTERFACE will be processed in the same way.

The transmitter output control logic (FIG. 22) operates in the idle and transmit states. The idle state will be discussed first. A 6 MHz xtal oscillator 680 feeds a F/F 682. This F/F divides the 6 MHz by 2, yielding a 3 MHz clock called $\overline{\text{LCLK}}$. $\overline{\text{LCLK}}$ increments the left output counter 684. The left output counter is a presetable up counter which, in the idle state, has its parallel inputs all set low. This makes it perform a divide-by-16 of the input $\overline{\text{LCLK}}$. Its outputs connect to a binary-to-decimal decoder 686 which will decode counts 1, 2 and 3.

Count 1 will allow LCLK to set F/F 688. Count 2 will allow LCLK to clear it. Count 3 will allow LCLK to set F/F 690. The carry from the left output counter will allow LCLK to clear this F/F. The output of the first F/F is called LASYNC (left ASYNC). The output of the second F/F will enable AND gate 692 to pass LCLK's from the count of 4 through 15. This generates the 12 clock burst called LWCLK (left WCLK). The LASYNC and LWCLK timing is shown in FIG. 17.

LASYNC is applied as one input to NAND gate 694. The other input to this NAND gate is the LOR signal from the left buffer logic of FIG. 20. LOR will be tested by LASYNC at the beginning of each idle cycle. If LOR is high, the output of the NAND gate 694 will set F/F 696. This will produce the LXMIT (left transmit) signal, and causes the output control logic to enter the transmit state.

The origin of the LOR signal is shown in FIG. 20. First in first out registers 697–699 make up the left buffer 530. As data is shifted into the left FIFO, it will automatically propagate to the output of the right FIFO. When it arrives the OR output of 699 will go high, indicating data is available to be shifted out. OR will partially enable the LOR AND gate 700. When the write operation to the left buffer begins (excluding the addressing phase) the left F/F 672 goes high. This partially enables the NAND gate 702. As the data being written into the buffer passes from the middle to the right FIFO the OR output of FIFO 698 will go high, satisfying the input requirements of the NAND gate 702. Its output, in turn, will set the F/F 704 whose output, in turn, will satisfy the input requirements of the LOR AND gate 700.

The LOR signal will remain availabe until the $\overline{\text{LXMIT}}$ signal clears F/F 704. Another write cycle into the buffer will reset the F/F and cause another LOR. Thus, LOR will be set and cleared once for each line of transmission.

Now returning to FIG. 22 and the LXMIT F/F 694 which has just been set by LOR and LASYNC, the LXMIT signal will:

Modify the left output counter preset value, changing the counter to a divide-by-12 on its next carry.

Inhibit the AND gate 706. This prevents the carry from the left output counter from clearing the LWCLK F/F 690.

Enable the LSO (left shift out) AND gate. This will allow the LWCLK to shift the data out of the left buffer (see FIG. 20).

Clear the LOR F/F 704 (FIG. 20) on LXMIT's trailing edge.

A binary down counter 710 is strapped with a preset value of nine. This counter will be directly loaded by $\overline{\text{LASYNC}}$ from F/F 688. It is decremented by LCLK NANDed with carry from the left output counter. Counter 710 will thus count the COL's of the left transmission. It will count one address and nine COL's and during the ninth COL produce a borrow pulse. This borrow occurs on the last of the 120 LWCLK's needed to transmit a complete line to the left side of the matrix, and is called $\overline{\text{LEOL}}$ (left end of line).

$\overline{\text{LEOL}}$ will set the output of OR gate 712 low. This returns the left output counter to the divide-by-16 mode, and conditions the LWCLK F/F 690 to be cleared on LCLK's trailing edge. The clock of the LXMIT F/F 694 is connected to $\overline{\text{LEOL}}$. When $\overline{\text{LEOL}}$ returns high the LXMIT F/F will be cleared, terminating the transit state.

The left output counter will have been reset to zero and a 16 count cycle will begin and generate the next LASYNC. If LOR is low the idle state will once again be entered. If LOR is high ASYNC will sample it and start another transmit state.

The output data from the left buffer along the LASYNC and LWCLK is given to the data selectors 538 (FIG. 19) for transmission to the video board.

The final circuit for discussion is the $\phi$ pulse multiplexer (FIG. 22). An 8-to-1 multiplexer 720 receives the six $\phi$ pulses from the $\phi$ GEN at its inputs, while its select inputs receive the output of a binary counter 722. F/F 724 will hold the multiplex counter in a load mode until the LD bit from the left output counter goes high. This will permit the multiplex counter to count during the last seven LCLK's of a 12 clock cycle. The output of the counter will cause the six $\phi$ pulses to output and generate the LM (left multiplex) data at gate 726. During the twelfth LCLK the left output counter will carry, generating the LCAR signal. LCAR will disable the multiplexers' output and enable the NAND gate 728. Here the ERA signal will produce the LM output. Thus, LM will be the time-multiplexed status of the six $\phi$ pulses and the ERA signal.

The $\phi$ GEN always generates three sets of $\phi$ pulses, one for each phase A, B and C. The DISPLAY LOGIC always decodes the $\phi$M data in a fixed way which will reproduce the $\phi$ pulses as A, B and C. Desirably, A, B and C generated in the control room match the A, B and C phases of the matrix board. But this rarely happens because 3 phase power distribution systems do not require identification of phases between distant locations to match. This means that the A, B and C outputs of the $\phi$ GEN may be matched to the A, B and C phases of the matrix board in any of six different ways. It is, therefore, usually necessary to modify the count sequence of the multiplex counter 722 and assemble the $\phi$M outputs in the six different orders which are possible.

The left phasing switch 730 is provided to match the control room $\phi$ pulse rotation with that of the matrix board. It allows the multiplex counter to be selectively preset and its output count rotation to be reversed by the exclusive OR gates 732. The output of the multiplexer 720 can thus change depending on the position of the phasing switch.

VIII. THE $\phi$ GENERATOR

The sixteen different lamp intensities which may appear on the matrix display board are achieved by varying the average power consumed by a lamp within each AC half-cycle. This is accomplished by controlling the turn-on point of triacs at fifteen different locations during each half of the 120 VAC sine wave. Each triac controls one lamp. A triac turned on yields a lamp turned on. The later a lamp is turned on within each half cycle, the lower its average power consumption, and therefore, the dimmer its intensity (see FIG. 23). This is called phase controlled dimming.

The scoreboard logic receives $\phi$ pulses from the 16 SHADE $\phi$ GENERATOR 134 via the TRANSMITTER. The $\phi$ pulses are synchronized with the AC line voltage and divide it in such a way as to provide fifteen timing windows for turning on lamps at fifteen different intensity levels. The data which defines the brightness of an individual lamp is contained in one 4 bit binary word, or pixel. A pixel value of binary 111 represents the highest brightness level while one of $\phi\phi\phi\phi$ represents the dimmest, or off lamp value.

The 16 SHADE AND GIP $\phi$ GENERATOR, hereafter referred to as the $\phi$ GEN, provides the matrix display board with three sets of $\phi$ pulses. Each of the three sets of $\phi$ pulses is matched to a different power phase (A, B, or C), but all the fifteen pulses of each set are identically spaced within each power line half cycle.

The $\phi$ GEN provides for two modes of operation called BRIGHT and DIM. Each mode has fifteen adjustable potentiometers (pots) which make it possible to set the desired brightness value of each $\phi$ pulse. The BRIGHT mode is typically adjusted to optimize the daylight viewing of the display, while the DIM mode is adjusted to favor the night.

A detailed description of the $\phi$ GEN is omitted here since a complete description of substantially the same circuitry is provided in U.S. Pat. No. 3,941,926 incorporated hereby by reference. See particularly FIG. 15 and the text relating thereto.

IX. MATRIX BOARD DISPLAY LOGIC

The DISPLAY LOGIC consists of three types of logic boards and TRIAC BOARDS. The logic boards are:

I/O BOARD
CONTROLLER BOARD
DRIVER BOARDS

The logic in a display board cabinet can drive a matrix of lamps 24 wide by 60 high. The description will first consider the input circuits and show how the data is received.

DATA I/O

Figure 24:
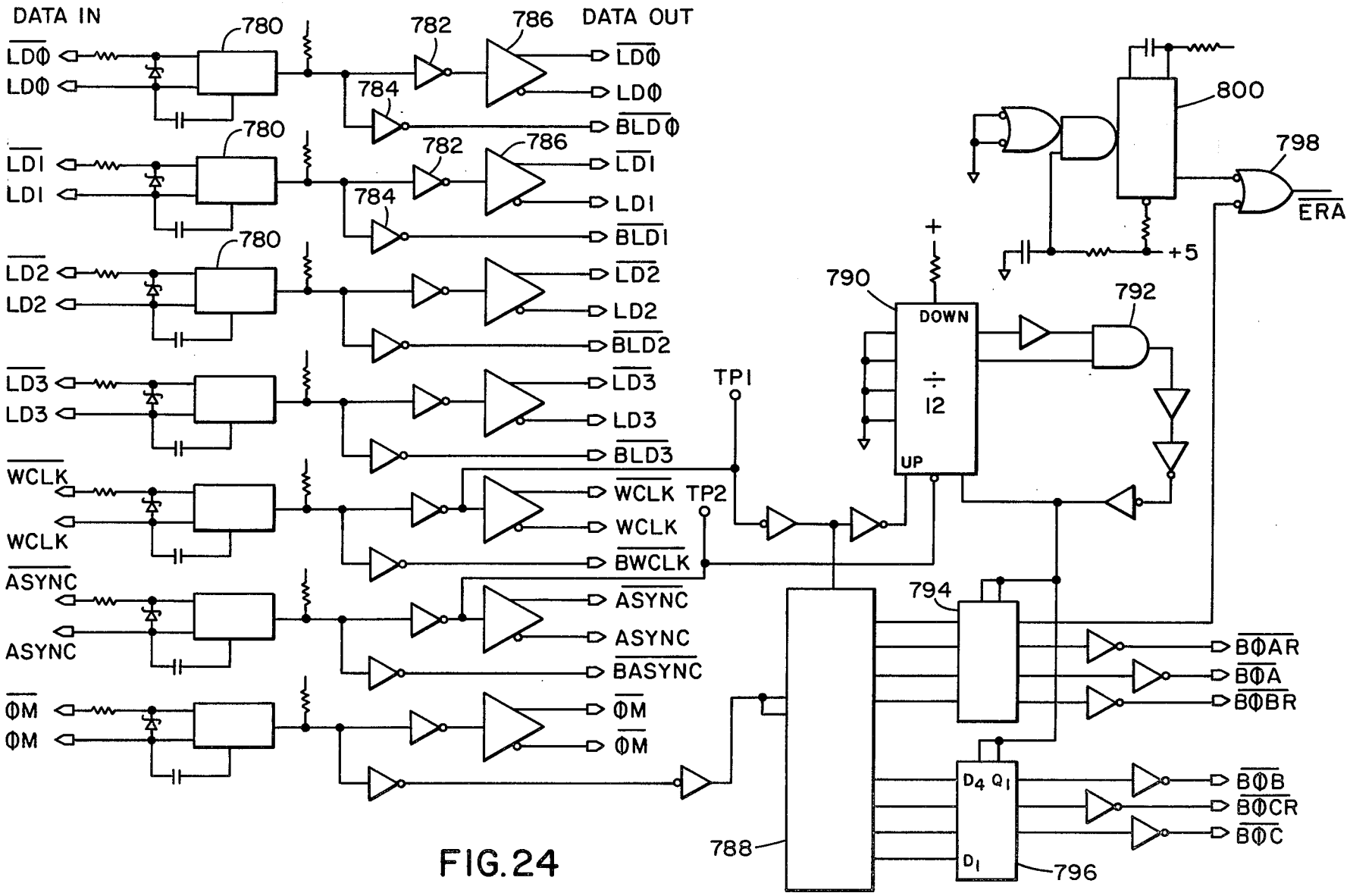
FIG. 24 is a schematic diagram of the I/O circuit according to the invention.

The signals sent by the TRANSMITTER are received in the CONTROL CABINETS by the I/O (INPUT/OUTPUT) BOARD, FIG. 24. This data is in a video format and exists in two states. The "idle" condition when no lamp data (LD) is being sent, and the "transmit" condition when LD is being sent. See FIG. 17.

The following seven signals are received:

LD$\phi$ through LD3—contain the lamp data. LD$\phi$ is the LSB; LD3 the MSB. LD3 is also the carrier for address information.

ASYNC—address sync, is a pulse which indicates that the next twelve LD3 data bits are to be interpreted as an address.

WCLK—write clock, a 3 MHz clock which occurs between ASYNC's. The leading edge is used to sample the LD. The trailing edge is when LD changes.

$\phi$M—multiplexed $\phi$ pulses, the lamp brightness data, $\phi$ pulses, are multiplexed onto this line, along with the ERASE (ERA) signal.

The received data, identified as "DATA INPUTS", is brought into by opto-isolators 780 which take the differential input and produce a TTL level output. At the same time they provide electrical isolation between the CONTROL CABINETS. The isolators' outputs pass through a pair of schmidt-trigger buffers 782 and 784. One buffer 782 of each pair drives a differential line driver 786. These provide the "DATA OUTPUT" to the next CONTROL CABINET. The second buffer provides a set of output signals used by the rest of the cabinets' logic. These signals have the prefix "B" (for buffered) attached.

The I/O BOARD contains the circuits for demultiplexing the $\phi$ pulses. WCLK is always transmitted in some multiple of twelve clock pulses after each ASYNC pulse. The $\phi$M signal contains the time multiplexed state of the six $\phi$ pulses and the ERA signal synchronized during the last seven clocks of each twelve WCLK's. Shift register 788 (S/R) has $\phi$M as its serial data input and WCLK as its clock input. After every twelve WCLK's the S/R will contain the last seven states of $\phi$M in outputs QA through QG. A presettable counter 790 has its outputs decoded to make it a divide-by-12. ASYNC loads the counter to zero, WCLK increments it until count 12 is decoded by gate 792. Count 12 is used to reset the counter, and also to sample the contents of the S/R into two quad latches 794 and 796.

Thus the lamp brightness information is output as $\overline{B\phi AR}$, $\overline{B\phi A}$, $\overline{B\phi BR}$, $\overline{B\phi B}$, $\overline{B\phi CR}$, & $\overline{B\phi C}$. The ERA signal is outputed from latch 794 and applied to OR gate 798. The second input to the OR gate is the output of a monostable 800 that generates a one-second pulse whenever the power is first applied. The output of OR gate 798 yields a signal called $\overline{ERA}$. The $\overline{ERA}$ signal is used to erase and initialize other circuits both on command from the TRANSMITTER or when power is first applied to the cabinet logic.

ADDRESSING

The CONTROLLER BOARD contains the circuits necessary to decode the transmitted address and select the correct data from each line of transmission. The CONTROLLER BOARD contains two identical sets of circuits to perform this operation. They are the "a" circuits and the "b" circuits. Each controls the data for one COL. The discussion of the circuit operation will be confined to the "a" side.

Figure 25:
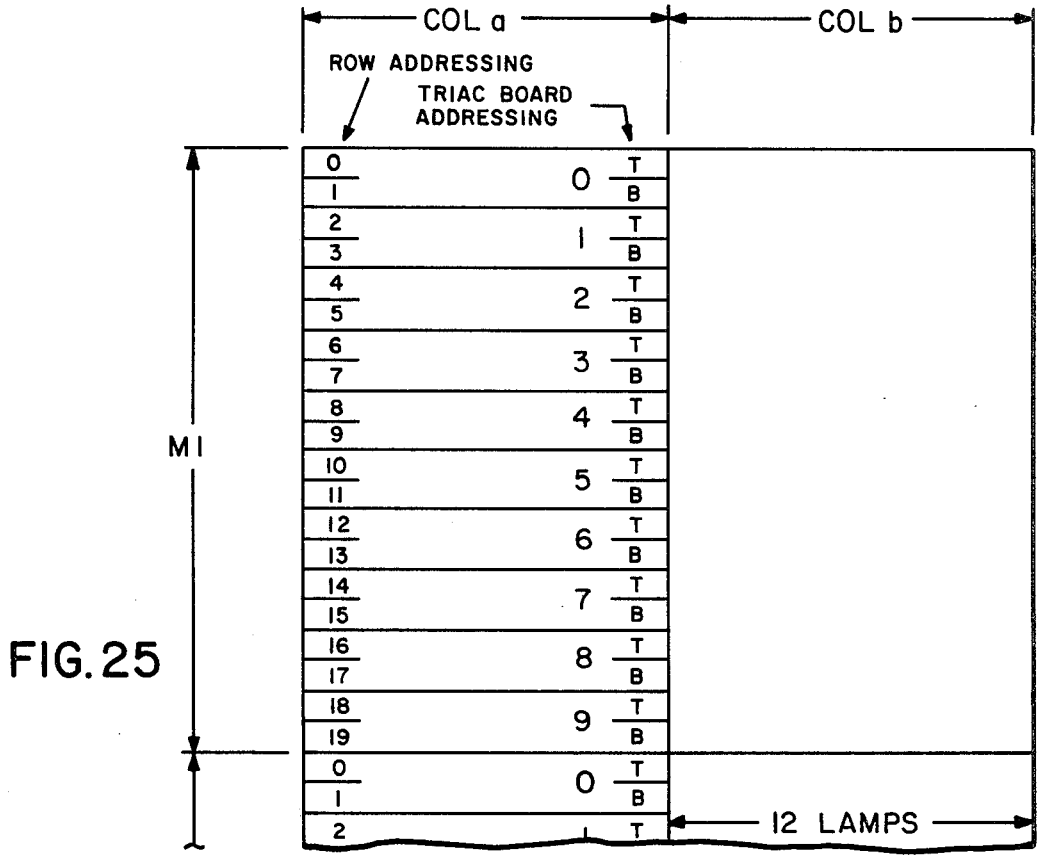
FIG. 25 is a diagram useful in explaining addressing scheme utilized for the control cabinet of the display board.

Before considering the schematic circuits, a discussion of the cabinet addressing scheme is in order. FIG. 25 shows the control area of one cabinet diagrammed with its addressing subdivisions. Whenever data is loaded into a COL it is always done so in 12 bit words. A line of transmission can be divided into a number of 12 bit COL's. Each line must in turn be identified with an address that describes to which level (LEV) of the matrix display it belongs. This, in effect, identifies the cabinet. Each cabinet's COL is divided into three memory (MEM) groups (M1 through M3). Within each MEM group we have 20 LINES of data. Therefore, the address that must precede each line of data has three parts that may be defined by 12 bits:

| (spare) | (LEV) | (MEM) | (LINE) |
|---|---|---|---|
| 1 bit | 4 bits | 2 bits | 5 bits |

A spare bit is added to bring the bit count to twelve. The COL address is, of course, obtained by counting every 12 bits of data.

LEV's may be numbered from 1 to 15.
MEM's are numbered 1, 2 or 3.
LINE's are numbered from $\phi$ to 19.
COL's are numbered from 1 to 255.

Figure 26:
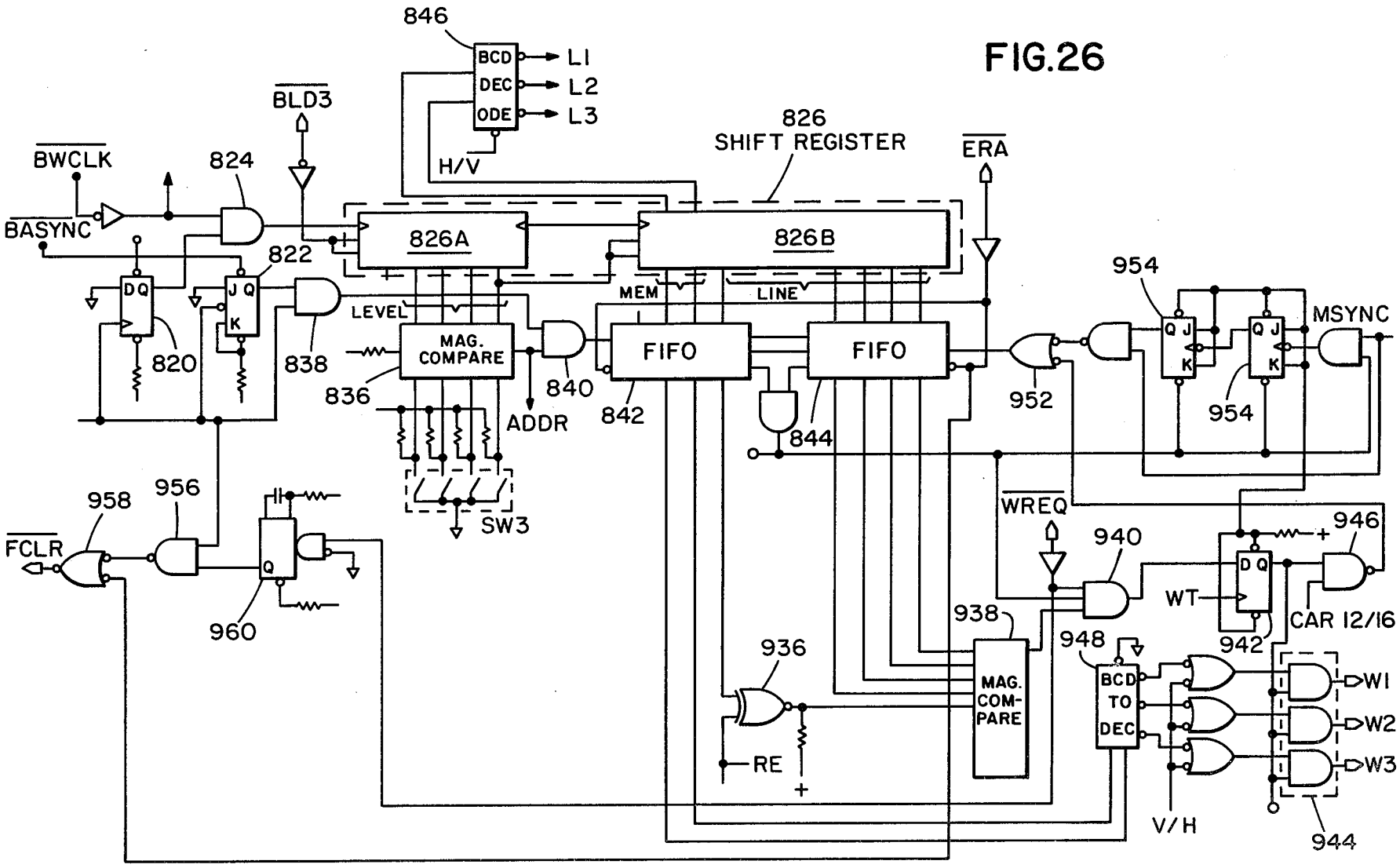
FIGS. 26 and 27A are schematic diagrams of the display logic controller according to the invention.

Referring now to FIG. 26, the $\overline{BASYNC}$ signal is received and sets two F/F's 820 and 822. The output of the first F/F enables AND gate 824 to allow $\overline{BWCLK}$'s to clock the S/R 826. $\overline{BASYNC}$ also appears on FIG. 27A where it clears a divide-by-12 counter 828, and clears an 8 bit binary up counter 830. The output of the latter is the COL counter. BWCLK is used to clock these two counters. Every twelfth BWCLK is passed via AND gate 832 to monostable 834. The output of this monostable is 90 nsec pulse which occurs after the twelfth BWCLK. This is called ASTB (for Address Strobe), and is supplied to FIG. 26.

During the first twelve BWCLK's following the BASYNC pulse, 12bits of address data are loaded into the address S/R 826. After twelve clocks, the leading edge of ASTB clears F/F 820 so that no more data is allowed into the address S/R. The S/R contains the address in the following form:

826A: QB through QE holds the LEV with QE containing the LSB.

826B: QA and QB holds the MEM with QB containing the LSB.

826B: QC through QG holds the LINE with QG containing the LSB.

The LEV data is presented to one side of a magnitude comparator 836. The other side of comparator 836 is connected to a thumbwheel switch SW3 which must be preset to the correct LEV which the cabinet services. If the LEV data equals the LEV, switch comparator 836 goes high indicating address OK (ADOK), a match condition, which means that some part of the data following is to be loaded into this cabinet's COL. ADOK is combined with ASTB via AND gates 838 and 840. The output of gate 840 is used to clock the shift in (SI) inputs on two FIFO memories 842 and 844. The back edge of ASTB clears F/F 822 which inhibits any further ASTB's from clocking the FIFO. Thus, the MEM & LINE address data has been saved in FIFO storage to be used at a later time.

The MEM output data at 826B, QA & QB, is applied to a binary-to-decimal decoder 846. This yields a set of signals ($\overline{L1}$, $\overline{L2}$ & $\overline{L3}$) that indicate for which memory the data is destined. These signals go to FIG. 27A where they decode the correct COL, and transfer the data to another FIFO memory on the DRIVER BOARD. ADOK enables the ASTB pulse via AND gate 848 to strobe the output of the cascaded magnitude comparators 850 and 852. One set of inputs to the comparators is formed by the COL counters' outputs; the second set, by two thumbwheel switches, SW1 & SW2. These switches must be preset with the binary values needed to define the COL which the cabinet circuits must service. When the COL count equals the COL preset, and ASTB comes from AND gate 848, then the output of 852 goes high, setting the data load F/F 854, whose output in turn partially enables three NAND gates 856.

Meanwhile, BWCLK's are being counted by divider 828. Every twelfth BWCLK increments the COL counter and generates an ASTB. Each ASTB tests for the correct COL via a comparator. A COL match sets a F/F which enables three NAND gates. The $\overline{L1}$, $\overline{L2}$ & $\overline{L3}$ signals are received at three OR gates 858. If one of these is low, then one OR gate output will go high, providing another enable to one of the NAND gates of 856. The final input to the NAND gates 856 is BWCLK from inverter 860. This enables one of the gates to produce a burst of BWCLK's. This new output is called $\overline{LF1}$, $\overline{LF2}$ or $\overline{LF3}$, depending upon which NAND gate was ultimately enabled. This burst will contain exactly twelve BWCLK's, for on the twelfth BWCLK's trailing edge, the data load F/F 854 will be clocked, clearing its output and disabling gates 856. This culminates the address decoding process for each line of transmitted data.

The $\overline{LF}$ signal stands for LOAD FIFO. The first, second or third FIFO's represent a temporary storage register located on the FIG. 27 portion of the DRIVER BOARD. These registers are shown at 870-872. The $\overline{BLD\phi}$–$\overline{BLD3}$ lamp data is applied to the inputs of the three FIFO's. If the $\overline{LF}$ signal is present, then twelve bits on each LD line will be shifted into the selected FIFO.

When the data loaded into the FIFO bubbles to the output, a signal called output ready is generated. The output ready signals are ORed together by gate 874, whose output generates a signal called $\overline{WREQ}$ (Write Request). The $\overline{WREQ}$ indicates to the CONTROLLER BOARD that data is ready to be transferred from temporary storage to the memory. First, however, the operation of the memory and output circuits must be explained.

MEMORY AND OUTPUT

The memory devices used on the DRIVER BOARD consist of three MOS dynamic shift registers, 875-877. Each is 4 bits wide by 256 bits long. Since all three memories operate the same way, we will restrict our discussion to the M1 circuits formed around register 875.

The 256-by-4 bit shift register holds enough data to light the 12×20 MI area within the COL. Of the 256 words available within one revolution of the S/R, only 240 are needed and 16 are unused. If we divide the 240 by 12, we have 20 groupings which can be called ROWS. If we divide the 20 ROWS by two, we end up with ten new groups which we can call triac board addresses and define the value with four bits called A, B, C & D. These, and other useful signals, are needed to control the recirculation and outputting of the data contained in the memory.

Figure 28:
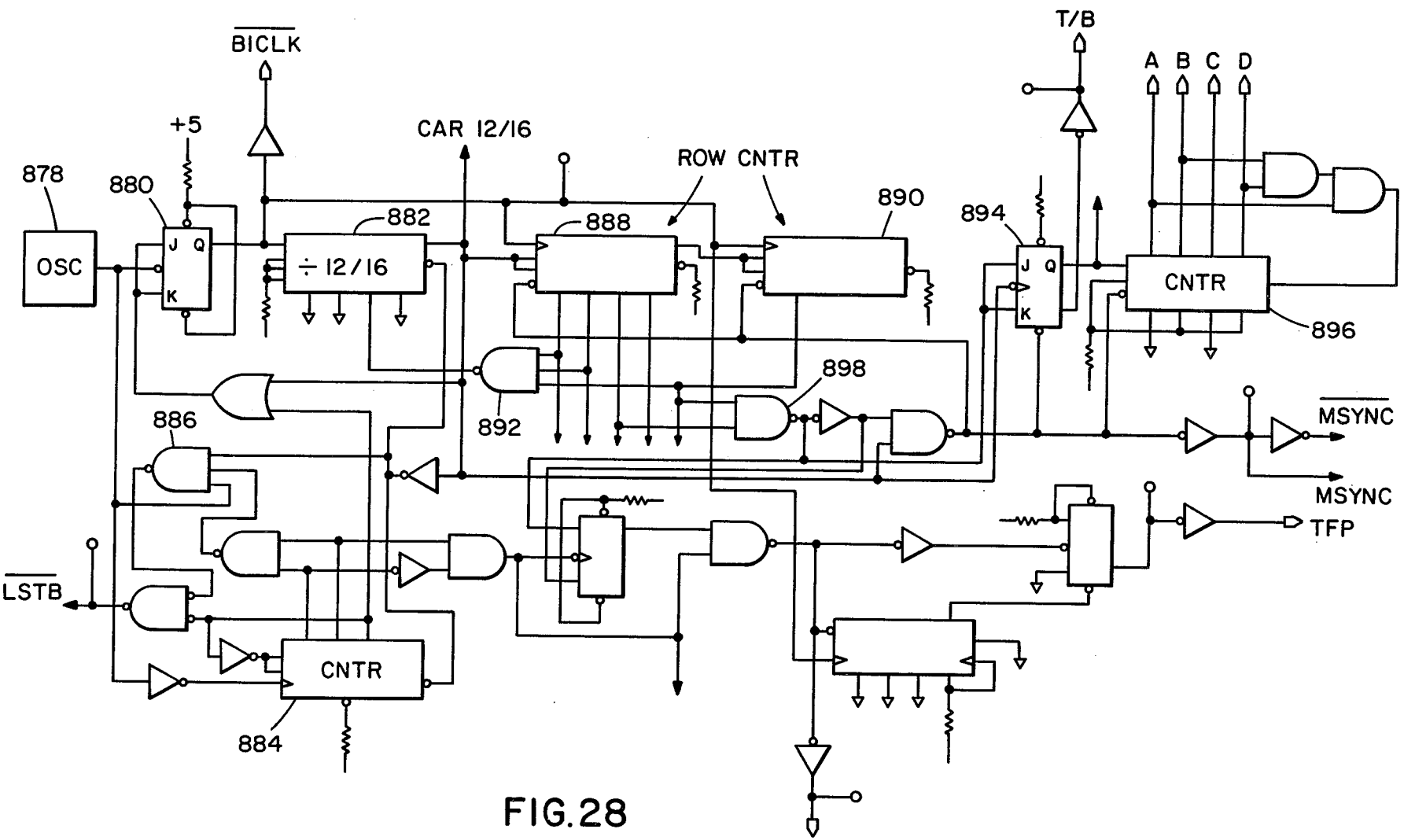
FIG. 28 is a schematic diagram of a further portion of the display logic controller according to the invention.

On the CONTROLLER BOARD circuit of FIG. 28 we have a clock control circuit which is used to recirculate the memory and drive the memory output circuits. A 4 MHz XTAL oscillator 878 has its output divided by two at F/F 880, and generates a 2 MHz recirculate clock called $\overline{BICLK}$ (Interrupted Clock). The $\overline{BICLK}$ is formed into bursts containing twelve clock pulses; this by the action of counter 882, interacting with counter 884, and OR gate 886. Row counters 888 and 890 count each burst of twelve ICLK's. After 20 ROWs have been counted, the present value of the divide-by-12 counter 882 is modified by the NAND gate 892 to yield a 21st burst containing sixteen ICLK's. Thus, 256 ICLK's are generated which recirculate the memory.

The carry output of counter 882 is used to toggle the top/bottom (T/B) F/F 894 which generates the T/B signal. The T/B in turn clocks counter 896, which produces the triac board address bits A, B, C, D. Notice that the T/B F/F is not toggled by the 21st burst's carry since NAND gate 898 decodes the 21st burst and disables the J-K inputs to the T/B F/F 894. The T/B and A, B, C, and D signals are used to address TRIAC BOARDS. The output of one memory (240 words) can drive ten TRIAC BOARDS.

TRIAC BOARDS

Figure 29:
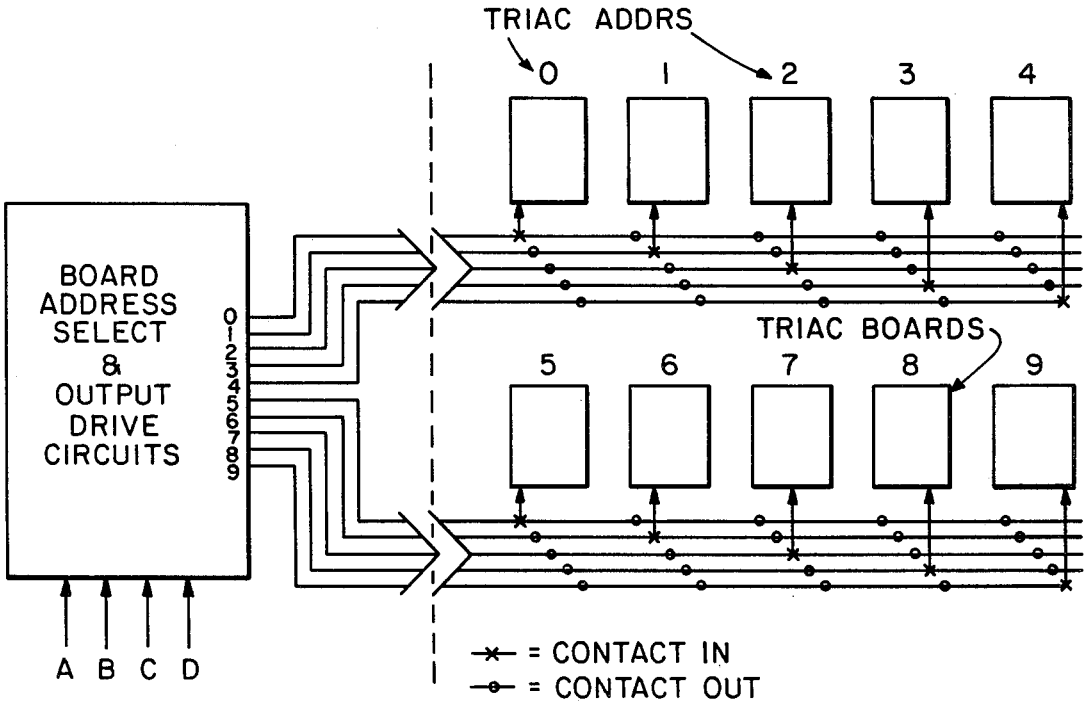
FIG. 29 is a diagram useful in understanding the triac board address selection method.

The TRIAC BOARD has 24 lamp control circuits arranged in two twelve-circuit rows, which are identified as the TOP and BOTTOM. The two rows of circuits share a common set of inputs. To drive a TRIAC BOARD requires twelve bits of data and a control line which routes the data to either the TOP or BOTTOM row. To multiplex the data, up to ten TRIAC BOARDS are connected on a common bus of twelve data bits and one T/B signal (see FIG. 29). This bus will physically be divided into two halves, one to feed TRIAC BOARDS $\phi$ through 4, and one to feed boards 5 through 9. To discriminate between the ten boards on this common data bus, a single control line is provided to select the particular board being addressed. This line will be called BOARD ADDRESS. FIG. 29 diagrams the selector circuit operation while FIG. 25 shows the relative position of the triac cards in the display area.

The triac circuits will not be described in detail in this specification. They are disclosed in U.S. Pat. Nos. 3,961,365 and 4,009,335 incorporated herein by reference. See particularly FIG. 17 of the '926 patent and the text relating thereto.

Since the lamp brightness is regulated by controlling the turn on time of the lamp within each half cycle of the AC line we must convert the 4 bit pixel which defines a lamp's brightness into data that corresponds to phase position with respect to the AC cycle. To begin with, $\phi$R and $\phi$ pulses are used to preset and decrement three counters, one for each phase. The counters will be preset to fifteen by $\phi$R and decremented by the trailing edge of each $\phi$ pulse.

Figure 30A:
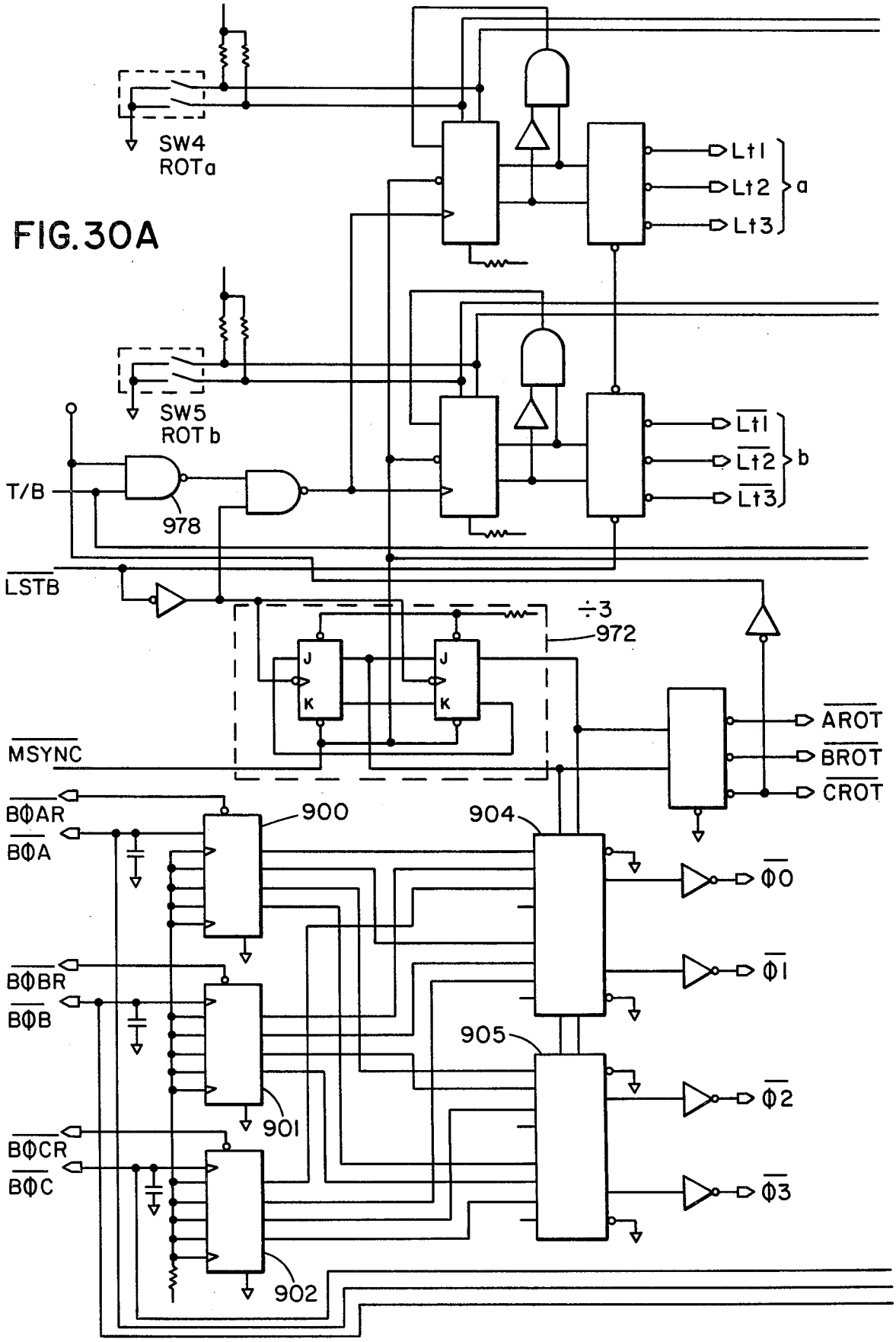
FIGS. 30A & 30B are schematic circuit diagrams of a portion of the display logic controller.
Figure 30B:
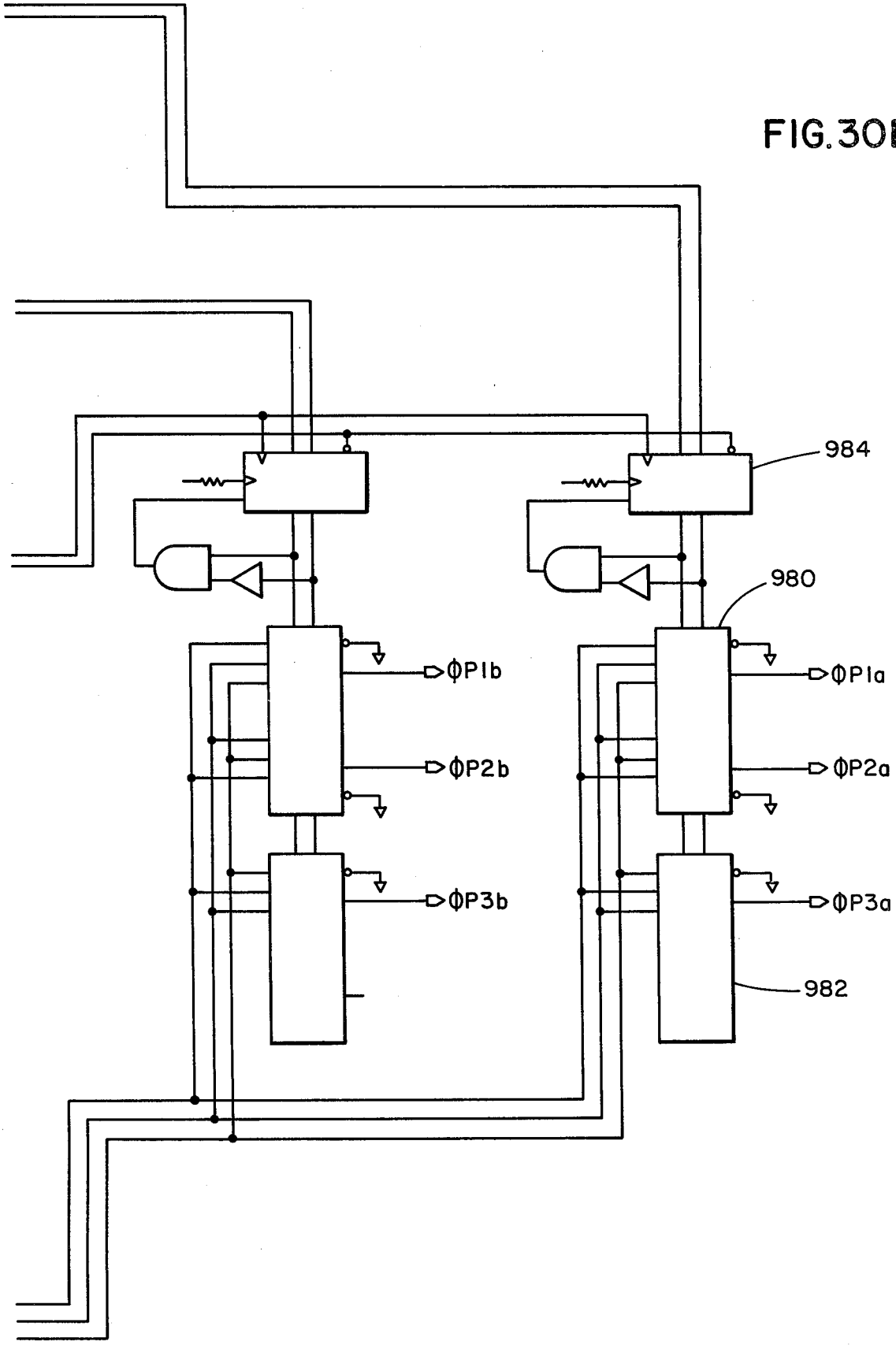
Figure 31:
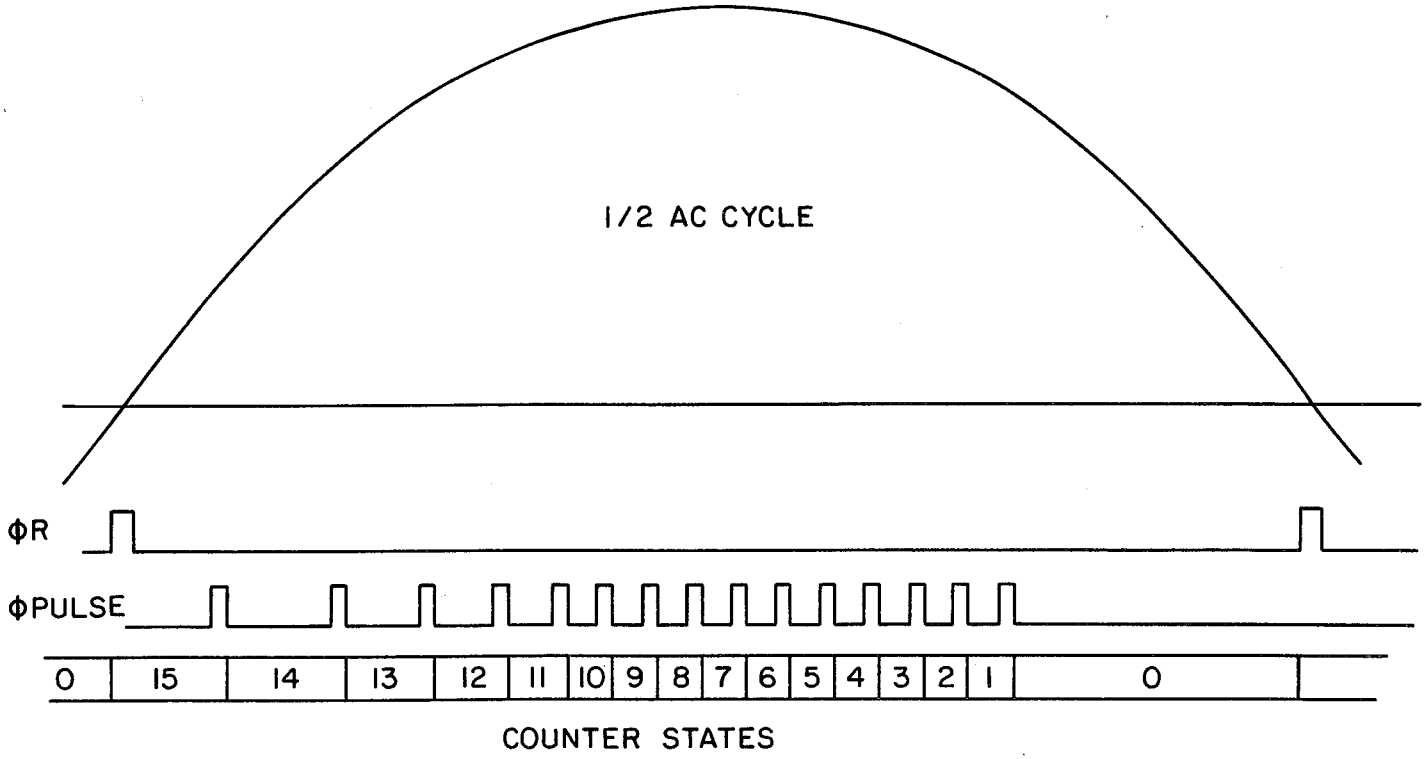
FIG. 31 is a timing diagram useful in explaining the $\phi$ pulse counter timing.

The controller board circuit of FIG. 30 contains these three counters 900-902. The 4 bit binary numbers in the counters are multiplexed through multiplexers 904 and 905 and yield data identified as $\overline{\phi 0}$, $\overline{\phi 1}$, $\overline{\phi 2}$, and $\overline{\phi 3}$. The binary count pattern relative to an AC 1/2 cycle sine wave is typified in FIG. 31. For the time being ignore the multiplexer circuit and just consider the output of one of the counters. The four brightness bits from the counter yield counts of 15, 14, 13 early in the AC cycle. Firing triacs early in the cycle will turn lamps on at relatively high brightness levels. Likewise turning lamps on when the count reaches 3, 2, 1 will turn lamps on at lower brightness levels. It should be apparent that all that must be done is to compare the value in the brightness counter with the 4 pixel bits recirculating in each word of memory, to determine if it is the correct time to light a lamp at a specific brightness. Thus we use the lamp brightness counter to poll the memory looking for data that should be used by the next $\phi$ pulse to come along. This polling circuit is diagrammed in FIG. 32.

Figure 32:
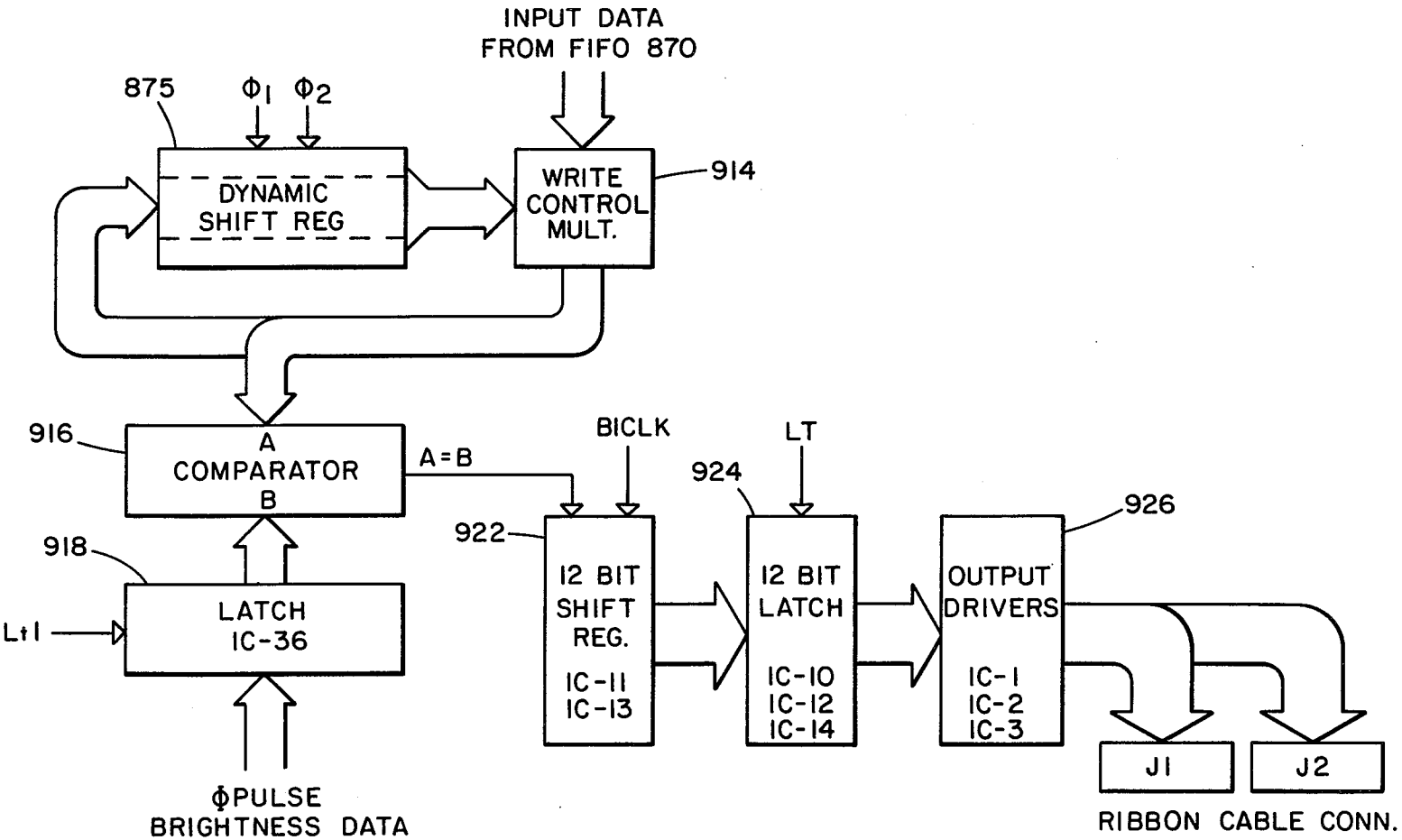
FIG. 32 is a block diagram of the data output logic contained on the driver board.

For the following description of the output circuit operation reference will be made to both FIGS. 27 and 32. The dynamic S/R 875 requires a two phase clock ($\phi_1$ and $\phi_2$). These clocks must swing between +5 and −9 VDC. The J-K F/F 910 with AND gate 911 perform the clock splitting operation on $\overline{\text{BICLK}}$. Comparators 912 perform the level conversion to +5 and −9 VDC. The output of the IC-42 is applied to the dynamic S/R's $\phi_1$ and $\phi_2$ inputs.

With the memory 875 in the recirculate mode, its data is continuously passing from its output, through the write control gate 914, back to its input. It takes 149 usec for the memory to make one complete circulation.

As the data is circulating, its output is simultaneously being applied to the "A" input of comparator 916. The "B" side of the comparator has as its input the current value of the $\phi$ pulse counter via a latch 918. The output of the comparator is, therefore, a singel line of serial data indicating each time the memory contents represent a lamp to be turned on at the current brightness value of the $\phi$ pulse counter. This serial data is called SER1 at the output of OR gate 920. SER1 is applied to the input of a 12 bit S/R 922 (FIG. 32). Each time twelve bits of data have been shifted into the S/R a signal called LT (Latch Trigger) will transfer the contents into a 12 bit latch 924. The LT signal is derived from the clock control circuits. Immediately following the LT signal a signal called TFP (Triac Firing Pulse) is generated. TFP is 4.5 usec long and will eventually be the signal that appears on the Triac Board as Board Address, thus causing the triacs to fire.

The twelve outputs of the latch 924 drive twelve PNP transistors forming the output drivers 926. The open collectors of the transistors drive two sets of ribbon cables. Typically, a lamp on signal will be a high level at the output of the latch. This keeps the transistor turned off, producing an open circuit condition on the data line of the ribbon cable.

Figure 33:
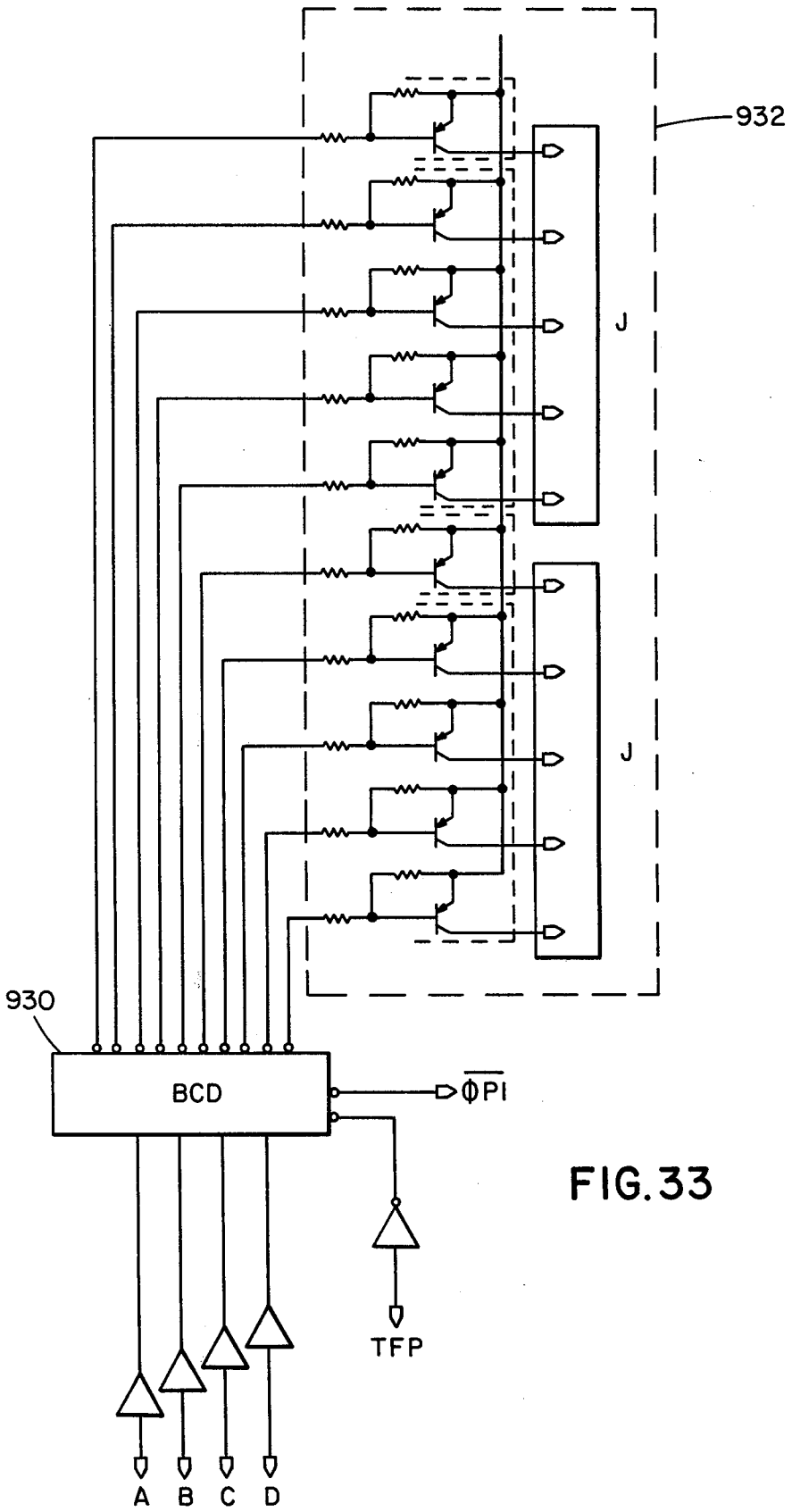
FIG. 33 is a schematic circuit diagram of a further portion of the driver board according to the invention.

All the time that the data is being decoded by the process just described, the A, B, C, D counter is keeping track of where the data is supposed to go (i.e., which Triac Board). On FIG. 33 the driver circuits include a binary-to-decimal decoder 930. Its inputs are the A, B, C, D count value. Its outputs drive ten output drive transistors 932. The outputs of the decoder 930 represent decimal 0 through 9 and are routed via these output drive transistors 932 to ribbon cable connectors.

The outputs of the binary decoder are strobed. Even though we are constantly decoding the data, we only want to fire the triacs when the $\phi$ pulse ($\phi$P) occurs simultaneously with TFP. TFP allows the data to settle on the cable's data circuits, between Board Address changes. Thus $\phi$P and TFP strobe the output of decoder 930. Remember, also, that it takes 149 sec for the memory to completely recirculate. This means that $\phi$P must provide a window large enough for the entire memory to output. It will be recalled that, for this purpose, $\phi$ pulses are approximately 175 usec long.

WRITE CONTROL

At this point in the discussion of the display logic the following has been described:

The address of a transmitted line of data has been decoded.

The MEM and LINE portion were loaded into a FIFO memory.

The MEM data was used together with the COL decoder to load 12 bits of LD into a temporary storage FIFO.

The memory is dynamic and has a ROW counter to keep track of its recirculating data.

To perform the write operation we must locate the correct ROW in memory and then replace the existing data with the new data stored in the temporary data FIFO 842, 844 (FIG. 26). The MEM and LINE data will appear at the output of the address FIFO's 842, 844. The five LINE bits are compared against the ROW counter 888, 890 outputs on FIG. 28. The ROW counter bits are called RA, RB, RC, RD and RE; RA being the LSB. The comparator is formed by exclusive OR gate 936 coupled to a magnitude comparator 938. When LINE equals ROW the output of comparator 938 goes high indicating the match. If a $\overline{\text{WREQ}}$ is being received from the DRIVER board (this indicates that the data has already arrived at the output of the storage FIFO) then the AND gate 940 inputs are high, enabling the write F/F 942. This F/F is clocked by WT (Write Trigger). WT is generated between each burst of twelve or sixteen ICLK's (see FIG. 28). When WT causes the Q output of F/F 942 to go high this indicates a write operation will be performed by the next twelve ICLK's.

The Q output of the write F/F partially enables the three AND gates 944 and also the NAND gate 946. The MEM data is brought out of FIFO 842 and applied to a binary-to-decimal decoder 948. The output of decoder 948 controls into which MEM the write operation is to be made, by selecting which of the three AND gates 944 is ultimately enabled. The resulting W1, W2, and W3 signals are sent to the DRIVER BOARD to write the data from the temporary storage FIFO's to the memory.

Figures 1, 27:
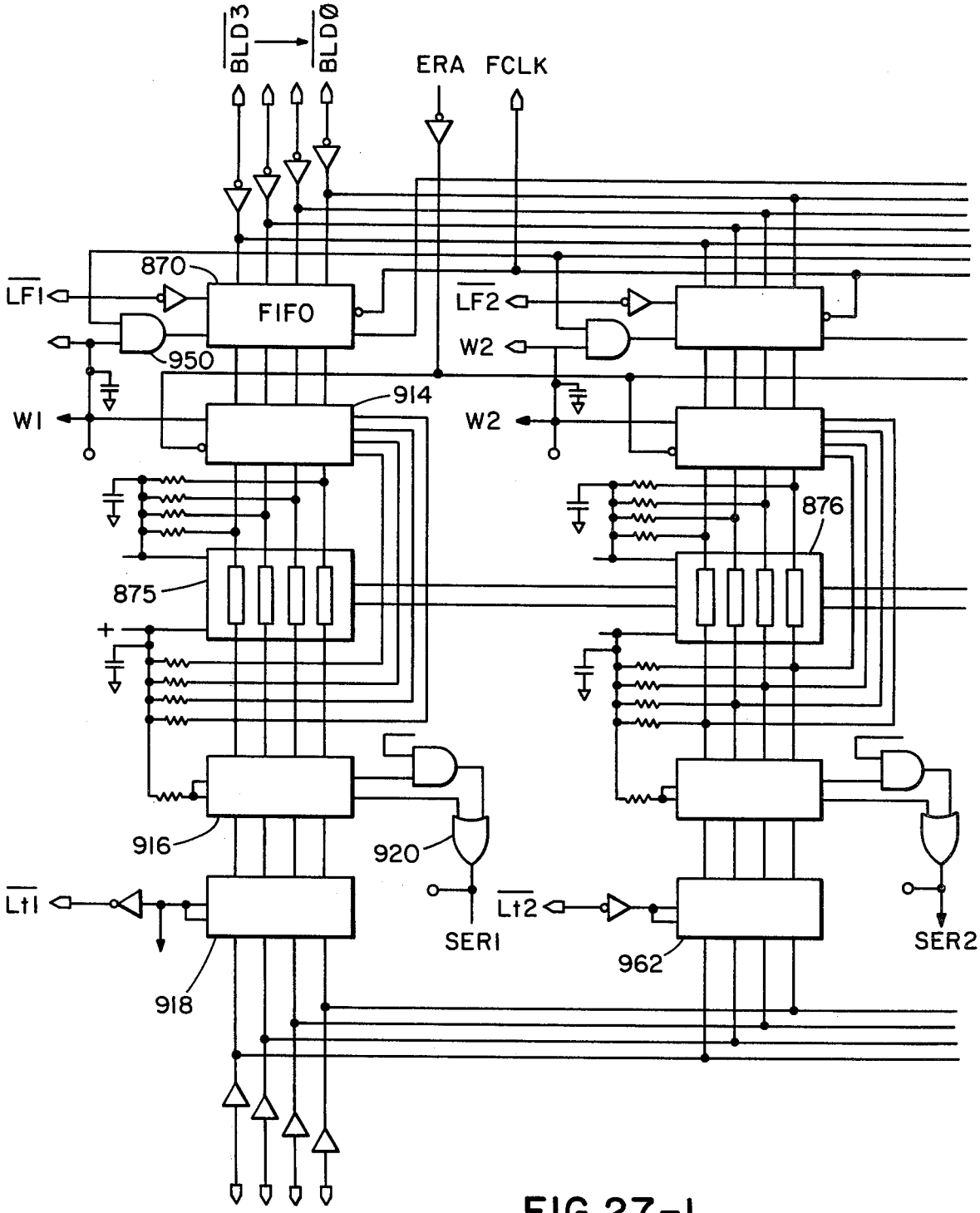
Figures 2, 27:
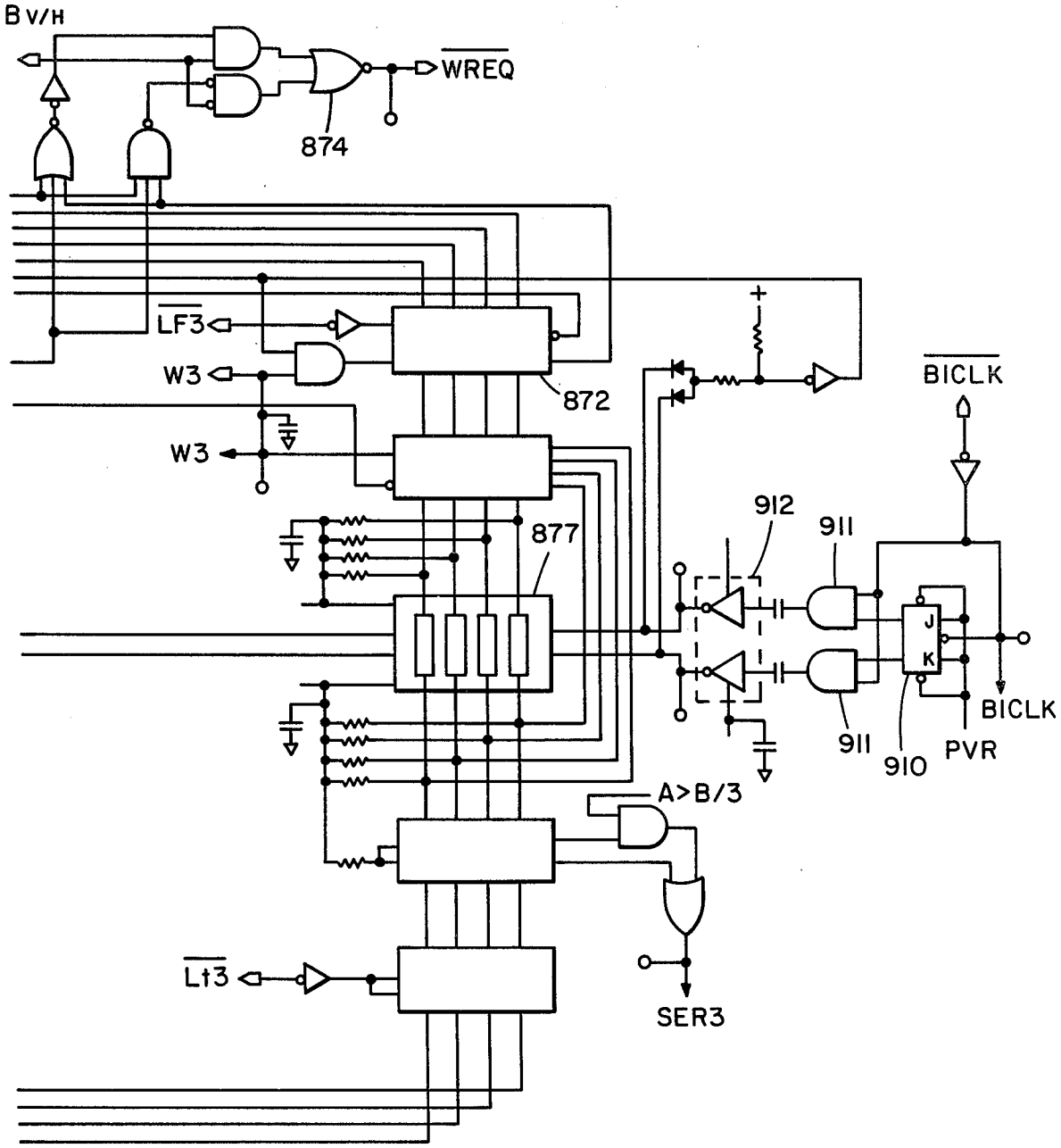
Figure 27A:
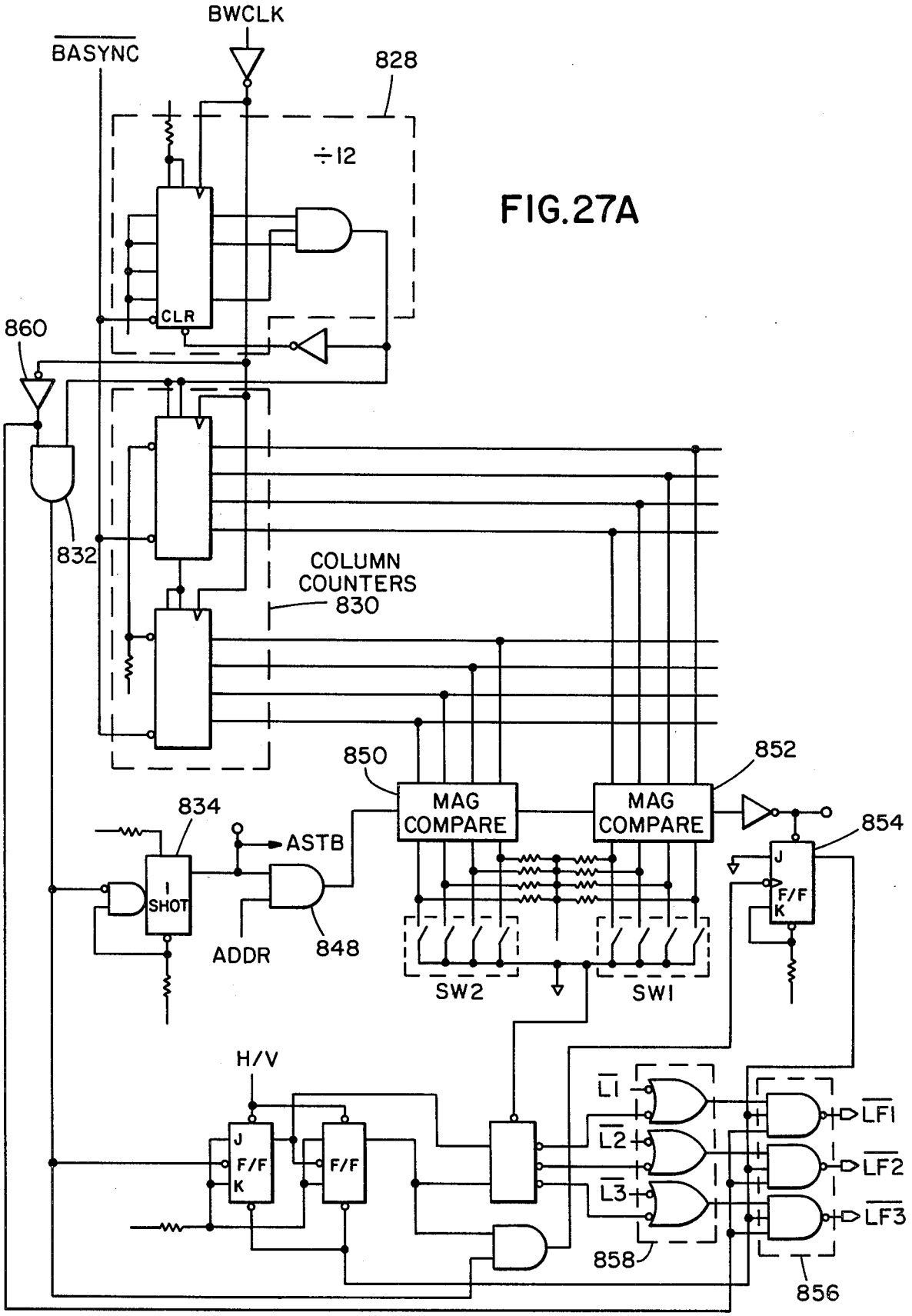

Referring now to the DRIVER BOARD of FIG. 27, observe the W1 signal goes to AND gate 950 allowing the recombined $\phi_1$ and $\phi_2$ clocks to shift out the contents of the FIFO 870. At the same time W1 causes the write control multiplexer 914 to switch off the recirculating data coming from the memory and substitute the FIFO outputs in its place.

On the CONTROLLER BOARD, FIG. 26, the CAR 12/16 pulse indicates the end of a write operation. The output of NAND gate 946 via OR 952 causes the address storage FIFO's 842 and 844 to shift out. This allows the next address stored in the FIFO to appear at its output, and the start of the next write cycle can begin. If no new cycle is to start, then the "D" input of the write F/F 942 will be disabled causing the next WT to clear the write F/F. This completes the description of the write operation.

There are a few peripheral circuits connected with those just discussed. On FIG. 26 are F/F 954. They from the first of two antilock-up circuits. If, for some mysterious reason, an invalid address were to be loaded into the address FIFO's, it would remain there unserviced by the write control circuits. To prevent this from happening the above F/F's will count three MSYNC pulses. If the FIFO has not been serviced within two passes of the memory, then the third MSYNC will cause a shift out to be delivered to the FIFO, dumping the bad address.

Another problem with FIFO's is that if excess data should accidentally be loaded into them, then all the data being piped through will be displaced by the number of excess bits remaining in the FIFO. To prevent this condition from persisting it becomes necessary to insure that the FIFO is empty prior to each transmission. This is accomplished by gating the ASTB pulse to the FIFO's master reset line. ASTB enters NAND gate 956 then passes through OR gate 958 and becomes $\overline{\text{FCLR}}$ (FIFO Clear) at its output. Monostable 960 allows this process to continue until a $\overline{\text{WREQ}}$ arrives from the DRIVER. The leading edge of $\overline{\text{WREQ}}$ triggers 960 which then prevents the generation of $\overline{\text{FCLR}}$ via the ASTB pulse. During a transmission the $\overline{\text{WREQ}}$ signal will make many transitions. Each oscillation will retrigger the monostable. Approximately 1 ms after the last $\overline{\text{WREQ}}$ has occurred the monostable will time out, restoring the FCLR's generated by ASTB. In this way, the FIFO's are kept clear between transmissions.

PHASE MULTIPLEXING

Up to this point we have ignored the fact that the control logic is driving lamps on three different phases. The comparator input on the DRIVER BOARD was shown as the output of only one $\phi$ pulse counter. In fact, it is the output of three $\phi$ pulse counters, time-multiplexed. FIG. 34 shows how the TRIAC BOARD control areas rotate phases between adjacent cards. In COL 1, M1 starts on Phase A, M2 on Phase B and M3 on Phase C. We will call this the ABC rotation. COL 2, therefore, has a BCA rotation, and COL 3 a CAB rotation.

As the data in the DRIVER's memory is being fed to the comparator's "A" input (FIG. 32), the lamp brightness data at the "B" input must be for the correct phase. For example, if we consider COL 1, M1 in FIG. 34, the first two rows of data must be compared to the phase A counter. Simultaneously, the M2 data must be compared to the phase B counter, and the M3 data must be compared against the phase C counter. As we progress through the memory the third and fourth rows are compared, M1 to $\phi$B, M2 to $\phi$C, and M3 to $\phi$A. Then for the fifth and sixth rows M1 to $\phi$C, M2 to $\phi$A and M3 to $\phi$B. The cycle then repeates itself.

The DRIVER schematic FIG. 27 contains three latches 918, 962 and 964. Each will hold the output of the lamp brightness counter needed to decode the lamp data currently being processed. The input of the latches are tied to a 4 bit bus which will contain the multiplexed output of the three lamp brightness counters. By clocking the latches with $\overline{\text{Lt1}}$, $\overline{\text{Lt2}}$ and $\overline{\text{Lt3}}$ at the correct time and in the correct order, the latches will be loaded.

The gap preceding each burst of twelve ICLK's is the proper time to change the latch contents, since no data is being processed in that interval. Since we must multiplex three counter outputs we will need three timing divisions inside each ICLK gap. The circuits which generate the three divisions are contained on the CONTROLLER BOARD schematics FIG. 28 and 30. Counter 884 is called the LSTB counter. The gating above it allows it to count four 4 MHz clocks from the xtal oscillator 878 between each burst of ICLK's. The associated decoding gates yield a signal called $\overline{\text{LSTB}}$ as the output from NAND gate 970. $\overline{\text{LSTB}}$ is a group of three pulses which divide the gap between ICLK bursts.

Figure 35:
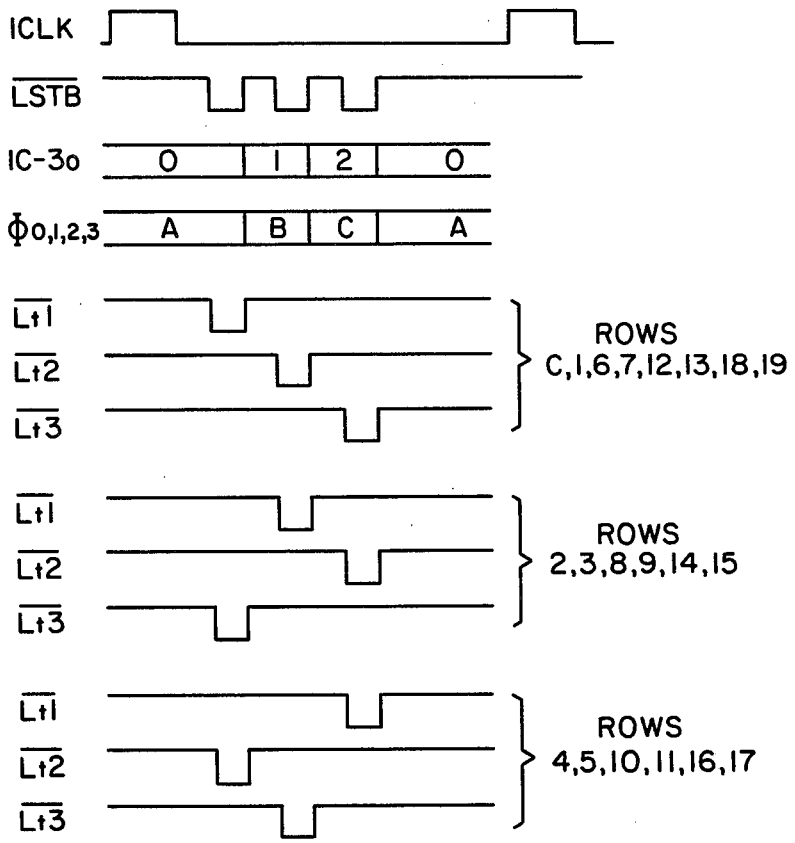
FIG. 35 is a timing diagram showing the time relationship of certain signals employed in producing an ABC rotation.

On FIG. 30 $\overline{\text{LSTB}}$ is used to increment a divide-by-3 counter 972 formed by the two J-K F/F. The two outputs of this divide-by-3 counter are applied to multiplexers 904 and 905. As counter 972 counts $\phi$, 1, 2 the multiplexers place the output of the $\phi$ pulse counters onto the $\phi\phi$ through $\phi$3 bus in the order $\phi$A, $\phi$B and oC. FIG. 35 shows the timing relationship of the $\overline{\text{LSTB}}$ and $\phi$ data.

To load the driver latches we require three $\overline{\text{Lt}}$ signals. Notice tht if $\overline{\text{Lt1}}$ is generated when counter 972 is on count $\phi$, then its corresponding latch will load $\phi$A outputs. If generated when the counter is on count 1, then $\phi$B outputs will be latched; if count 2, the $\phi$C. This same rule applies to $\overline{\text{Lt2}}$ and $\overline{\text{Lt3}}$. Thus, if the $\overline{\text{Lt}}$ signals can be caused to shift their positions during the $\overline{\text{LSTB}}$ cycles, we can rotate the lamp brightness data being latched at the DRIVER. The CONTROLLER schematic, FIG. 30, has a circuit which performs the rotation. Counter 974 is a divide-by-3 counter that is presettable by MSYNC. SW4 (ROTa) is a thumbwheel switch which allows control of the preset value of the counter and, therefore, the rotation sequence. See the table in the upper left hand corner of FIG. 30. Each group of $\overline{\text{LSTB}}$'s will cycle the counter of 974. Circuit 976 is a binary-to-decimal decoder which converts the output of the counter to the three $\overline{\text{Lt}}$ signals. Its output is strobed by $\overline{\text{LSTB}}$. In this way $\overline{\text{Lt1}}$, $\overline{\text{Lt2}}$, and $\overline{\text{Lt3}}$ are generated.

To get the position of the $\overline{\text{Lt}}$ signals to shift, it is necessary to cause the counter 974 to slip one count cycle during the counting of the last $\overline{\text{LSTB}}$ of each odd-numbered row. The odd rows are all identified by the T/B signal being high. If we decode counter 972 when it is on count 2 and NAND this with T/B, we have a signal at gate 978 that will inhibit $\overline{\text{LSTB}}$ from incrementing the counter 974. Thus, the position of $\overline{\text{Lt1}}$, $\overline{\text{Lt2}}$, and $\overline{\text{Lt3}}$ will rotate as shown in FIG. 35. This satisfies the requirements of the M1 through M3 comparators on the DRIVER BOARD. The lamp data will be decoded using the correct phase brightness counter. This is only half the problem, however. The DRIVER BOARD circuits on FIG. 3 3 require the correct $\phi$ pulse to be applied at $\overline{\phi P1}$, $\overline{\phi P2}$ $\overline{\phi P3}$.

Figure 36:
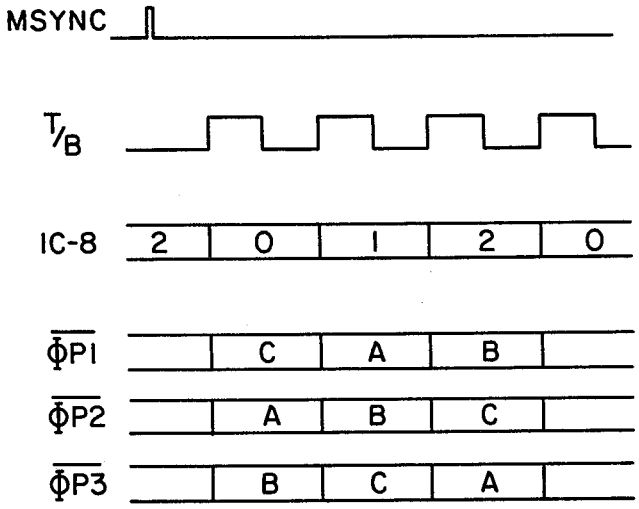
FIG. 36 illustrates the $\phi$ P outputs for a CAB rotation.

The CONTROLLER BOARD, FIG. 30, has multiplexers 980 and 982 for just this application. The $\overline{B\phi A}$, $\overline{B\phi B}$ and $\overline{B\phi C}$ pulses are applied to the inputs of the multiplexers in such a way that when divide by 3 counter 984 cycles from $\phi$, 1, 2 the output of the multiplexers follows the scheme shown in FIG. 36.

As before, SW4 and $\overline{MSYNC}$ are used to preset the counter. The positive going edge of T/B is used to increment it. Thus, as the A, B, C, D counter addresses the TRIAC BOARDS, the counter of 984 multiplexes the correct rotation of $\phi$ pulses as selected by SW4.

While we have shown and described embodiments of this invention in some detail, it will be understood that this description and illustrations are offered merely by way of example, and that the invention is to be limited in scope only by the appended claims.

We claim:

1. A high resolution system for displaying video images on a pluraity of variable intensity display devices in real time, said images representing selected portions of video frames received from a video source in raster (TV) format, said system comprising:

(a) a video converter receiving the raster lines of video information corresponding to each frame, said converter including quantizing means for generating digital data representative of the relative intensity of said video information at selected points on selected raster lines of said frames and means for selecting which lines and the number of said points per line for which digital data is generated, said digital data being generated at a first rate, sufficient to keep up with the rate at which the video information is received;

(b) transmitter means receiving said digital data at said first rate for transmitting it to said display devices in a modified raster line format without frame storage, said transmitter means including means for dividing each line of digital data into at least two segments and means for transmitting in parallel the data for each of said segments to said display devices, whereby the line at a time raster format of the video information is retained but the effective rate of transmission of data to the display devices corresponding to each segment is reduced to a second rate approximately equal to said first rate divided by the number of said segments, the reduced data rate permitting display of an increased number of data points per raster line and/or the use of more raster lines from the video source;

(c) interface means for selectively connecting said converter to said transmitter means;

(d) means for controlling the operation of said interface means thereby directing the transfer of data between said converter and transmitter means.

2. The system according to claim 1 wherein said display devices are operated by a three phase AC power supply and said transmitter means includes a phase genertor for producing signals for synchronizing the digital data to the correct phase of said AC power supply.

3. The system according to claim 1 wherein said system further includes a display buffer capable of storing digital data representative of selected portions of a complete frame of video information, said interface means permitting transfer of digital data from said converter to said buffer and transfer of data from said buffer to said transmitter means for transmission to said display devices, said buffer permitting the capture and storing of animations, photographs and messages for processing and subsequent display.

4. The system according to claim 3 further including rotation means for manipulating selected digital data stored in said buffer to move data stored in selected memory locations of said buffer to successively displaced locations whereby when the display devices repetitively receive data from the buffer the data will cause the corresponding display to appear to move across the display devices in the manner of a travelling sign.

5. The system according to claim 4 wherein said rotation means includes:

(a) means for cyclically and sequentially addressing selected locations in said buffer to cause data to be read from and restored to said locations;

(b) shift register means receiving the data from each addressed buffer location for shifting said data a selected number of bits in a selected direction and restoring the shifted data to the same buffer location;

(c) linking register means operatively connected to said shift register means for receiving said temporarily storing the bits shifted out one side of the shift register means during each shift cycle and for inserting the shifted bits back into the other side of said shift register means during the next shift cycle corresponding to the next buffer address in the sequence, whereby the data in the addressed locations are shifted in a selected direction across the buffer so that a repetitive display of the data in the buffer, after each shift cycle is complete, will cause the data to appear to travel across the matrix in the manner of a travelling sign display.

6. The system according to claim 1 wherein said video converter includes:

(a) a quantizer having a phase lock loop (PLL) circuit operable at a selectable rate, said selectable rate determining the number of selected points on said raster line for which digital data is generated;

(b) means for selecting the rate at which said PLL operates.

7. The system according to claim 1 wherein said line dividing means includes:

(a) an input register receiving said data;

(b) buffer means for each of said segments;

(c) logic means for cyclically and sequentially transferring said data from said input register to said segment buffers.

8. The system according to claim 7 wherein said parallel transmitting means includes output control logic for the buffer means for causing the data segments in the buffer means to be transmitted in parallel to said display devices at said second rate whereby the entire line of data is transmitted to said display devices in real time without the need for full frame buffer storage.

9. A rotation circuit for manipulating digital data stored in a buffer memory representing information to be displayed on a matrix of display devices for causing said information to appear to travel across the display matrix in a selected direction, said circuit comprising:

(a) means for cyclically and sequentially addressing selected memory locations in said buffer to cause data to be read from and restored to said locations;

(b) shift register means recieving the data from each addressed buffer location for shifting said data a selected number of bits in a selected direction and restoring the shifted data to the same buffer location;

(c) linking register means operatively connected to said shift register means for receiving and temporarily storing the bits shifted out one side of the shift register means during each shift cycle and for inserting the shifted bits back into the other side of said shift register means during the next shift cycle corresponding to the next buffer address in the sequence, whereby the data in the addressed locations are shifted in a selected direction across the buffer so that a repetitive display of the data in the buffer, after each shift cycle is complete, will cause the data to appear to travel across the matrix in the manner of a travelling sign display.

* * * * *